US009044129B2

(12) United States Patent
McLuckie et al.

(10) Patent No.: US 9,044,129 B2
(45) Date of Patent: Jun. 2, 2015

(54) SURFACE TREATING APPLIANCE

(75) Inventors: Paul Andrew McLuckie, Malmesbury (GB); William David Postle, Malmesbury (GB); Samuel James Czerpak, Malmesbury (GB); Christopher Thomas Watson, Malmesbury (GB); Leigh Michael Ryan, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 882 days.

(21) Appl. No.: 12/900,873

(22) Filed: Oct. 8, 2010

(65) Prior Publication Data

US 2011/0088202 A1 Apr. 21, 2011

(30) Foreign Application Priority Data

Oct. 15, 2009 (GB) ..... 0918019.1

(51) Int. Cl.
*A47L 5/28* (2006.01)
*A47L 5/32* (2006.01)

(52) U.S. Cl.
CPC ..... *A47L 5/32* (2013.01)

(58) Field of Classification Search
CPC ..... A47L 5/225; A47L 5/24; A47L 5/32; A47L 9/02; A47L 9/325; A47L 9/327
USPC ..... 15/331, 334, 335, 338, 410
IPC ..... A47L 5/28
See application file for complete search history.

(56) References Cited

U.S. PATENT DOCUMENTS 1,689,166 A 10/1928 Varner
2,162,313 A 6/1939 McCabe et al.

(Continued)

FOREIGN PATENT DOCUMENTS

CN 1674819 9/2005
CN 101511247 8/2009

(Continued)

OTHER PUBLICATIONS

GB Search Report dated Jan. 27, 2010 directed to counterpart GB Application No. 0918019.1; 1 page.

(Continued)

*Primary Examiner* — David Redding
(74) *Attorney, Agent, or Firm* — Morrison & Foerster LLP

(57) ABSTRACT

A surface treating appliance includes a surface treating head, a hose, and a main body including a fan unit for generating a flow of fluid, and a rotary changeover valve including a valve member which is selectively rotatable between a first position allowing fluid flow between the hose and the fan unit, and a second position allowing fluid flow between the surface treating head and the fan unit, the valve member comprising a hub having an internal surface shaped to receive a boss about which the valve member is selectively rotatable. To facilitate the breaking of seals by valve member and other parts of the appliance as the valve member moves away from one of its first and second positions, the external surface of the boss and the internal surface of the hub each has a profile generally in the form of a triangular prism, the profile of the external surface of the boss tapering towards the valve member. As a result, the valve member is forced to move along the longitudinal axis of the boss as it is rotated thereabout.

19 Claims, 41 Drawing Sheets

(56) References Cited

U.S. PATENT DOCUMENTS

| | | | | |
|---|---|---|---|---|
| 2,165,678 | A | | 7/1939 | Riebel, Jr. et al. |
| 2,218,161 | A | | 10/1940 | Berg |
| 2,218,163 | A | | 10/1940 | Carlson |
| 2,226,362 | A | | 12/1940 | White |
| 2,243,066 | A | | 5/1941 | Becker |
| 2,260,222 | A | | 10/1941 | Hahn |
| 2,525,282 | A | | 10/1950 | Brace |
| 2,525,283 | A | | 10/1950 | Brace |
| 2,534,479 | A | | 12/1950 | Sellers |
| 2,550,384 | A | | 4/1951 | Senne |
| 2,591,214 | A | | 4/1952 | Tamarin |
| 2,644,976 | A | | 7/1953 | Osborn |
| 2,684,271 | A | | 7/1954 | Brace |
| 2,686,330 | A | | 8/1954 | Wales |
| 2,719,318 | A | | 10/1955 | Tschudy |
| 2,750,618 | A | | 6/1956 | Kaufman |
| 2,898,622 | A | | 8/1959 | Hurd |
| 3,150,394 | A | | 9/1964 | Sauers |
| 3,655,005 | A | | 4/1972 | Chicurel |
| 3,794,351 | A | | 2/1974 | Cudmore |
| 3,932,912 | A | | 1/1976 | Johnson |
| 4,129,920 | A | | 12/1978 | Evans et al. |
| 4,145,064 | A | | 3/1979 | Carn |
| 4,307,485 | A | | 12/1981 | Dessig, III |
| 4,397,060 | A | | 8/1983 | Jinkins et al. |
| 4,423,534 | A | | 1/1984 | Lyman et al. |
| 4,472,855 | A | | 9/1984 | Murphy et al. |
| 4,573,236 | A | | 3/1986 | Dyson |
| 4,696,076 | A | | 9/1987 | Ahlf et al. |
| 4,785,899 | A | | 11/1988 | von Winckelmann |
| 4,811,452 | A | | 3/1989 | Sumerau |
| 5,086,538 | A | | 2/1992 | Zahuranec |
| 5,168,598 | A | | 12/1992 | Hashizume et al. |
| 5,323,510 | A | | 6/1994 | Redding et al. |
| 5,351,361 | A | | 10/1994 | Buchtel |
| 5,355,549 | A | * | 10/1994 | Steinberg et al. ..... 15/334 |
| 5,584,095 | A | | 12/1996 | Redding et al. |
| 5,794,305 | A | | 8/1998 | Weger |
| 5,836,047 | A | | 11/1998 | Lee et al. |
| 5,839,156 | A | | 11/1998 | Park et al. |
| 6,006,401 | A | | 12/1999 | Jailor et al. |
| 6,055,703 | A | | 5/2000 | Redding et al. |
| 6,141,822 | A | | 11/2000 | Riviera-Boklund et al. |
| 6,167,587 | B1 | | 1/2001 | Kasper et al. |
| 6,277,164 | B1 | | 8/2001 | Embree et al. |
| 6,345,411 | B1 | | 2/2002 | Kato et al. |
| 6,519,807 | B1 | | 2/2003 | Thomson |
| 6,553,613 | B2 | | 4/2003 | Onishi et al. |
| 6,572,078 | B1 | | 6/2003 | Thomson et al. |
| 6,574,827 | B2 | | 6/2003 | Hashizume et al. |
| 6,588,051 | B2 | | 7/2003 | Hashizume et al. |
| 6,618,898 | B2 | | 9/2003 | Tingle |
| 6,678,916 | B2 | | 1/2004 | Hashizume et al. |
| 6,684,451 | B2 | | 2/2004 | Kato et al. |
| 6,745,432 | B2 | | 6/2004 | Wright et al. |
| 6,772,474 | B2 | | 8/2004 | Nishikori et al. |
| 6,807,708 | B2 | | 10/2004 | Roney et al. |
| RE39,304 | E | | 9/2006 | Kasen et al. |
| 7,213,297 | B2 | | 5/2007 | Nam et al. |
| 7,310,855 | B2 | | 12/2007 | Blocker et al. |
| 7,581,284 | B2 | | 9/2009 | Courtney |
| 7,581,285 | B2 | | 9/2009 | Courtney |
| 7,600,292 | B2 | | 10/2009 | Courtney |
| 7,607,196 | B2 | | 10/2009 | Li |
| 7,610,653 | B2 | | 11/2009 | Courtney |
| 7,757,343 | B2 | | 7/2010 | Courtney |
| 7,805,804 | B2 | | 10/2010 | Loebig |
| 7,823,251 | B2 | | 11/2010 | Dyson et al. |
| 7,836,544 | B2 | | 11/2010 | Jansen |
| 7,950,102 | B2 | | 5/2011 | Lee et al. |
| 8,112,841 | B2 | | 2/2012 | Garcia et al. |
| 8,186,007 | B2 | | 5/2012 | Iseringhausen et al. |
| 8,272,097 | B2 | | 9/2012 | Poetting |
| 8,327,504 | B2 | | 12/2012 | Helps et al. |
| 8,347,454 | B2 | | 1/2013 | Ashbee et al. |
| 2002/0129460 | A1 | | 9/2002 | Roney et al. |
| 2003/0084536 | A1 | | 5/2003 | Yung |
| 2003/0131440 | A1 | | 7/2003 | Illingworth |
| 2003/0188396 | A1 | | 10/2003 | Hitzelberger et al. |
| 2004/0060146 | A1 | | 4/2004 | Coates et al. |
| 2004/0216263 | A1 | | 11/2004 | Best et al. |
| 2004/0261213 | A1 | | 12/2004 | Park et al. |
| 2005/0125937 | A1 | | 6/2005 | Nielsen |
| 2005/0223516 | A1 | | 10/2005 | Courtney |
| 2005/0223517 | A1 | | 10/2005 | Courtney |
| 2005/0235454 | A1 | | 10/2005 | Courtney |
| 2006/0021184 | A1 | | 2/2006 | Hawkins et al. |
| 2007/0209114 | A1 | | 9/2007 | Chu |
| 2007/0209144 | A1 | | 9/2007 | Fester et al. |
| 2008/0022482 | A1 | | 1/2008 | Courtney |
| 2008/0115313 | A1 | | 5/2008 | Dyson et al. |
| 2009/0056064 | A1 | | 3/2009 | Finke et al. |
| 2009/0056065 | A1 | | 3/2009 | Finke |
| 2009/0078284 | A1 | | 3/2009 | McDowell et al. |
| 2009/0165242 | A1 | | 7/2009 | Lee et al. |
| 2009/0288268 | A1 | | 11/2009 | Courtney |
| 2010/0088842 | A1 | | 4/2010 | Worker et al. |
| 2010/0095477 | A1 | | 4/2010 | Worker et al. |
| 2010/0139030 | A1 | | 6/2010 | Yoo |
| 2010/0236015 | A1 | | 9/2010 | Worker et al. |
| 2011/0088194 | A1 | | 4/2011 | White |
| 2011/0088195 | A1 | | 4/2011 | Dyson et al. |
| 2011/0088196 | A1 | | 4/2011 | Wills et al. |
| 2011/0088197 | A1 | | 4/2011 | Postle et al. |
| 2011/0088198 | A1 | | 4/2011 | Wills et al. |
| 2011/0088200 | A1 | | 4/2011 | White et al. |
| 2011/0088205 | A1 | | 4/2011 | Dyson et al. |
| 2011/0088206 | A1 | | 4/2011 | Ford et al. |
| 2011/0088208 | A1 | | 4/2011 | White et al. |
| 2011/0088210 | A1 | | 4/2011 | White et al. |
| 2011/0088211 | A1 | | 4/2011 | Dyson et al. |
| 2011/0088212 | A1 | | 4/2011 | Dyson et al. |

FOREIGN PATENT DOCUMENTS

| | | |
|---|---|---|
| DE | 195 20 236 | 12/1996 |
| EP | 0 353 546 | 2/1990 |
| EP | 0909546 | 4/1999 |
| EP | 0 947 155 | 10/1999 |
| EP | 0 963 731 | 12/1999 |
| EP | 1 121 889 | 8/2001 |
| EP | 1 129 657 | 9/2001 |
| EP | 1 136 029 | 9/2001 |
| EP | 1 388 318 | 2/2004 |
| EP | 1 526 796 | 5/2005 |
| EP | 1 647 219 | 4/2006 |
| EP | 1 915 937 | 4/2008 |
| EP | 2 030 547 | 3/2009 |
| EP | 2 113 183 | 11/2009 |
| FR | 2 826 851 | 1/2003 |
| GB | 2 181 638 | 4/1987 |
| GB | 2 333 442 | 7/1999 |
| GB | 2 337 923 | 12/1999 |
| GB | 2 388 310 | 11/2003 |
| GB | 2 391 459 | 2/2004 |
| GB | 2 402 048 | 12/2004 |
| GB | 2 422 094 | 7/2006 |
| GB | 2 433 425 | 6/2007 |
| GB | 2 441 299 | 3/2008 |
| GB | 2 441 300 | 3/2008 |
| GB | 2 441 301 | 3/2008 |
| GB | 2 452 548 | 3/2009 |
| GB | 2 452 549 | 3/2009 |
| GB | 2 454 448 | 5/2009 |
| JP | 61-48328 | 3/1986 |
| JP | 3-4825 | 1/1991 |
| JP | 4-166117 | 6/1992 |
| JP | 2001-204653 | 7/2001 |
| JP | 2001-314356 | 11/2001 |
| JP | 2003-111885 | 4/2003 |
| JP | 2004-188104 | 7/2004 |
| JP | 2009-61286 | 3/2009 |
| KR | 97-010410 | 6/1997 |
| KR | 2003-0088639 | 11/2003 |

(56) References Cited

FOREIGN PATENT DOCUMENTS

| | | |
|---|---|---|
| TW | 200826891 | 7/2008 |
| WO | WO-95/01748 | 1/1995 |
| WO | WO-99/30602 | 6/1999 |
| WO | WO-00/21424 | 4/2000 |
| WO | WO-00/21425 | 4/2000 |
| WO | WO-00/21426 | 4/2000 |
| WO | WO-01/45545 | 6/2001 |
| WO | WO-02/080749 | 10/2002 |
| WO | WO-03/070078 | 8/2003 |
| WO | WO-2008/025956 | 3/2008 |
| WO | WO-2008/037955 | 4/2008 |
| WO | WO-2008/037957 | 4/2008 |
| WO | WO-2008/135708 | 11/2008 |
| WO | WO-2009/030885 | 3/2009 |
| WO | WO-2010/070258 | 6/2010 |

OTHER PUBLICATIONS

White et al., U.S. Office Action mailed Jan. 18, 2013, directed to U.S. Appl. No. 12/899,334; 13 pages.
White et al., U.S. Office Action mailed Dec. 7, 2012, directed to U.S. Appl. No. 12/900,187; 12 pages.
Dyson et al., U.S. Office Action mailed Jan. 29, 2013, directed to U.S. Appl. No. 12/901,162; 7pages.
Wills et al., U.S. Office Action mailed Mar. 25, 2013, directed to U.S. Appl. No. 12/900,304; 7 pages.
Courtney, U.S. Office Action mailed Jan. 23, 2008, directed to U.S. Appl. No. 10/522,339; 6 pages.
Courtney, U.S. Office Action mailed Sep. 8, 2008, directed to U.S. Appl. No. 10/522,339; 8 pages.
Courtney, U.S. Office Action mailed Apr. 23, 2009, directed to U.S. Appl. No. 10/522,339; 6 pages.
Courtney, U.S. Office Action mailed Mar. 6, 2008, directed to U.S. Appl. No. 11/868,809; 8 pages.
Courtney, U.S. Office Action mailed Nov. 13, 2008, directed to U.S. Appl. No. 11/868,809; 7 pages.
Courtney, U.S. Office Action mailed Jan. 26, 2010, directed to U.S. Appl. No. 12/533,328; 4 pages.
Courtney, U.S. Office Action mailed Jun. 23, 2008, directed to U.S. Appl. No. 10/522,478; 7 pages.
Courtney, U.S. Office Action mailed Jan. 6, 2009, directed to U.S. Appl. No. 10/522,478; 5 pages.
Courtney, U.S. Office Action mailed Mar. 23, 2009, directed to U.S. Appl. No. 10/522,478; 6 pages.
Courtney, U.S. Office Action mailed May 26, 2009, directed to U.S. Appl. No. 10/522,478; 5 pages.
Courtney, U.S. Office Action mailed Jun. 20, 2008, directed to U.S. Appl. No. 10/523,246; 8 pages.
Courtney, U.S. Office Action mailed Dec. 24, 2008, directed to U.S. Appl. No. 10/523,246; 5 pages.
White et al., U.S. Office Action mailed Nov. 7, 2013, directed to U.S. Appl. No. 12/900,187; 12 pages.
Dyson et al., U.S. Office Action mailed Nov. 26, 2013, directed to U.S. Appl. No. 12/901,258; 9 pages.
Postle et al., U.S. Office Action mailed Sep. 20, 2013, directed to U.S. Appl. No. 12/901,949; 5 pages.
Ford et al., U.S. Office Action mailed Apr. 10, 2013, directed to U.S. Appl. No. 12/899,360; 11 pages.
White et al., U.S. Office Action mailed Apr. 11, 2013, directed to U.S. Appl. No. 12/900,196; 5 pages.
Dyson et al., U.S. Office Action mailed May 15, 2013, directed to U.S. Appl. No. 12/899,313; 7 pages.
Dyson et al., U.S. Office Action mailed Apr. 17, 2013, directed to U.S. Appl. No. 12/901,258; 9 pages.
Wills et al., U.S. Office Action mailed May 9, 2013, directed to U.S. Appl. No. 12/902,817; 11 pages.
Wills et al., U.S. Office Action mailed Feb. 25, 2014, directed to U.S. Appl. No. 12/902,817; 8 pages.
Collins English Dictionary. (2014) "Between," located at <http://www.collinsdictionary.com/dictionary/english/between> visited on Apr. 17, 2014. (2 pages).

* cited by examiner

SURFACE TREATING APPLIANCE

REFERENCE TO RELATED APPLICATIONS

This application claims the priority of United Kingdom Application No. 0918019.1, filed Oct. 15, 2009, the entire contents of which are incorporated herein by reference.

FIELD OF THE INVENTION

The present invention relates to a surface treating appliance.

BACKGROUND OF THE INVENTION

Surface treating appliances such as vacuum cleaners are well known. The majority of vacuum cleaners are either of the "upright" type or of the "cylinder" type (also referred to canister or barrel machines in some countries). An upright vacuum cleaner typically comprises a main body containing dirt and dust separating apparatus, a pair of wheels mounted on the main body for maneuvering the vacuum cleaner over a floor surface to be cleaned, and a cleaner head mounted on the main body. The cleaner head has a downwardly directed suction opening which faces the floor surface. The vacuum cleaner further comprises a motor-driven fan unit for drawing dirt-bearing air through the suction opening. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement.

In use, a user reclines the main body of the vacuum cleaner towards the floor surface, and then sequentially pushes and pulls a handle which is attached to the main body of the cleaner to maneuver the vacuum cleaner over the floor surface. The dirt-bearing air flow drawn through the suction opening by the fan unit is conducted to the separating apparatus by a first air flow duct. When dirt and dust has been separated from the air flow, the air flow is conducted to a clean air outlet by a second air flow duct. One or more filters may be provided between the separating apparatus and the clean air outlet.

An example of an upright vacuum cleaner is described in WO2008/037955. The main body of the vacuum cleaner is moveable between an upright position and a reclined position for maneuvering over a floor surface to be cleaned. The vacuum cleaner comprises a stand which is moveable relative to the main body between a supporting position for supporting the main body in its upright position, and a retracted position so that the stand does not interfere with the maneuvering of the vacuum cleaner over the floor surface. The vacuum cleaner also comprises a hose and wand assembly connected to the main body through which air can be drawn into the vacuum cleaner and a changeover valve which is moveable to connect either the hose and wand assembly or the cleaner head to the fan unit depending on the position of the main body.

The changeover valve comprises a casing which houses a cylindrical drum. The casing comprises a first fluid inlet connected to the hose and wand assembly, a second fluid inlet connected to the cleaner head and a fluid outlet connected to the fan unit. The drum comprises a fluid inlet located on a side wall thereof, and a fluid outlet located on an end wall thereof. A wheel is connected to the drum to rotate the drum within the casing so that the fluid inlet of the drum is connected to a selected one of the fluid inlets of the casing. The wheel is rotated by the stand as the stand moves between its supporting and retracted positions. When the stand is in its supporting position the fluid inlet of the drum is connected to the hose and wand assembly, whereas when the stand is in its retracted position the fluid inlet of the drum is connected to the cleaner head.

SUMMARY OF THE INVENTION

The present invention provides a surface treating appliance comprising a surface treating head, a hose, and a main body comprising a fan unit for generating a flow of fluid, and a rotary changeover valve comprising a valve member which is selectively rotatable between a first position allowing fluid flow between the hose and the fan unit, and a second position allowing fluid flow between the surface treating head and the fan unit, the valve member comprising a hub having an internal surface shaped to receive a boss about which the valve member is selectively rotatable, wherein the external surface of the boss and the internal surface of the hub are shaped to impart a translational movement of the valve member along the boss as the valve member is rotated about the boss.

Due to the shapes of the hub and the boss, the movement of the valve member between its first and second positions has two different components: (i) a rotational movement about the longitudinal axis of the boss with the valve drive, and (ii) a translational movement along the longitudinal axis of the boss relative to the valve drive. The rotational movement of the valve member allows the fan unit to be selectively connected to one of the surface treating head and the hose, whereas the translational movement of the valve member facilitates the breaking of seals between the valve member and, for example, a valve body within which the valve member is rotatable. The translational movement of the valve member can reduce the force required to move the valve member between its first and second positions, and can also enhance the lifetime of the seals.

Preferably, each of the external surface of the boss and the internal surface of the hub has a profile generally in the form of a prism. This prism is preferably a regular prism having curved edges. In a preferred embodiment each of the external surface of the boss and the internal surface of the hub has a profile generally in the form of a triangular prism. The external surface of the boss preferably tapers towards the valve member. The internal surface of the hub preferably tapers away from the boss. Conforming profiles of the inner surface of the hub and the outer surface of the boss can allow the valve member to be accurately aligned, both angularly and axially, relative to the boss in its first and second positions.

The changeover valve preferably comprises a valve drive for driving the valve member between its first and second positions. The valve drive is preferably rotatable about the longitudinal axis of the boss. The valve member is preferably located between the boss and the valve drive. The appliance preferably comprises means for biasing the valve member away from the valve drive along the longitudinal axis of the boss. This can urge the valve member towards a position in which it is correctly seated with respect to the boss. The valve drive may comprise a pair of drive arms, and wherein the valve drive comprises a lever which is received between the drive arms of the valve drive, thereby allowing the valve member to move towards and away from the valve drive during the rotation thereof.

The appliance preferably comprises a stand moveable between a supporting position, in which it supports the main body, and a retracted position and which is arranged to induce movement of the valve drive as it moves between its supporting and retracted positions. The movement of the valve drive may be effected by an arrangement similar to a Geneva drive. For example, a pin on the stand may be arranged to engage with a slot on the valve drive.

The valve member preferably comprises an elbow-shaped conduit having a fluid port located at each end thereof.

The changeover valve preferably comprises a valve body comprising a first section for receiving fluid flow from the surface treating head, a second section for receiving fluid flow from the hose, and third section for conveying fluid flow towards the fan unit. The sections of the valve body are preferably angularly spaced, more preferably equally angularly spaced, about a circular path defined by the valve body.

The boss is preferably connected to the main body, more preferably to a casing housing the fan unit rather than to a separate component of the main body.

The appliance preferably comprises separating apparatus located downstream from the changeover valve for separating dirt from a fluid flow. The separating apparatus is preferably in the form of a cyclonic separating apparatus having at least one cyclone, and which preferably comprises a chamber for collecting dirt separated from the air flow. Other forms of separator or separating apparatus can be used and examples of suitable separator technology include a centrifugal separator, a filter bag, a porous container or a liquid-based separator.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
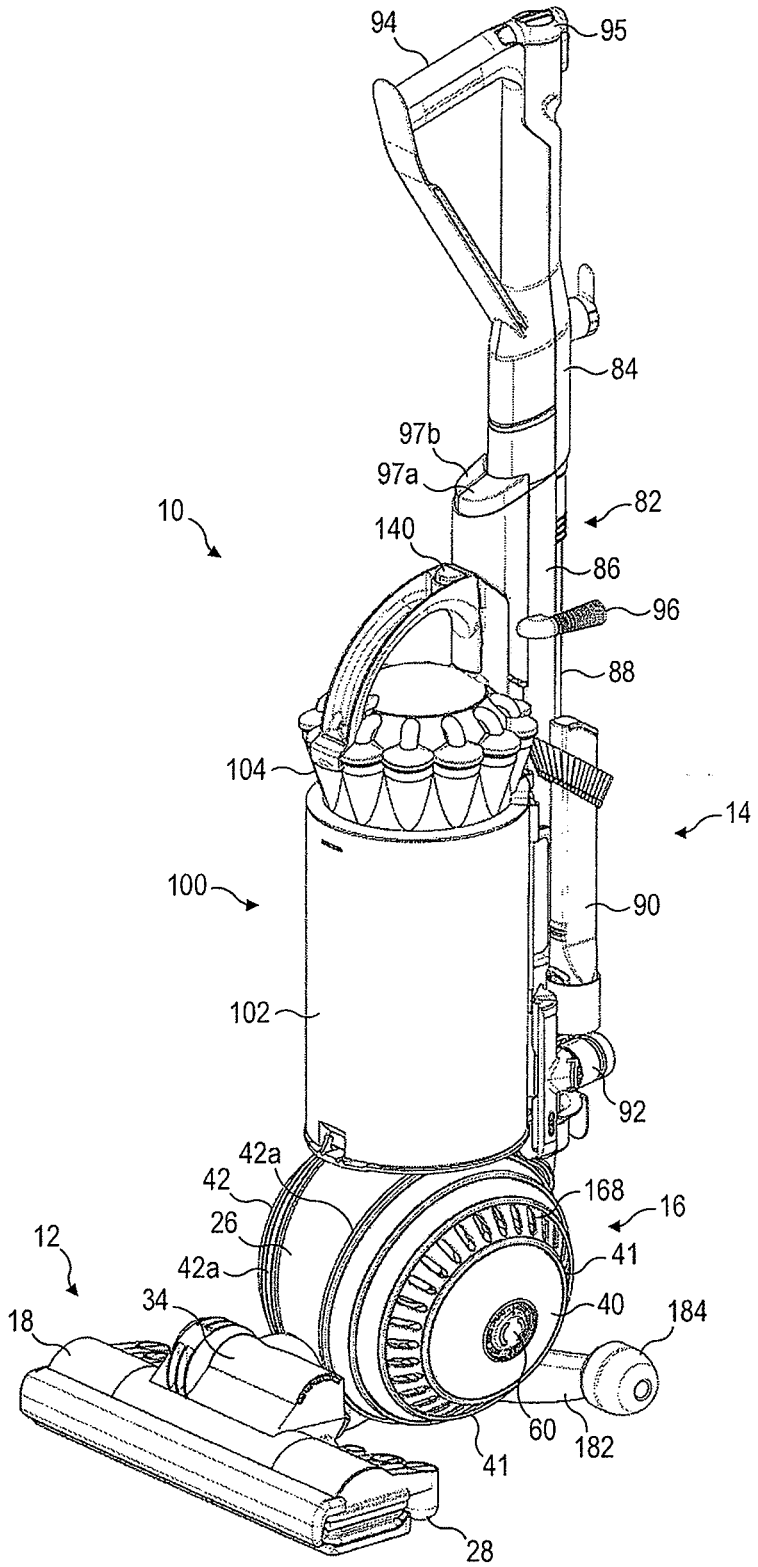
FIG. 1 is a front perspective view, from the left, of an upright vacuum cleaner.

FIGS. 1 to 4 illustrate an upright surface treating appliance, which is in the form of an upright vacuum cleaner. The vacuum cleaner 10 comprises a cleaner head 12, a main body 14 and a support assembly 16. In the FIGS. 1, 2*a*, 3 and 4, the main body 14 of the vacuum cleaner 10 is in an upright position relative to the cleaner head 12, whereas in FIG. 2*b* the main body 14 is in a fully reclined position relative to the cleaner head 12.

The cleaner head 12 comprises a housing 18 and a lower plate, or sole plate 20, connected to the housing 18. The sole plate 20 comprises a suction opening 22 through which a dirt-bearing air flow enters the cleaner head 12. The sole plate 20 has a bottom surface which, in use, faces a floor surface to be cleaned, and which comprises working edges for engaging fibers of a carpeted floor surface. The housing 18 defines a suction passage extending from the suction opening 22 to a fluid outlet 24 located at the rear of the housing 18. The fluid outlet 24 is dimensioned to connect to a yoke 26 for connecting the cleaner head 12 to the main body 14 of the vacuum cleaner 10. The yoke 26 is described in more detail below. The lower surface of the cleaner head 12 can include small rollers 28 to ease movement of the cleaner head 12 across the floor surface.

The cleaner head 12 comprises an agitator for agitating dirt and dust located on the floor surface. In this example the agitator comprises a rotatable brush bar assembly 30 which is mounted within a brush bar chamber 32 of the housing 18. The brush bar assembly 30 is driven by a motor 33 (shown in FIG. 5*b*) located in a motor housing 34 of the housing 18. The brush bar assembly 30 is connected to the motor 33 by a drive mechanism located within a drive mechanism housing 36 so that the drive mechanism is isolated from the air passing through the suction passage. In this example, the drive mechanism comprises a drive belt for connecting the motor 33 to the brush bar assembly 30. To provide a balanced cleaner head in which the weight of the motor 33 is spread evenly about the bottom surface of the sole plate 20, the motor housing 34 is located centrally above, and rearward of, the brush bar chamber 32. Consequently, the drive mechanism housing 36 extends into the brush bar chamber 32 between the side walls of the brush bar chamber 32.

It will be appreciated that the brush bar assembly 30 can be driven in other ways, such as by a turbine which is driven by an incoming or exhaust air flow, or by a coupling to the motor which is also used to generate the air flow through the vacuum cleaner 10. The coupling between the motor 33 and brush bar assembly 30 can alternatively be via a geared coupling. The brush bar assembly 30 can be removed entirely so that the vacuum cleaner 10 relies entirely on suction or by some other form of agitation of the floor surface. For other types of surface treating machines, the cleaner head 12 can include appropriate means for treating the floor surface, such as a polishing pad, a liquid or a wax dispensing nozzle.

The main body 14 is connected to a support assembly 16 for allowing the vacuum cleaner 10 to be rolled along a floor surface. The support assembly 16 comprises a pair of wheels 40, 42. Each wheel 40, 42 is dome-shaped, and has an outer surface of substantially spherical curvature. Annular ridges 41 may be provided on the outer surface of each wheel 40, 42 to improve grip on the floor surface. These ridges 41 may be integral with the outer surface of each wheel 40, 42 or, as illustrated, may be separates members adhered or otherwise attached to the outer surface of each wheel 40, 42. Alternatively, or additionally, a non-slip texture or coating may be provided on the outer surface of the wheels 40, 42 to aid grip on slippery floor surfaces such as hard, shiny or wet floors.

Figure 5A:
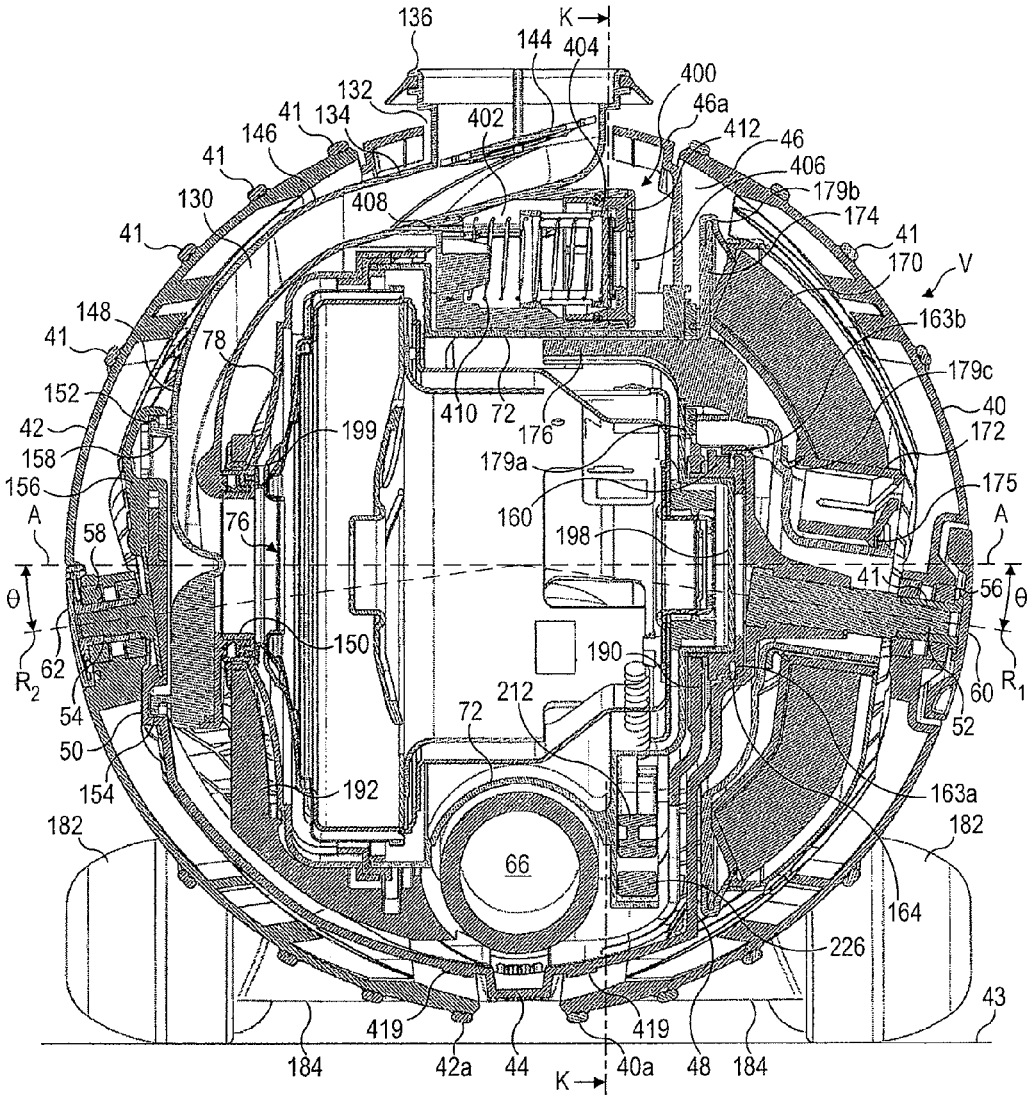
FIG. 5*a* is a front vertical cross-sectional view through the center of a spherical volume V defined by the wheels of the support assembly of the vacuum cleaner.
Figure 5B:
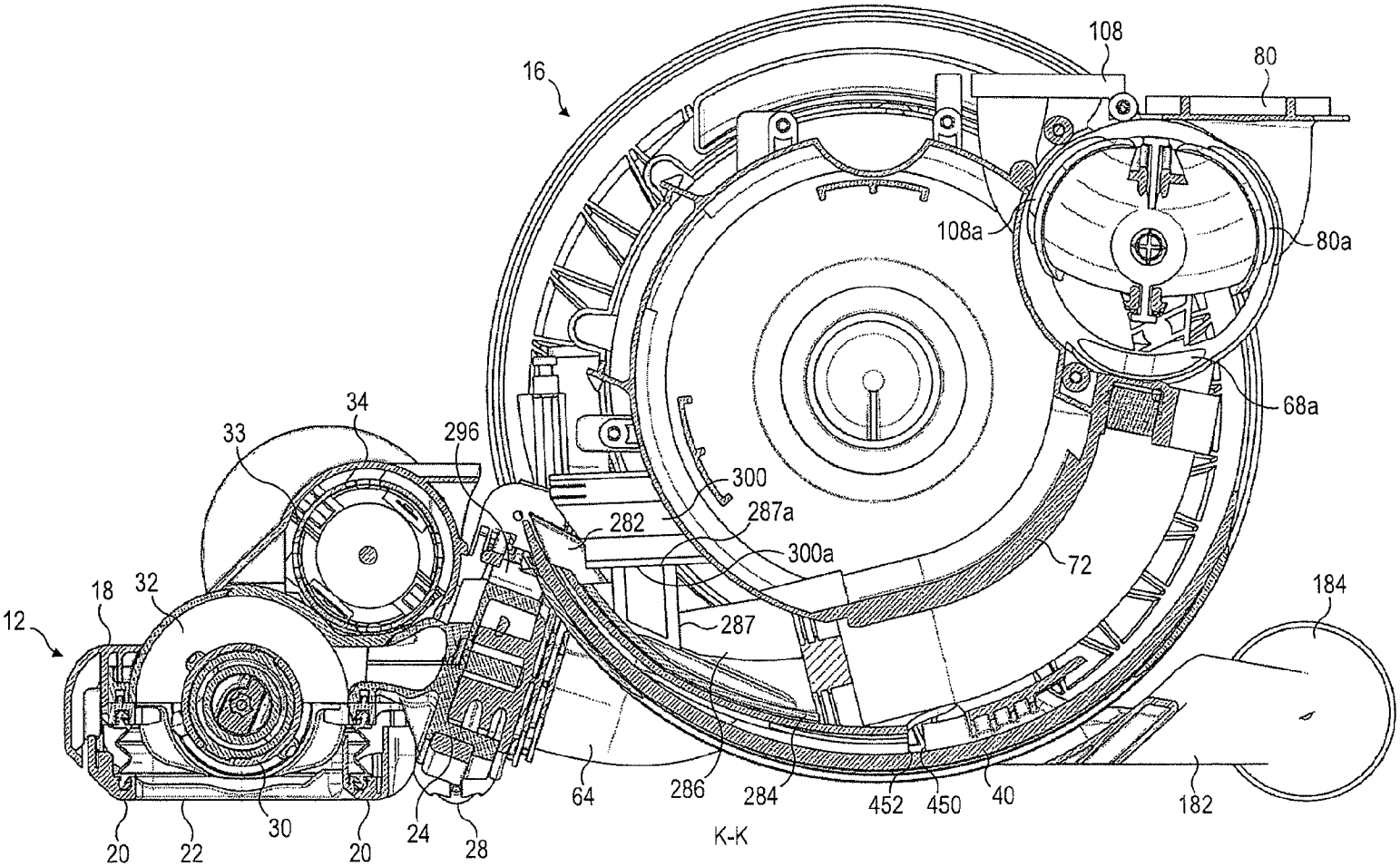
FIG. 5*b* is a section along line K-K in FIG. 5*a*, but with the motor inlet duct omitted.

As shown most clearly in FIGS. 5*a* and 5*b*, the outer surfaces of the wheels 40, 42 (that is, excluding the optional ridges 41) at least partially delimit a substantially spherical volume V. The rotational axes $R_1$, $R_2$ of the wheels 40, 42 are inclined downwardly relative to an axis A passing horizontally through the center of the spherical volume V. Consequently, the rims 40*a*, 42*a* of the wheels 40, 42 provide the lowest extremity of the wheels 40, 42 for making contact with a floor surface 43. A ridge 41 may be formed or otherwise provided at each rim 40*a*, 42*a*. In this example, the angle θ of the inclination of the rotational axes $R_1$, $R_2$ is around 8°, but the angle θ may take any desired value.

Figure 6A:
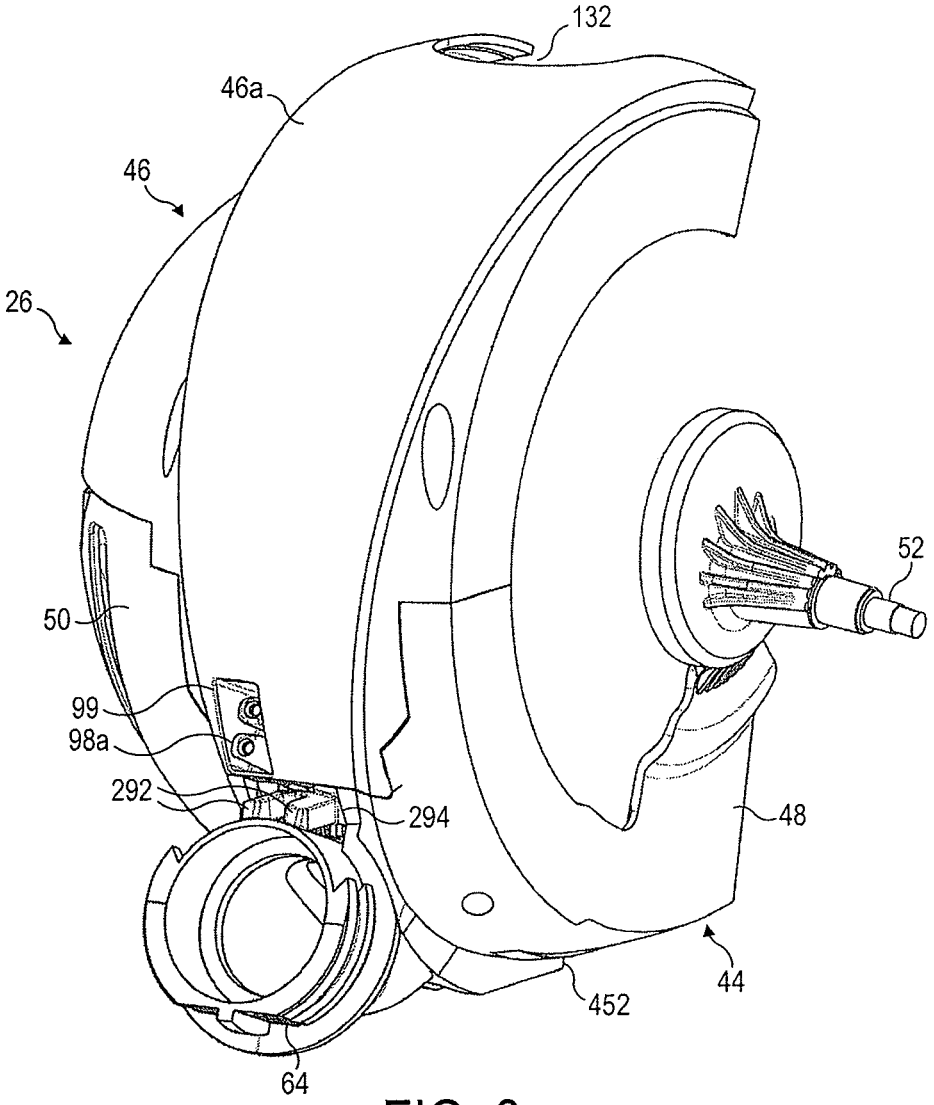
FIG. 6*a* is a front perspective view, from the left, of the yoke of the vacuum cleaner.
Figure 6B:
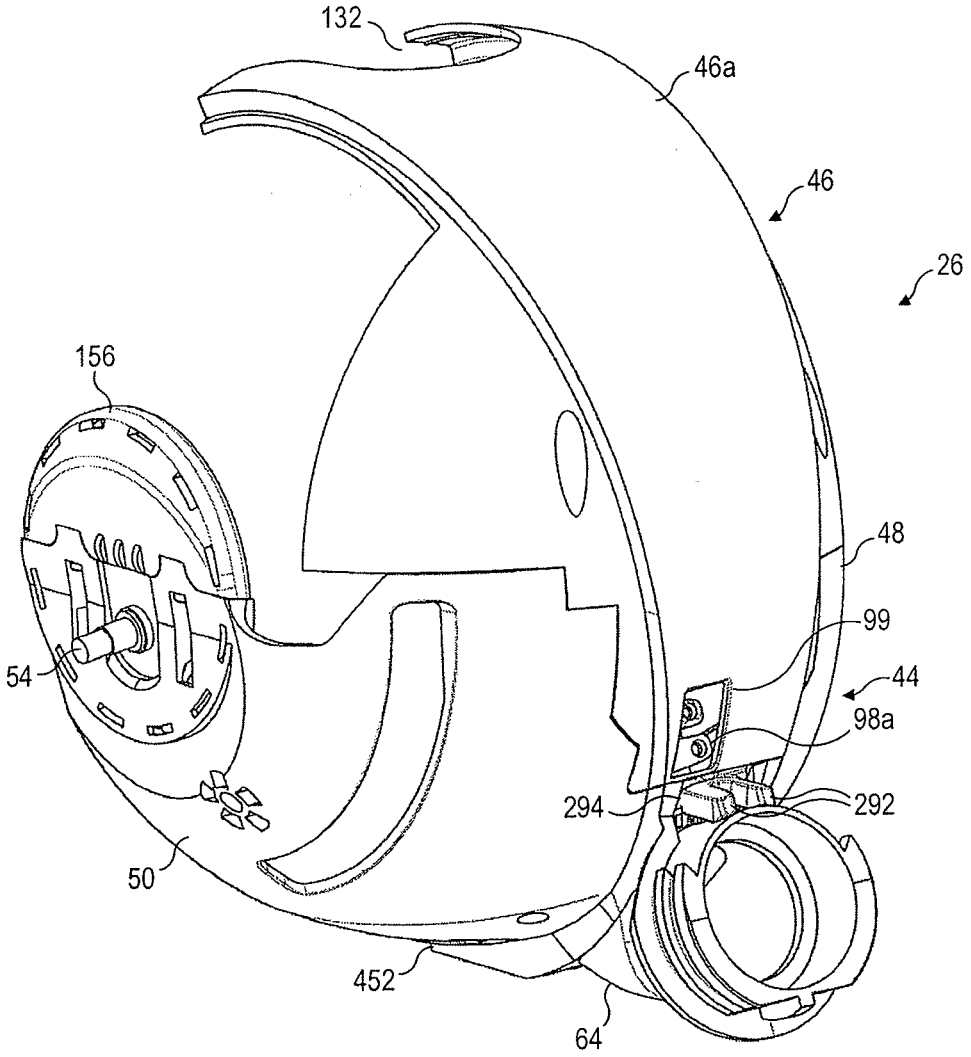
FIG. 6*b* is a front perspective view, from the right, of the yoke.

The wheels 40, 42 are rotatably connected to the yoke 26 that connects the cleaner head 12 to the main body 14 of the vacuum cleaner 10, and so the yoke 26 may be considered to form part of the support assembly 16. FIGS. 6*a* and 6*b* illustrate front perspective views of the yoke 26. In this example, to facilitate manufacture the yoke 26 comprises a lower yoke section 44 and an upper yoke section 46 connected to the lower yoke section 44. However, the yoke 26 may comprise any number of connected sections, or a single section. The lower yoke section 44 comprises two yoke arms 48, 50 A wheel axle 52, 54 extends outwardly and downwardly from each yoke arm 48, 50. The longitudinal axis of each wheel axle 52, 54 defines a respective one of the rotational axes $R_1$, $R_2$ of the wheels 40, 42. Each wheel 40, 42 is rotatably connected to a respective wheel axle 52, 54 by a respective wheel bearing arrangement 56, 58. End caps 60, 62 mounted on the wheels 40, 42 inhibit the ingress of dirt into the wheel bearing arrangements 56, 58, and serve to connect the wheels 40, 42 to the axles 52, 54.

Figure 10A:
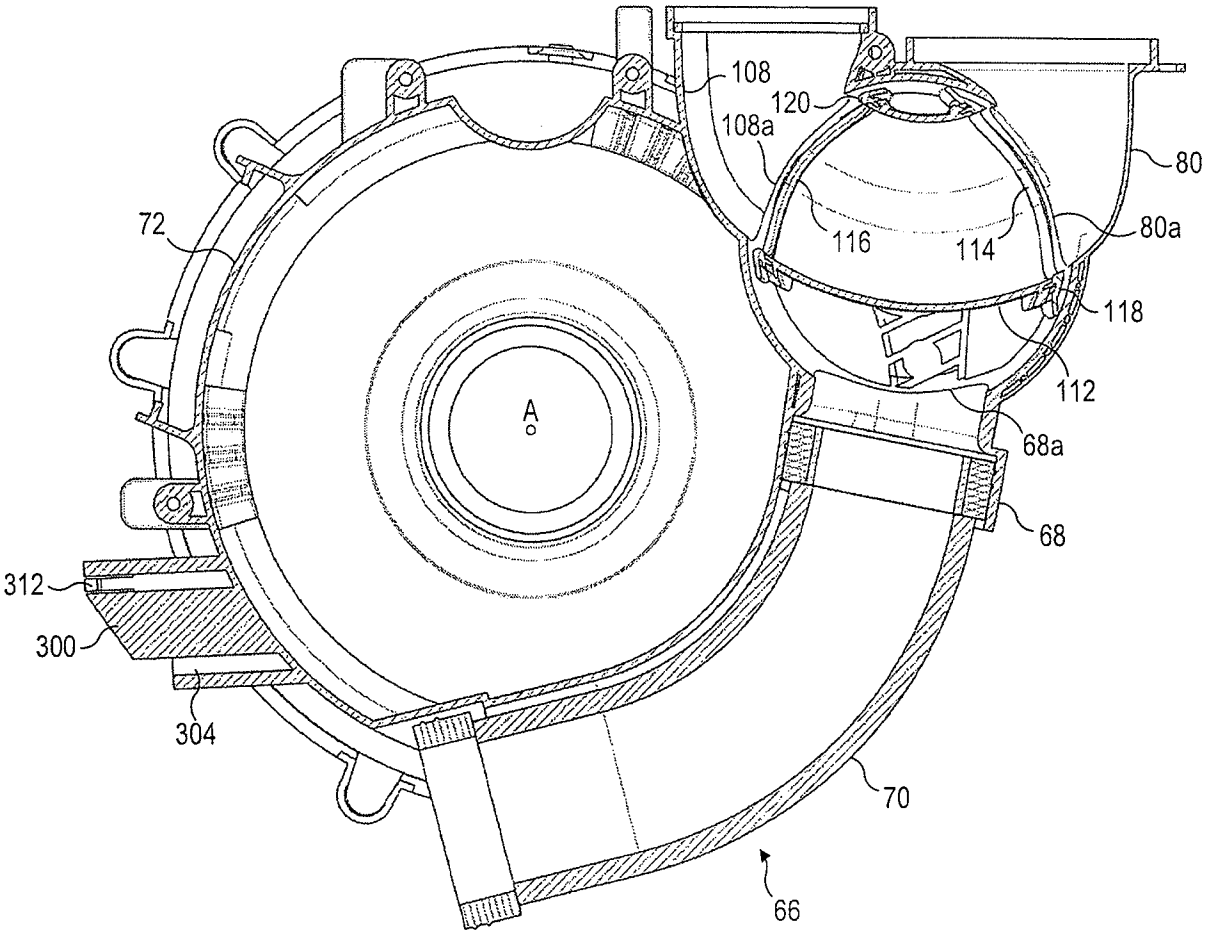
FIG. 10*a* is a vertical cross-sectional view of the change over arrangement when mounted on the motor casing, and with the change over arrangement in a first angular position relative to the motor casing.

The lower yoke section 44 also comprises an inlet section 64 of an internal duct, indicated at 66 in FIG. 10*a*, for receiving a dirt-bearing air flow from the cleaner head 12. The internal duct 66 passes through the spherical volume V delimited by the wheels 40, 42 of the support assembly 16. The fluid outlet 24 of the cleaner head 12 is connected to the internal duct inlet section 64 in such a manner that allows the fluid outlet 24 to rotate about the internal duct inlet section 64, and thus allows the cleaner head 12 to rotate relative to the main body 14 and the support assembly 16, as the vacuum cleaner 10 is maneuvered over a floor surface during floor cleaning. For example, with reference to FIG. 8 the fluid outlet 24 of the cleaner head 12 comprises at least one formation 65 for receiving the internal duct inlet section 64. The fluid outlet 24 of the cleaner head 12 may be retained on the internal duct inlet section 64 by a snap-fit connection. Alternatively, or additionally, a C-clip or other retaining mechanism may be used to releasably retain the fluid outlet 24 of the cleaner head 12 on the internal duct inlet section 64.

With reference again to FIG. 10*a*, the internal duct 66 further comprises an internal duct outlet section 68 connected to the main body 14 of the vacuum cleaner 10, and a flexible hose 70 which extends between the wheels 40, 42 of the support assembly 16 to convey a dirt-bearing air flow to the internal duct outlet section 68. The internal duct outlet section 68 is integral with a first motor casing section 72 of a motor casing 74 housing a motor-driven fan unit (indicated generally at 76 in FIG. 5*a*) for drawing the airflow through the vacuum cleaner 10. As also shown in, for example FIGS. 5*a* and 12, the motor casing 74 comprises a second motor casing section 78 which is connected to the first motor casing section 72, and which defines with the first motor casing section 72 an airflow path through the motor casing 74. The axis A passes through the motor casing 74 so that the central axis of the fan unit 76, about which an impeller of the fan unit rotates, is co-linear with the axis A.

Figure 7A:
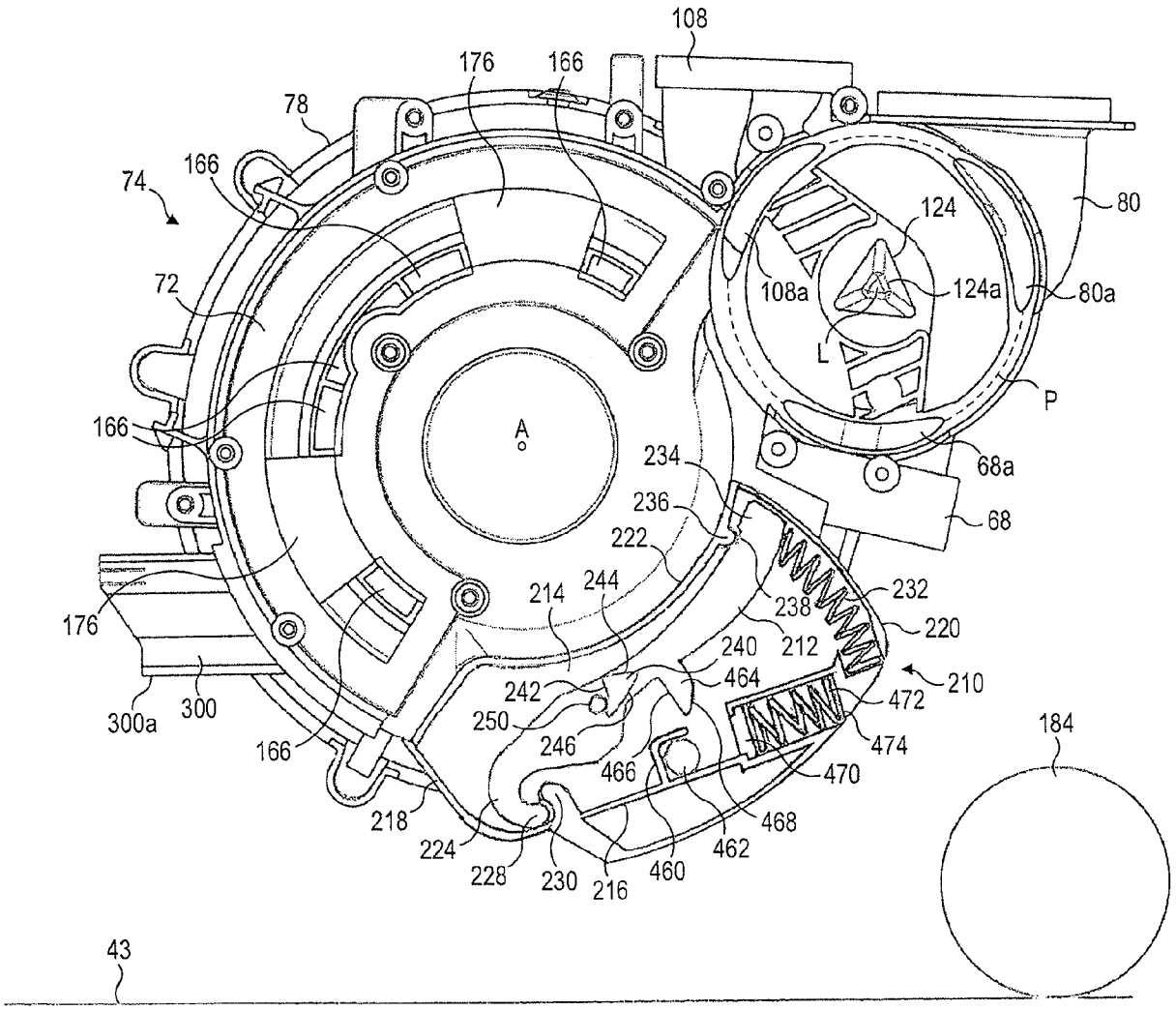
FIGS. 7*a*, 7*b* and 7*c* are a sequence of left side views of the motor casing and the stand retaining mechanism of the vacuum cleaner, illustrating the release of the stand from the retaining mechanism as the main body is reclined.

A number of parts of the main body 14 of the vacuum cleaner 10 are also integral with the first motor casing section 72, which is illustrated in FIG. 7*a*. One of these parts is an outlet section 80 of a hose and wand assembly 82 of the main body 14. The hose and wand assembly outlet section 80 has an air outlet 80*a* which is angularly spaced from the air outlet 68*a* of the internal duct outlet section 68. With reference again to FIGS. 1, 2*a* and 3, the hose and wand assembly 82 comprises a wand 84 which is releasably connected to the spine 86 of the main body 14, and a flexible hose 88 connected at one end thereof to the wand 84 and at the other end thereof to the hose and wand assembly outlet section 80. The spine 86 of the main body 14 preferably has a concave rear surface so that the wand 84 and the hose 88 may be partially surrounded by the spine 86 when the wand 84 is connected to the main body 14. Cleaning tools 90, 92 for selective connection to the distal end of the wand 84 may be detachably mounted on the spine 86 of the main body 14, or the distal end of the hose 88.

The motor casing 74 is connected to the base of the spine 86 of the main body 14. The spine 86 of the main body 14 comprises a user-operable handle 94 at the end thereof remote from the support assembly 16. An end cap 95 is pivotably connected to the upper surface of the handle 94 for covering the distal end of the wand 84 when the wand 84 is connected to the spine 86 to inhibit user contact with this end of the wand 84 when the wand 84 is connected to the spine 86. A power lead 96 for supplying electrical power to the vacuum cleaner 10 extends into the spine 86 though an aperture formed in the spine 86. Electrical connectors (not shown) extend downwardly within the spine 86 and into the spherical volume V delimited by the wheels 40, 42 to supply power to the fan unit 76. A first user-operable switch 97*a* is provided on the spine 86 and is arranged so that, when it is depressed, the fan unit 76 is energized. The fan unit 76 may also be de-energized by depressing this first switch 97*a*. A second user-operable switch 97*b* is provided adjacent the first switch 97*a*. The second switch 97*b* enables a user to control the activation of the brush bar assembly 30 when the main body 14 of the vacuum cleaner 10 is reclined away from its upright position, as described in more detail below. An electrical connector 98*a* for supplying electrical power to the motor 33 of the brush bar assembly 30 is exposed by an aperture 99 formed in the upper yoke section 46. The electrical connector 98*a* is arranged to connect with an electrical connector 98*b* extending rearwardly from the cleaner head 12. As described in more detail below, power is not supplied to the motor 33 of the brush bar assembly 30 when the main body 14 of the vacuum cleaner 10 is in its upright position.

Figure 2A:
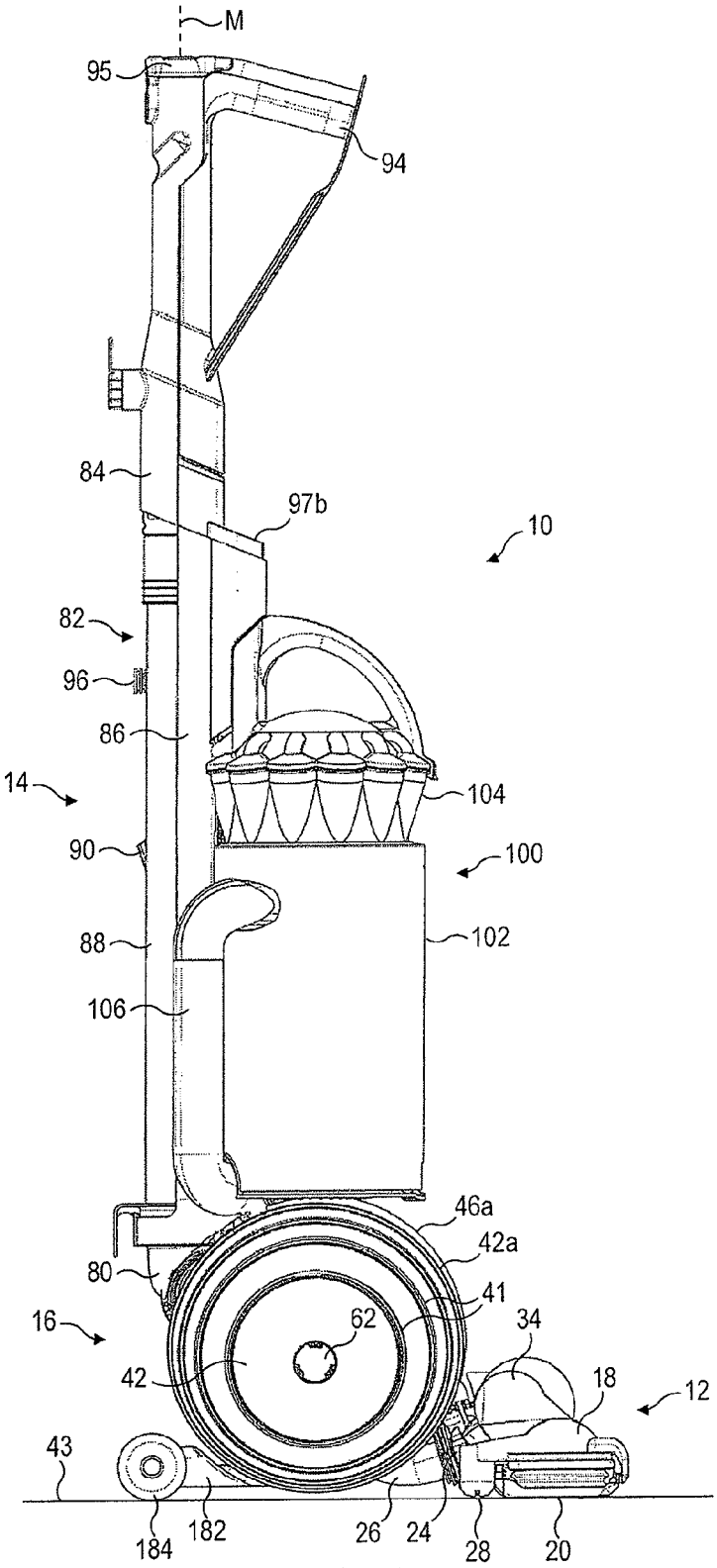
FIG. 2*a* is a right side view of the vacuum cleaner, with the main body of the vacuum cleaner in an upright position.
Figure 3:
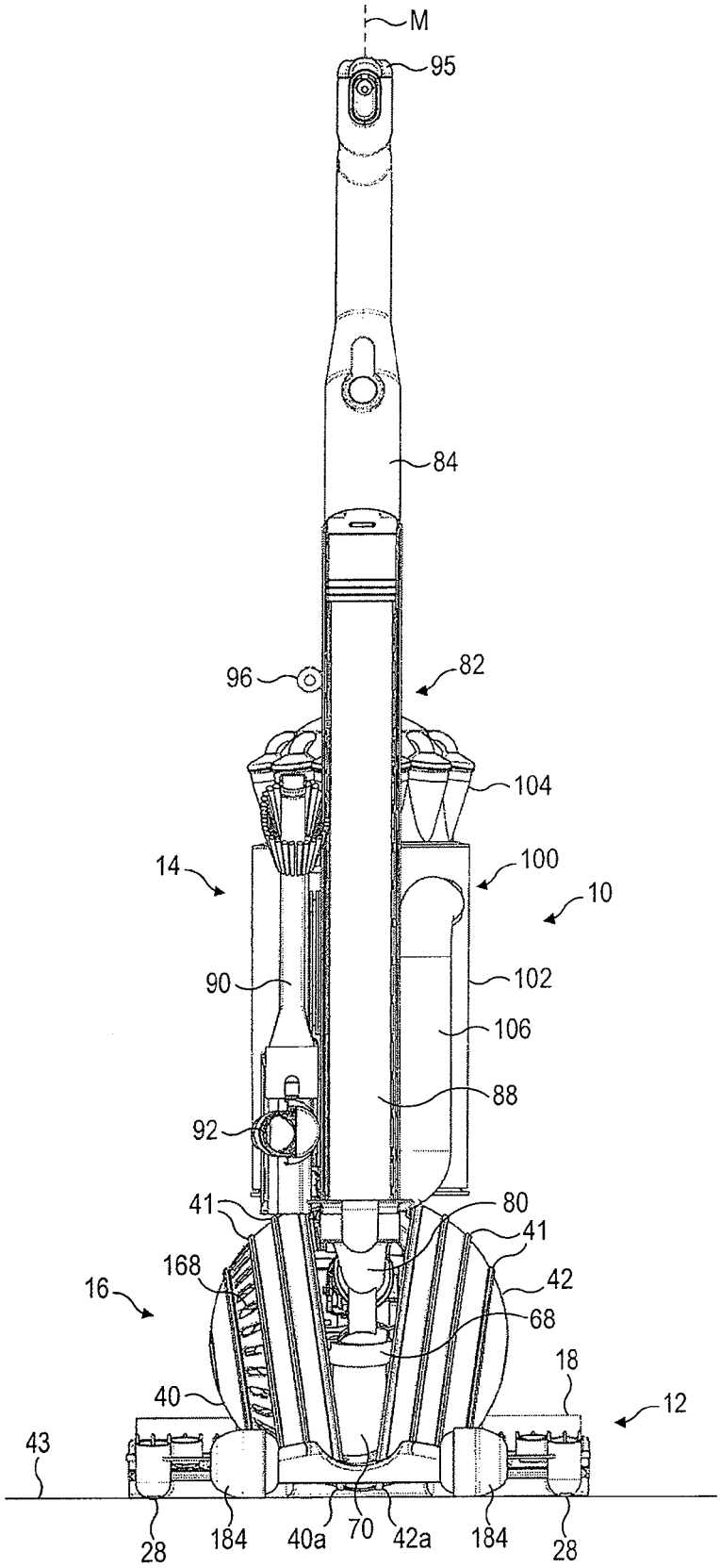
FIG. 3 is a rear view of the vacuum cleaner.

The main body 14 further comprises separating apparatus 100 for removing dirt, dust and/or other debris from a dirt-bearing airflow which is drawn into the vacuum cleaner 10. The separating apparatus 100 can take many forms. In this example the separating apparatus 100 comprises cyclonic separating apparatus, in which the dirt and dust is spun from the airflow. As is known, the separating apparatus 100 can comprise two or more stages of cyclone separation arranged in series with one another. In this example, a first stage 102 comprises a cylindrical-walled chamber and a second stage 104 comprises a tapering, substantially frusto-conically shaped, chamber or, as illustrated, a set of these tapering chambers arranged in parallel with one another. As illustrated in FIGS. 2*a* and 3, a dirt-bearing airflow is directed tangentially into the upper part of the first stage 102 of the separating apparatus 100 by a separating apparatus inlet duct 106. The separating apparatus inlet duct 106 extends alongside, and is connected to, the spine 86 of the main body 14.

Figure 9A:
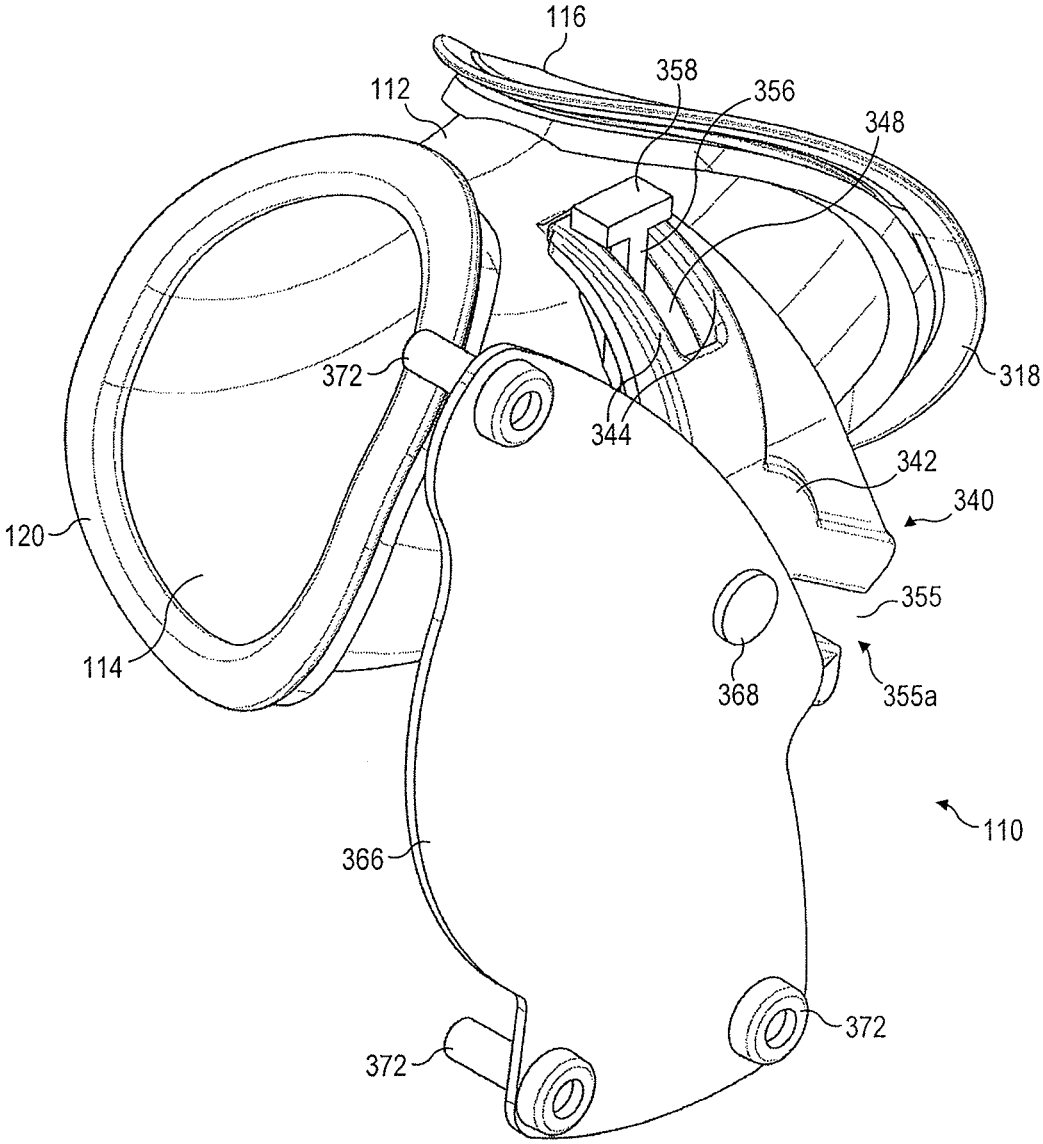
FIG. 9*a* is a perspective view of a change over arrangement of the vacuum cleaner.
Figure 9B:
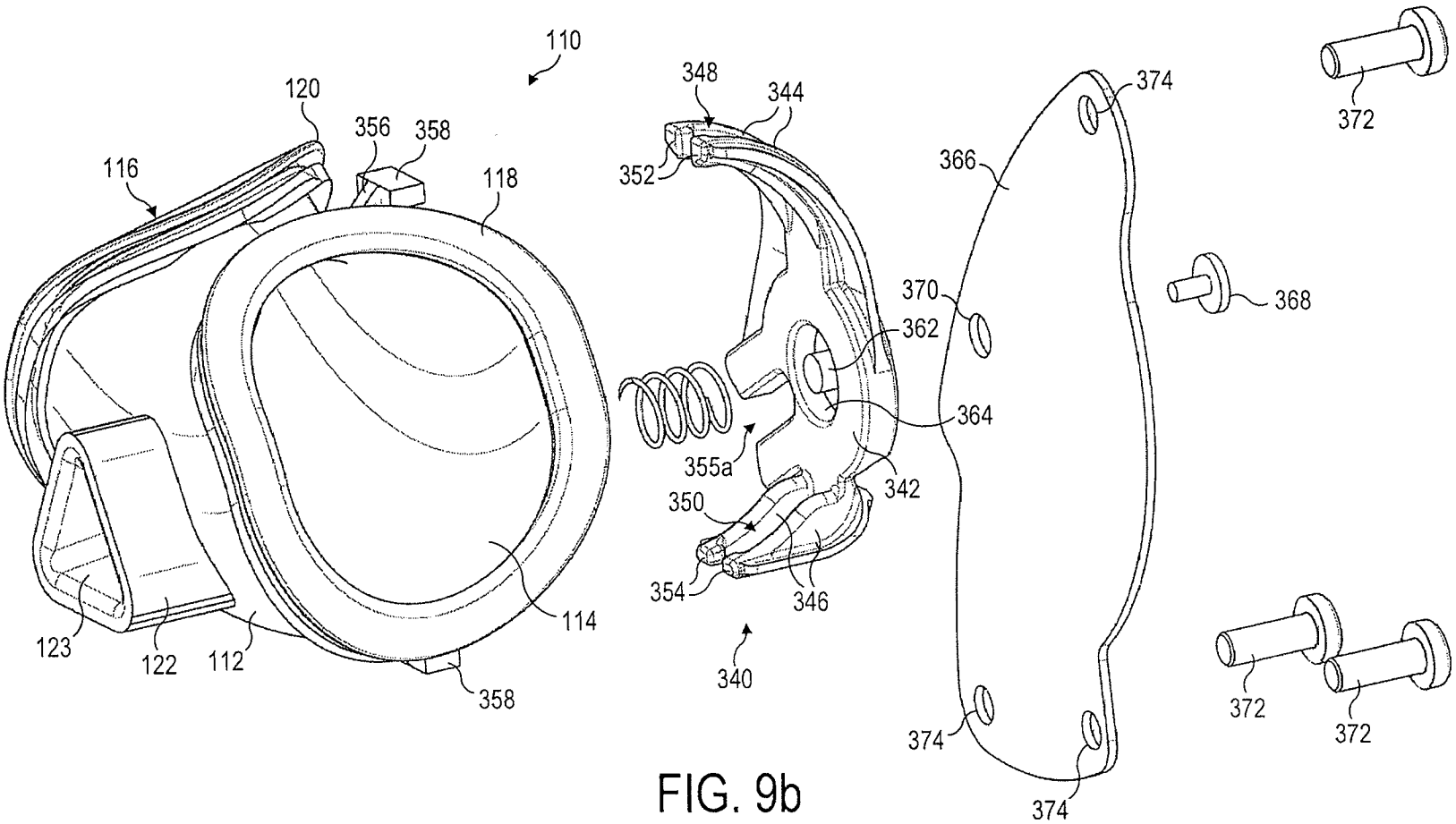
FIG. 9*b* is an exploded view of the change over arrangement.

Returning again to FIG. 7*a*, the separating apparatus inlet duct 106 is connected to an inlet duct inlet section 108 which also forms an integral part of the first motor casing section 72. The inlet duct inlet section 108 has an air inlet 108*a* which is angularly spaced from both the air outlet 68*a* and the air outlet 80*a* along a circular path P defined by the first motor casing section 72. A changeover valve 110 connects the air inlet 108*a* to a selected one of the air outlet 68*a* and the air outlet 80*a*. The change over arrangement 110 is illustrated in FIGS. 9*a* and 9*b*. The changeover valve 110 comprises an elbow-shaped valve member 112 having a first port 114 and a second port 116 located at opposite ends of the valve member 112, with the valve member 112 defining an airflow path between the ports 114, 116. Each port 114, 116 is surrounded by a respective flexible seal 118, 120.

The valve member 112 comprises a hub 122 which extends outwardly from midway between the ports 114, 116. The hub 122 has an inner periphery 123. The hub 122 is mounted on a boss 124. The boss 124 is also integral with the first motor casing section 72 and, as illustrated in FIG. 7*a*, is located at the center of the circular path P. The first motor casing section 72 thus provides a valve body of the changeover valve 110, within which valve body the valve member 112 is rotatable.

The boss 124 has a longitudinal axis L passing through the center of the circular path P, and which is substantially parallel to the axis A passing through the motor casing 74. The outer surface of the boss 124 is profiled so that the boss 124 is generally in the shape of a tapered triangular prism, which tapers towards the tip 124*a* of the boss 124 and which has rounded edges. The size and shape of inner surface 123 of the hub 122 is substantially the same as those of the outer surface of the boss 124 so that the inner surface 123 of the hub 122 lies against the outer surface of the boss 124 when the valve member 112 is mounted on the boss 124.

The valve member 112 is rotatable about the longitudinal axis L of the boss 124 between a first angular position and a second angular position relative to the motor casing 74. In the first angular position, shown in FIG. 10*a*, the airflow path defined by the valve member 112 connects the hose and wand assembly 82 to the separating apparatus inlet duct 106 so that air is drawn into the vacuum cleaner 10 through the distal end of the wand 84. This is the position adopted by the valve member 112 when the main body 14 of the vacuum cleaner 10 is in its upright position. The conforming profiles of the inner surface 123 of the hub 122 and the outer surface of the boss 124 means that the valve member 112 can be accurately aligned, both angularly and axially, relative to the motor casing 74 so that, in this first position of the valve member 112, the first port 114 is seated over the air outlet 80*a* so that the seal 118 is in sealing contact with the hose and wand assembly outlet section 80, and the second port 116 is seated over the air inlet 108*a* so that the seal 120 is in sealing contact with the inlet duct inlet section 108. In this first position of the valve member 112, the body of the valve member 112 serves to isolate the cleaner head 12 and the internal duct 66 from the fan unit 76 so that substantially no air is drawn into the vacuum cleaner 10 through the suction opening 22 of the cleaner head 12.

Figure 10B:
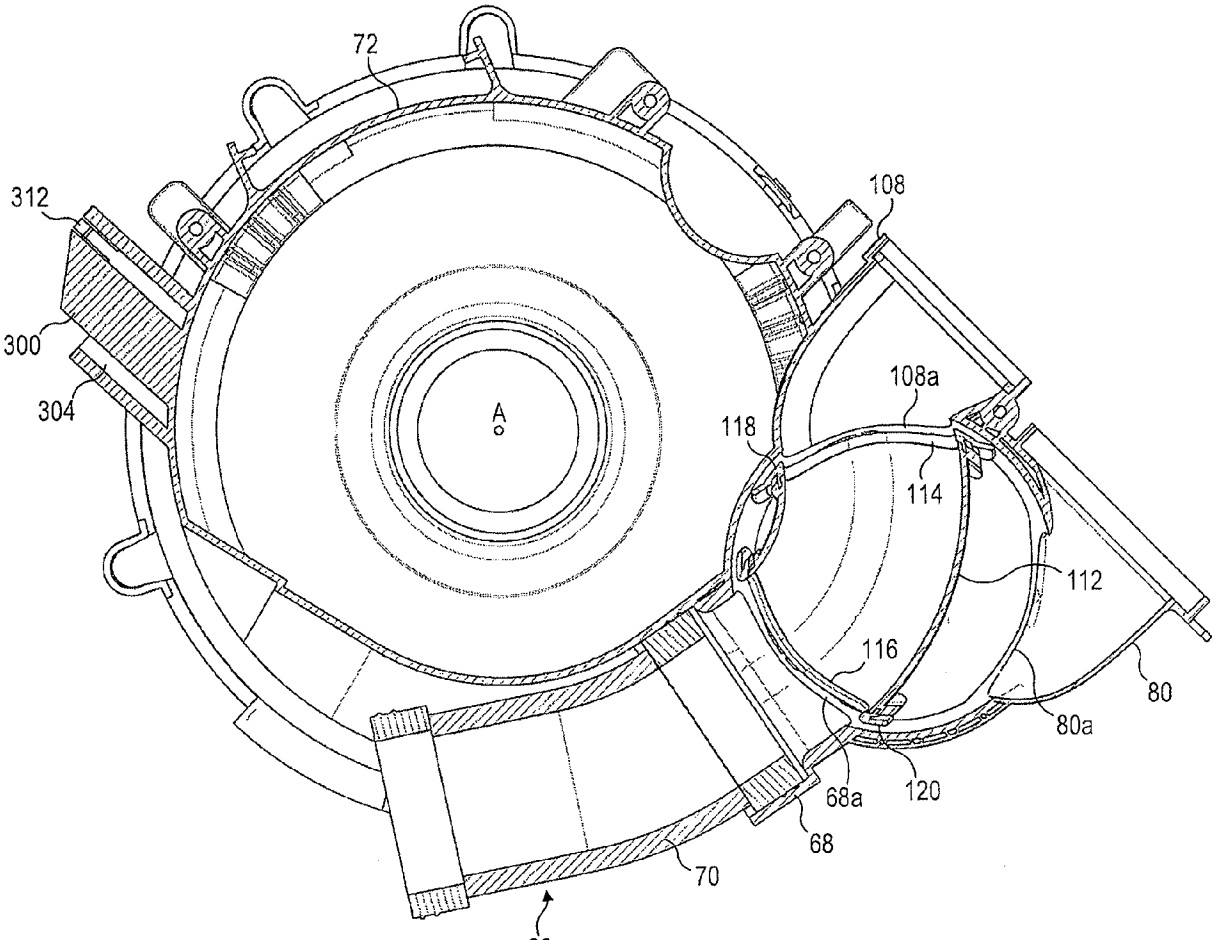
FIG. 10*b* is a similar cross-sectional view as FIG. 10*a* but with the change over arrangement in a second angular position relative to the motor casing.

In the second angular position, as shown in FIG. 10*b*, the airflow path connects the internal duct 66 to the separating apparatus inlet duct 106 so that air is drawn into the vacuum cleaner 10 through the cleaner head 12. This is the position adopted by the valve member 112 when the main body 14 is in a reclined position for floor cleaning. In this second position of the valve member 112, the body of the valve member 112 serves to isolate the hose and wand assembly 82 from the fan unit 76 so that substantially no air is drawn into the vacuum cleaner 10 through the distal end of the wand 84. The mechanism for moving the valve member 112 between the first and second positions, and its actuation, is described in more detail below.

Returning to FIG. 5*a*, the main body 14 comprises a motor inlet duct 130 for receiving an airflow exhausted from the separating apparatus 100 and for conveying this airflow to the motor casing 74. As previously discussed, the fan unit 76 is located between the wheels 40, 42 of the support assembly 16, and so the motor inlet duct 130 extends between the wheels 40, 42 of the support assembly 16 to convey the airflow from the separating apparatus 100 to the fan unit 76.

Figure 11A:
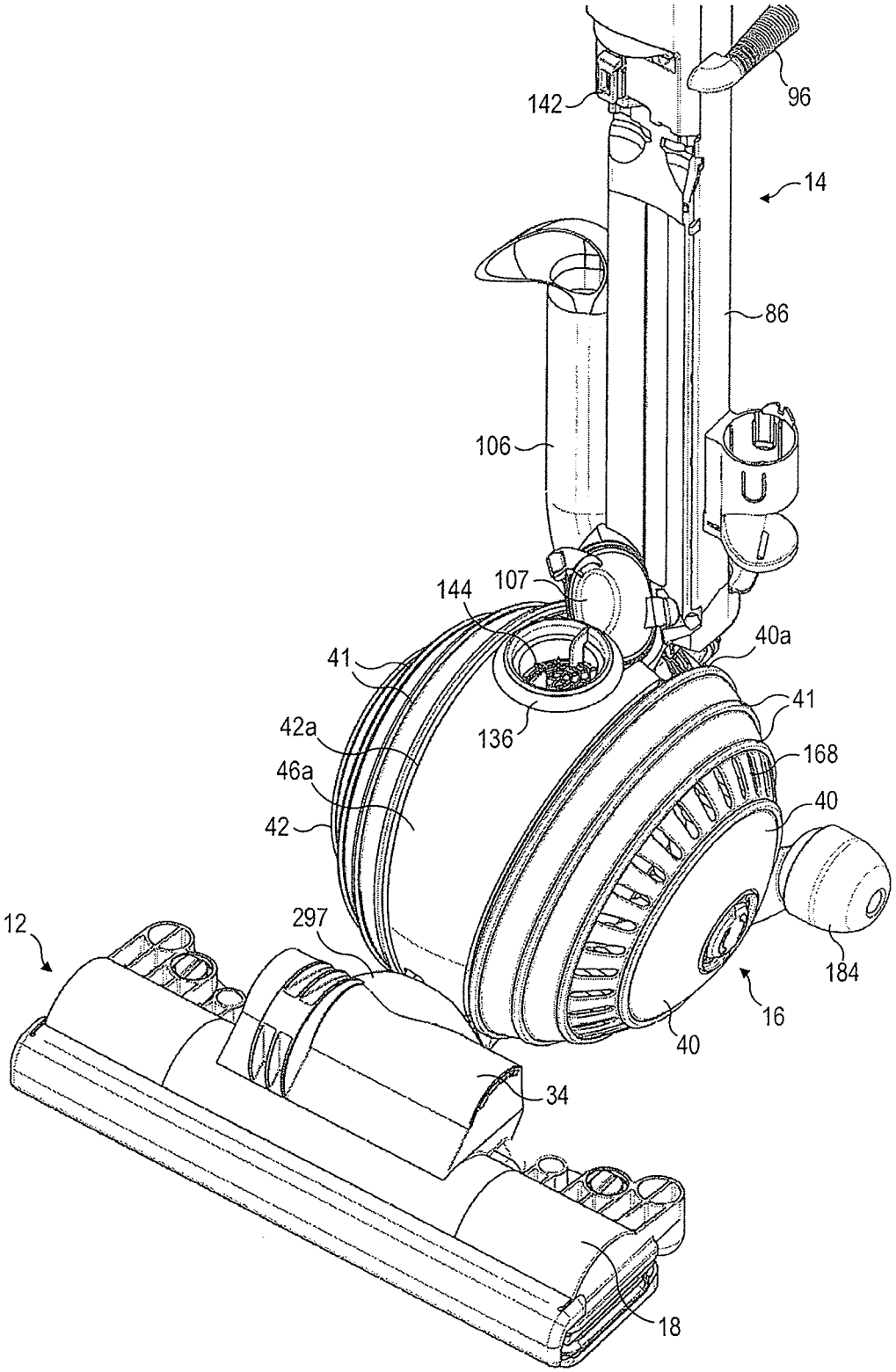
FIG. 11*a* is a front perspective view, from the left, of part of the vacuum cleaner, with the main body in its upright position and the separating apparatus removed.

In this example the airflow is exhausted from the separating apparatus 100 through an air outlet formed in the bottom surface of the separating apparatus 100. The airflow is conveyed from the second stage 104 of cyclonic separation to the air outlet of the separating apparatus 100 by a duct passing through, and co-axial with, the first stage 102 of cyclonic separation. In view of this, the motor inlet duct 130 can be substantially fully accommodated within the spherical volume V delimited by the wheels 40, 42 of the support assembly 16. With reference now to FIG. 11*a*, the upper yoke section 46 has an external surface 46*a* which is located between the wheels 40, 42, and which has a curvature which is substantially the same as that of the outer surfaces of the wheels 40, 42. The upper yoke section 46 thus serves to further delimit the spherical volume V, and, in combination with the wheels 40, 42 provides a substantially uninterrupted spherical appearance to the front of the support assembly 16. As shown also in FIGS. 6*a* and 6*b*, the upper yoke section 46 comprises an aperture 132 in the form of a slot through which a motor inlet duct inlet section 134 protrudes so that the air inlet of the motor inlet duct 130 is located beyond the external surface 46*a* of the upper yoke section 46. The motor inlet duct inlet section 134 comprises a spigot 136 upon which the base of the separating apparatus 100 is mounted so that the air inlet of the motor inlet duct 130 is substantially co-axial with the air outlet of the separating apparatus 100.

A manually-operable catch 140 is located on the separating apparatus 100 for releasably retaining the separating apparatus 100 on the spine 86 of the main body 14. The catch 140 may form part of an actuator for releasing the separating apparatus 100 from the spine 86 of the main body 14. The catch 140 is arranged to engage with a catch face 142 located on the spine 86 of the main body 14. In this example, the base of the separating apparatus 100 is movable between a closed position and an open position in which dust and dirt can be removed from the separating apparatus 100, and the catch 140 may be arranged to release the base from its closed position when the separating apparatus 100 is removed from the main body 14. Details of a suitable catch are described in WO2008/135708, the contents of which are incorporated herein by reference. A mesh or grille 144 may be located within the motor inlet duct inlet section 134. The mesh 144 traps debris which has entered the motor inlet duct 130 while the separating apparatus 100 is removed from the main body 14, and so prevents that debris from being conveyed to the motor casing 74 when the fan unit 76 is activated, thereby protecting the fan unit 76 from large foreign object ingress.

The separating apparatus inlet duct 106 comprises a hinged flap 107 which is manually accessible when the separating apparatus 100 is removed from the main body 14 to allow the user to remove any items which may have entered the separating apparatus inlet duct 106 while the separating apparatus 100 is removed from the main body 14, and to allow the user to remove blockages from the changeover valve 110.

The nature of the separating apparatus 100 is not material to the present invention and the separation of dust from the airflow could equally be carried out using other means such as a conventional bag-type filter, a porous box filter or some other form of separating apparatus. For embodiments of the apparatus which are not vacuum cleaners, the main body can house equipment which is appropriate to the task performed by the machine. For example, for a floor polishing machine the main body can house a tank for storing liquid wax.

Figure 12:
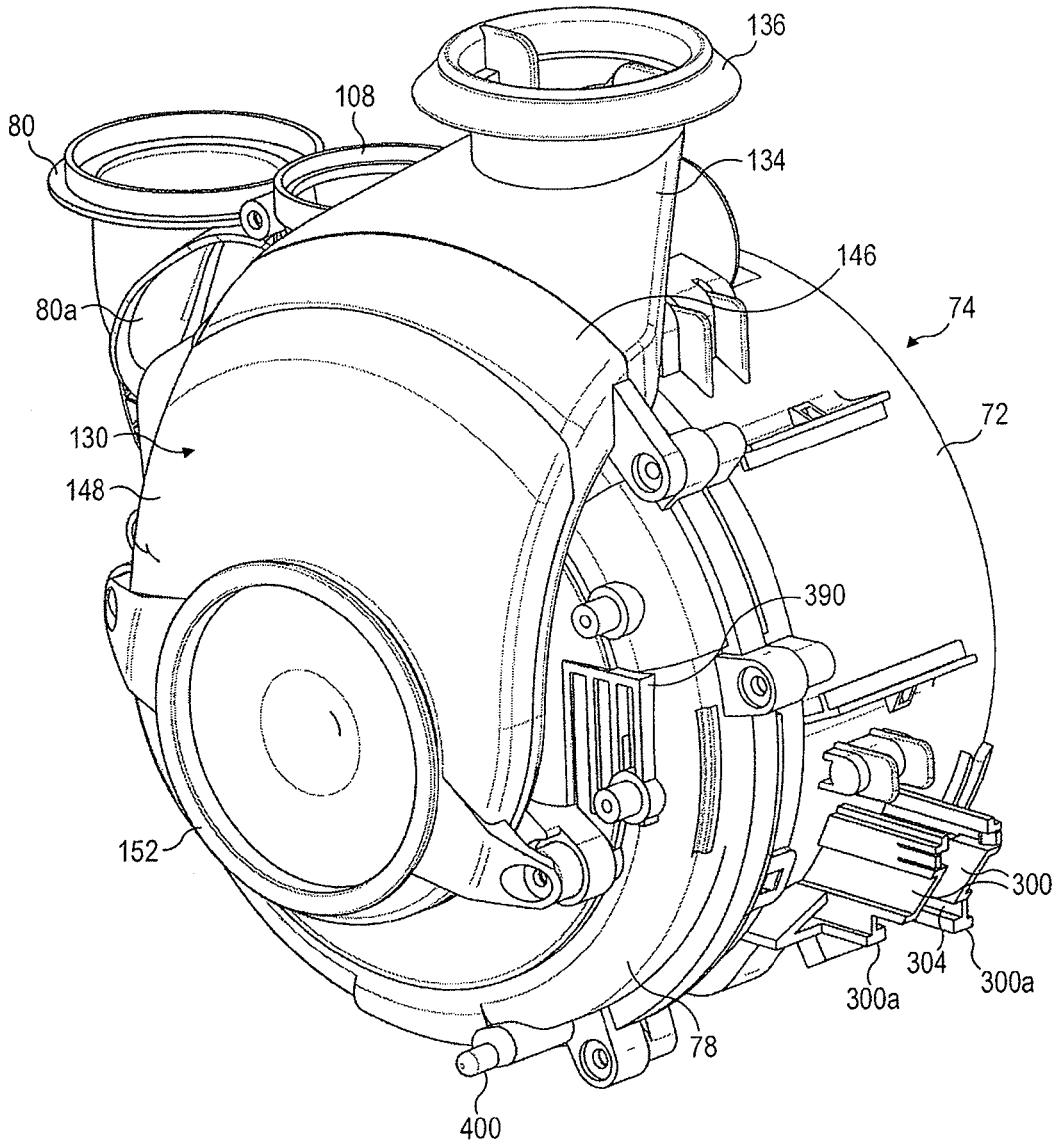
FIG. 12 is a front perspective view, from the right, of the motor casing and the motor inlet duct of the vacuum cleaner.

With reference now to FIGS. 5*a* and 12, to facilitate manufacturing the motor inlet duct 130 comprises a base section 146 connected to the second motor casing section 78, and a cover section 148 connected to the base section 146. Again, the motor inlet duct 130 may be formed from any number of sections. The base section 146 and the cover section 148 together define an airflow path extending from the motor inlet duct inlet section 134 to an air inlet 150 of the second motor casing section 78. The yoke arm 50 is pivotably connected to the cover section 148 of the motor inlet duct 130. The outer surface of the cover section 148 comprises a circular flange 152. The circular flange 152 is orthogonal to the axis A passing through the center of the spherical volume V, and arranged so the axis A also passes through the center of the circular flange 152. The inner surface of the yoke arm 50 comprises a semi-circular groove 154 for receiving the lower half of the circular flange 152. A yoke arm connector 156 is located over the upper end of the yoke arm 50 to secure the yoke arm 50 to the cover section 148 while permitting the yoke arm 50 to pivot relative to the cover section 148, and thus relative to the motor casing 74, about axis A. The yoke arm connector 156 comprises a semi-circular groove 158 for receiving the upper half of the circular flange 152.

Figure 14A:
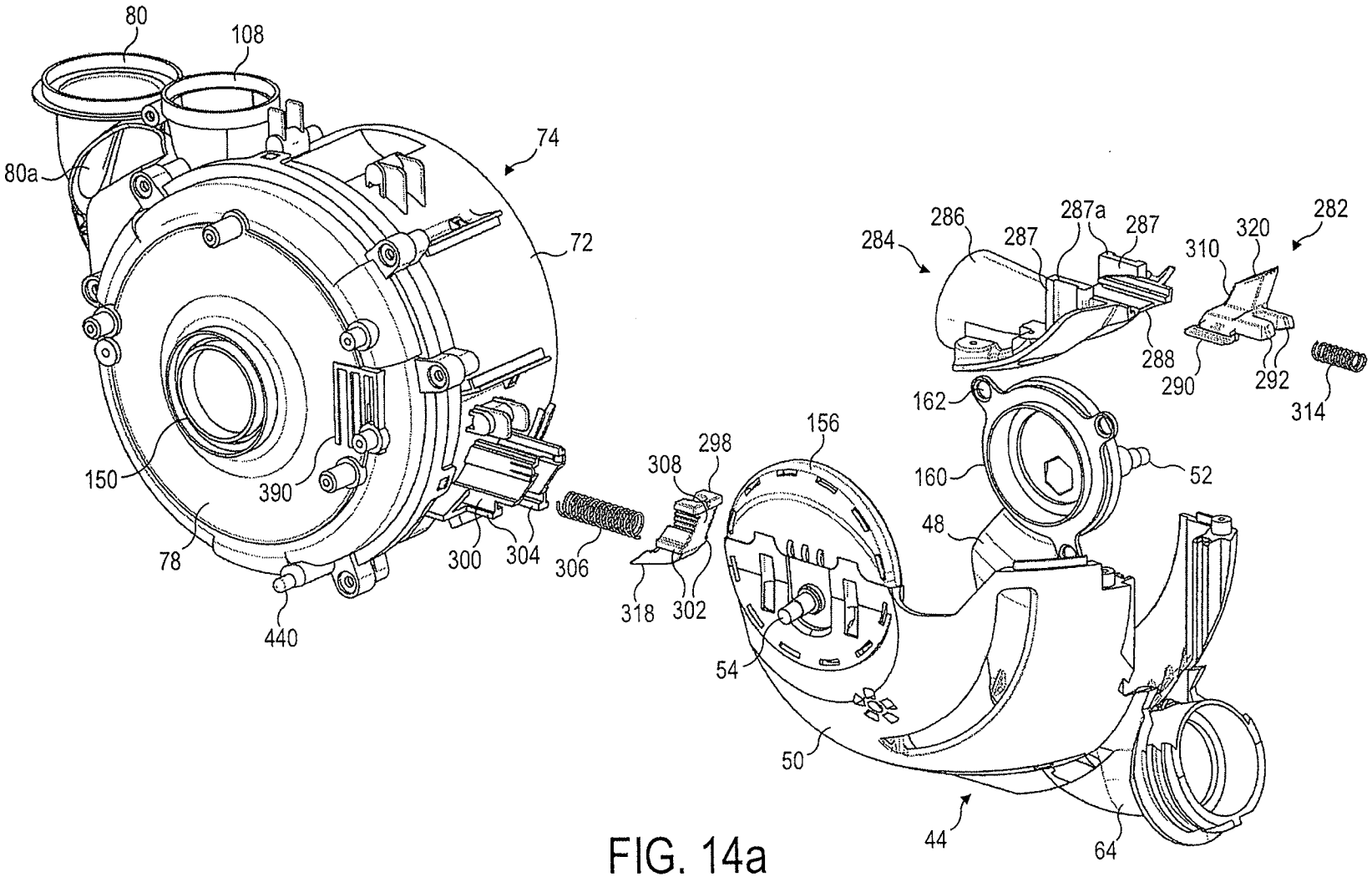
FIG. 14*a* is an exploded view of the lower housing section of the yoke, the motor casing and the components of a retaining mechanism for locking the angular position of the cleaner head relative to the yoke.

The yoke arm 48 is rotatably connected to the first motor casing section 72 by an annular arm bearing 160. The arm bearing 160 is illustrated in FIGS. 5*a* and 14*a*. The arm bearing 160 is connected to the outer surface of the first motor casing section 72, for example by means of bolts inserted through a number of apertures 162 located on the outer periphery of the arm bearing 160.

The arm bearing 160 is connected to the first motor casing section 72 so that it is orthogonal to the axis A, and so that the axis A passes through the center of the arm bearing 160. The outer periphery of the arm bearing 160 comprises a first annular groove 163*a*. The upper end of the yoke arm 48 is located over the arm bearing 160. The inner surface of the yoke arm 48 comprises a second annular groove 163*b* which surrounds the first annular groove 163*a* when the yoke arm 48 is located over the arm bearing 160. A C-clip 164 is housed between the grooves 163*a*, 163*b* to retain the yoke arm 48 on the bearing 160 while permitting the yoke arm 48 to pivot relative to the arm bearing 160, and thus the motor casing 74, about axis A.

Returning to FIG. 7*a*, the first motor casing section 72 comprises a plurality of motor casing air outlets 166 through which the airflow is exhausted from the motor casing 74. This airflow is subsequently exhausted from the vacuum cleaner 10 through a plurality of wheel air outlets 168 formed in the wheel 40 located adjacent the first motor casing section 72, and which are located so as to present minimum environmental turbulence outside of the vacuum cleaner 10.

As is known, one or more filters are positioned in the airflow path downstream of the first and second stages 102, 104 of cyclonic separation. These filters remove any fine particles of dust which have not already been removed from the airflow by the stages 102, 104 of cyclonic separation. In this example a first filter, referred to as a pre-motor filter, is located upstream of the fan unit 76 and a second filter, referred to as a post-motor filter, is located downstream from the fan unit 76. Where the motor for driving the fan unit 76 has carbon brushes, the post-motor filter also serves to trap any carbon particles emitted from the brushes.

The pre-motor filter may be located within the separating apparatus 100, between the second stage 104 of cyclonic separation and the air outlet from the separating apparatus 100. In this case, the pre-motor filter may be accessed by the user when the separating apparatus 100 has been removed from the main body 14, for example by disconnecting the first stage 102 from the second stage 104, or when the base of the separating apparatus 100 has been released to its open position. Alternatively, the pre-motor filter may be located within a dedicated housing formed in the motor inlet duct 130. In this case, the pre-motor filter may be accessed by removing the wheel 42 located adjacent the cover section 148 of the motor inlet duct 130, and opening a hatch formed in the cover section 148.

The post-motor filter, indicated at 170 in FIG. 5*a*, is located between the first motor casing section 72 and the wheel 40 so that the airflow passes through the filter 170 as it flows from the motor casing air outlets 166 to the wheel air outlets 168. The post-motor filter 170 is in the form of a dome-shaped pleated filter. Details of a suitable pleated filter are described in our application no. PCT/GB2009/001234, the contents of which are incorporated herein by reference. The filter 170 surrounds the axle 52 upon which the wheel 40 is rotatably mounted. The filter 170 is located within a frame 172 which is releasably connected to a filter frame mount 174 by a manually releasable catch 175. The filter frame mount 174 may be conveniently connected to the first motor casing section 72 by means of the bolts used to connect the arm bearing 160 to the first motor casing section 72. The filter frame mount 174 comprises a pair of apertured sections 176 which are inserted within apertures 178 formed in the first motor casing section 72 to ensure that the filter frame mount 174 is correctly aligned with the first motor casing section 72. These sections 176 also assist in suppressing noise generated by the motor of the fan unit 76. An annular seal 179*a* is located between the outer surface of the first motor casing section 72 and the filter frame mount 174 to inhibit the leakage of air therebetween. Additional annular seals 179*b*, 179*c* are provided between the filter frame mount 174 and the frame 172.

The filter 170 may be periodically removed from the vacuum cleaner 10 to allow the filter 170 to be cleaned. The filter 170 is accessed by removing the wheel 40 of the support assembly 16. This wheel 40 may be removed, for example, by the user first twisting the end cap 60 to disengage a wheel mounting sleeve 41 located over the end of the axle 52. As illustrated in FIG. 5*a*, the wheel mounting sleeve 41 may be located between the axle 52 and the wheel bearing arrangement 56. The wheel 40 may then be pulled from the axle 52 by the user so that the wheel mounting sleeve 41, wheel bearing arrangement 56 and end cap 60 come away from the axle 52 with the wheel 40. The catch 175 may then be manually depressed to release the frame 172 from the filter frame mount 174 to allow the filter 170 to be removed from the vacuum cleaner 10.

Figure 13:
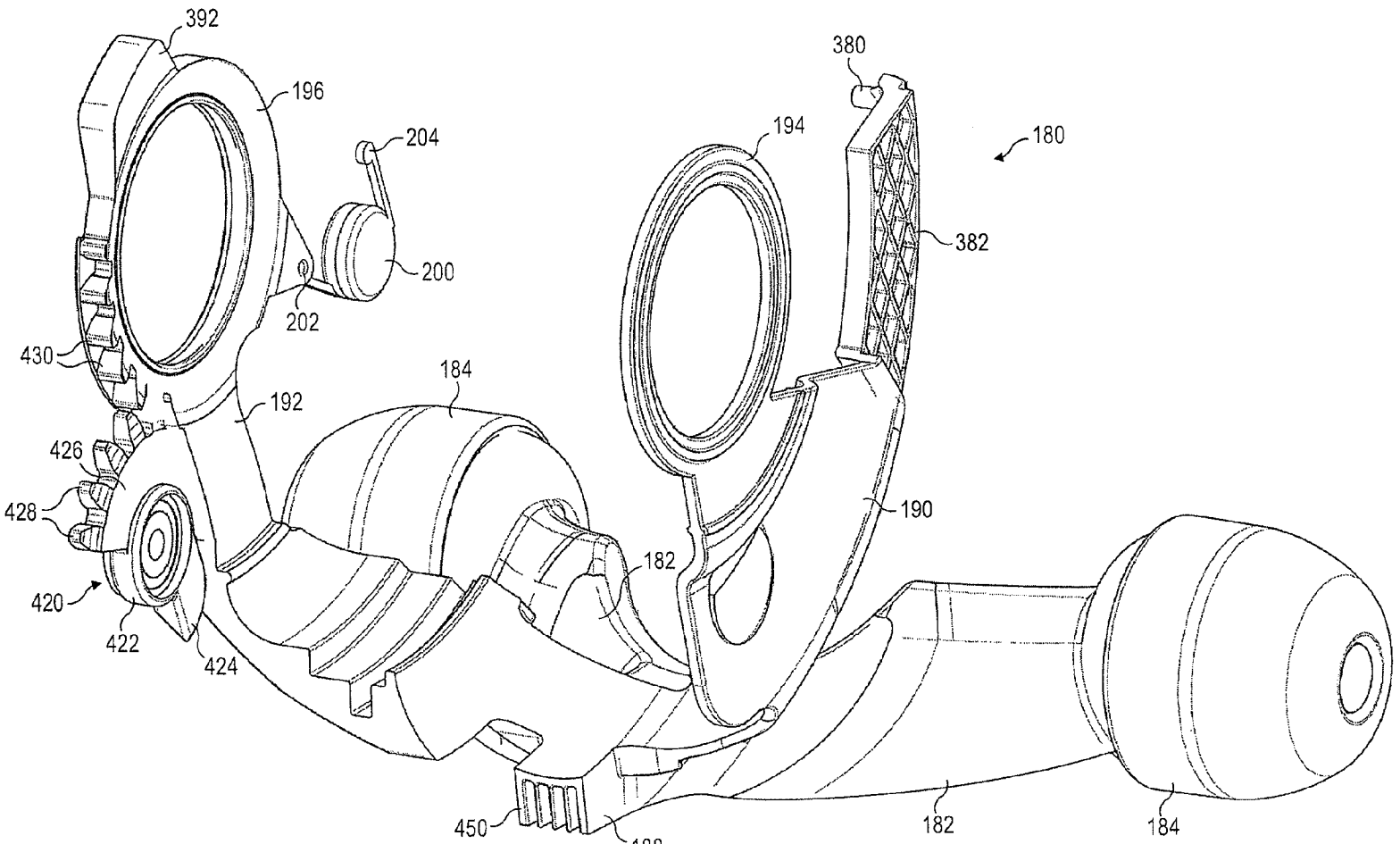
FIG. 13 is a perspective view of the stand of the vacuum cleaner.

The support assembly 16 further comprises a stand 180 for supporting the main body 14 when it is in its upright position. With reference to FIG. 13, the stand 180 comprises two supporting legs 182, each supporting leg 182 having a stabilizer wheel 184 rotatably attached to an axle extending outwardly from the lower end of the supporting leg 182.

Figure 4:
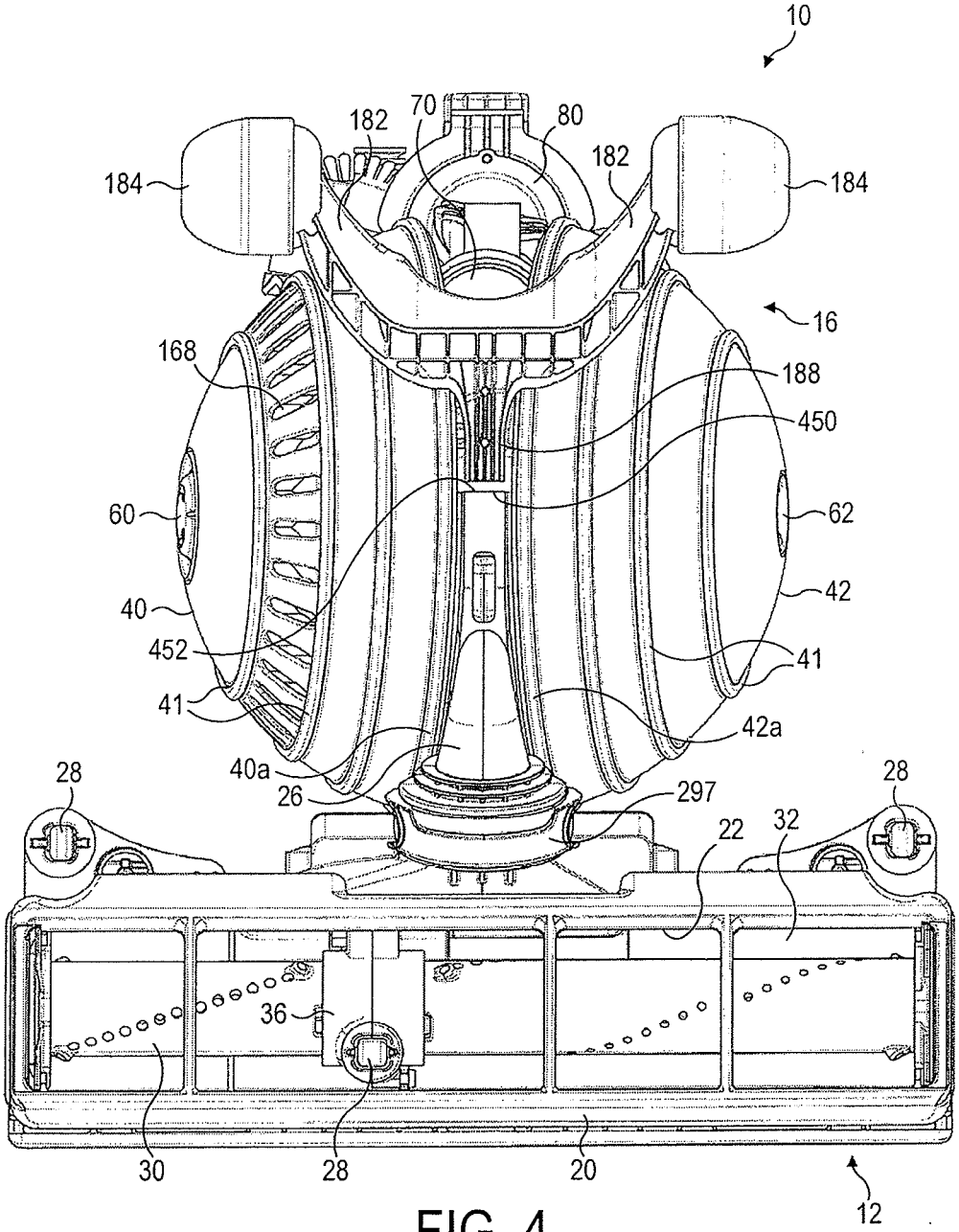
FIG. 4 is a bottom view of the vacuum cleaner.
Figure 15A:
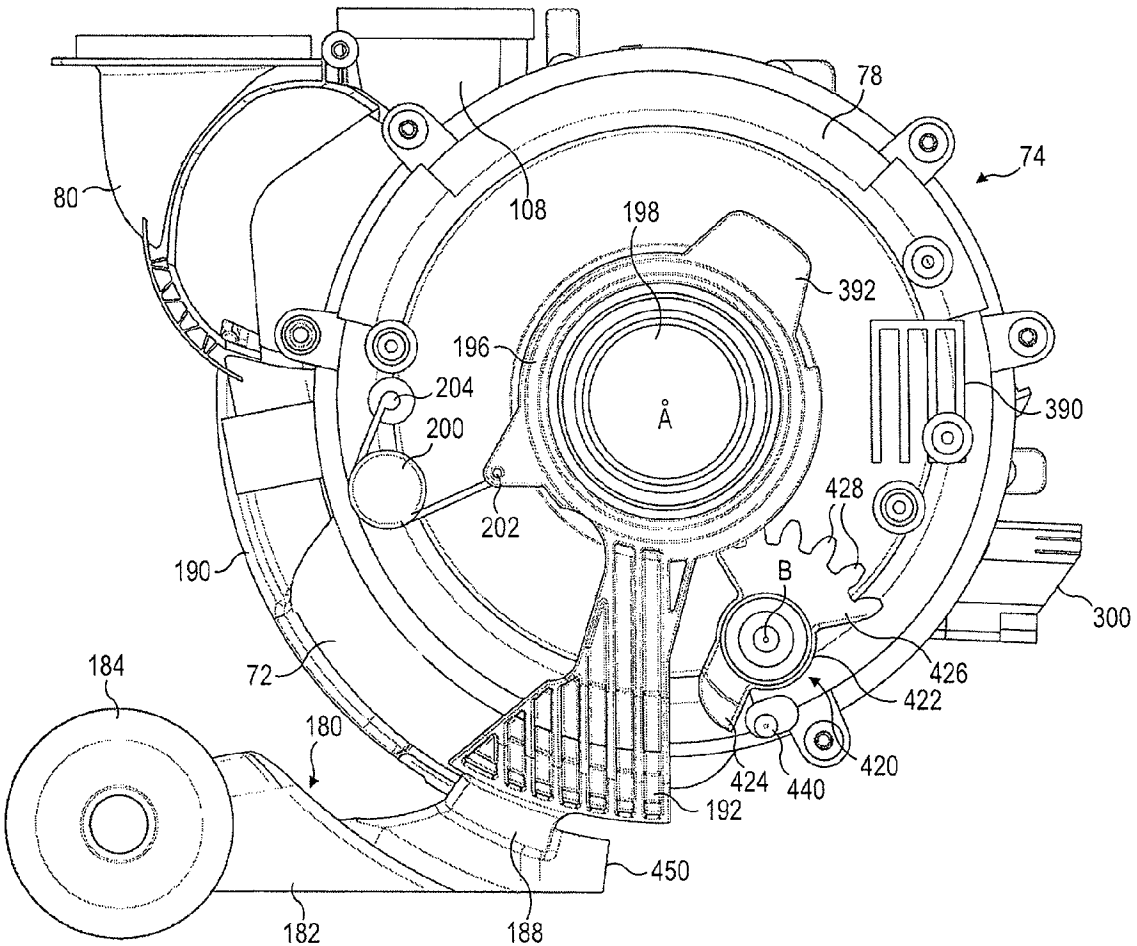
FIGS. 15*a* to 15*d* are a series of right side views of the vacuum cleaner, with various parts of the vacuum cleaner omitted, illustrating the movement of the stand between a supporting position to a retracted position as the main body is reclined.

The upper end of each supporting leg 182 is attached to the lower end of a relatively short body 188 of the stand 180. As illustrated in FIG. 4, the body 188 of the stand 180 protrudes outwardly from between the wheels 40, 42 of the support assembly 16, and so protrudes outwardly from the spherical volume V. The stand 180 further comprises two supporting arms 190, 192 extending outwardly and upwardly from the upper end of the body 188 of the stand 180. The supporting arms 190, 192 of the stand 180 are located within the spherical volume V, and so cannot be seen in FIGS. 1 to 4. The upper end of each supporting arm 190, 192 comprises a respective annular connector 194, 196 for rotatably connecting the stand 180 to the motor casing 74. The annular connector 194 is located over a cylindrical drum 198 formed on the outer surface of the first section 72 of the motor casing 74, and which is also illustrated in FIG. 15*a*. The annular connector 194 is retained on the motor casing 74 by the arm bearing 160. The annular connector 196 is located over the motor casing air inlet 150. An annular bearing 199 is positioned between the second motor casing 78 and the annular connector 196 to enable the annular connector 196 to rotate relative to the motor casing 74, and to retain the annular connector 196 on the motor casing 74.

Each of the annular connectors 194, 196 is rotatably connected to the motor casing 74 so that the annular connectors 194, 196 are orthogonal to the axis A, and so that the axis A passes through the centers of the annular connectors 194, 196. As a result, the stand 180 is pivotable relative to the motor casing 74 about the axis A.

The stand 180 is pivotable relative to the motor casing 74, and therefore relative to the main body 14 of the vacuum cleaner 10, between a lowered, supporting position for supporting the main body 14 when it is in its upright position, and a raised, retracted position so that the stand 180 does not interfere with the maneuvering of the vacuum cleaner 10 during floor cleaning. Returning to FIG. 13, an over-center spring mechanism is connected between the motor casing 74 and the stand 180 to assist in moving the stand 180 between its supporting and retracted positions. Depending on the relative angular positions of the motor casing 74 and the stand 180, the over-center spring mechanism either urges the stand 180 towards its supporting position, or urges the stand 180 towards its retracted position. The over-center spring mechanism comprises a helical torsion spring 200 having a first end 202 connected to the supporting arm 192 of the stand 180 and a second end 204 connected to the second motor casing section 78. The biasing force of the torsion spring 200 urges apart the ends 202, 204 of the torsion spring 200.

As discussed in more detail below, when the main body 14 is in its upright position the wheels 40, 42 of the stand assembly 16 are raised above the floor surface. Consequently, and as indicated in FIGS. 2*a* and 3, when the main body 14 of the vacuum cleaner 10 is in its upright position the load of the vacuum cleaner 10 is supported by a combination of the cleaner head 12 and the stabilizer wheels 184 of the stand 180. The raising of the wheels 40, 42 of the support assembly 16 above the floor surface can enable the cleaner head 12 and the stand 180 to provide maximum product stability when the main body 14 is in an upright position by ensuring that the cleaner head 12 and the stand 180 contact the floor surface rather than one of those components in combination with the wheels 40, 42 of the support assembly 16.

With reference now to FIG. 7*a*, the vacuum cleaner 10 comprises a stand retaining mechanism 210 for retaining the stand 180 in its supporting position when the main body 14 is in its upright position so that the wheels 40, 42 may be maintained above the floor surface. This stand retaining mechanism 210 comprises a stand locking member 212 located within an open-sided housing 214 formed on the outer surface of the first motor casing section 72. The housing 214 comprises a base 216, two side walls 218, 220 each upstanding from an opposite end of the base 216, and an upper wall 222 extending between the top surfaces of the side walls 218, 220. A first end 224 of the stand locking member 212 is in the form of a hook, the tip 228 of which is lodged against the base of a curved ridge 230 upstanding from the base 216 of the housing 214. A first helical compression spring 232 is located between a second end 234 of the stand locking member 212 and the base 216 of the housing 214. The compression spring 232 urges the second end 234 of the stand locking member 212 in an upward (as illustrated) direction so that the second end 234 of the stand locking member 212 engages the upper wall 222 of the housing 214. A ridge 236 may be located on, or integral with, the upper wall 222 of the housing 214 for engaging a groove 238 formed on the upper surface of the stand locking member 212 to inhibit sideways movement of the stand locking member 212 within the housing 214 when the stand locking member 212 is in the position illustrated in FIG. 7*a*.

The stand locking member 212 comprises a protrusion 240 extending outwardly from the side surface thereof, away from the motor casing 74. In this example the protrusion 240 is in the form of a generally triangular prism having side surfaces which define a first side face 242, a second side face 244 angled relative to the first side face 242, and a third side face 246 angled relative to both the first and second side faces 242, 244. The first side face 242 is concave, whereas the second and third side faces 244, 246 are generally planar.

The stand 180 comprises a stand pin 250 which extends inwardly from the supporting arm 190 for engaging the protrusion 240 of the stand retaining mechanism 210. The weight of the main body 14 acting on the stand 180 tends to urges the stand 180 towards its raised, retracted position, against the biasing force of the torsion spring 200. This causes the stand pin 250 to bear against the first side face 242 of the protrusion 240. The force applied to the protrusion 240 by the stand pin 250 tends to urge the stand locking member 212 to rotate clockwise (as illustrated) about the tip 228 of its hooked first end 224 towards the position illustrated in FIG. 7*b*. However, the biasing force of the compression spring 232 is chosen so that the stand locking member 212 is maintained in the position illustrated in FIG. 7*a*, against the force applied to the protrusion 240 by the stand pin 250, when the main body 14 is in its upright position so the stand 180 is retained in its supporting position by the stand retaining mechanism 210.

Figure 14B:
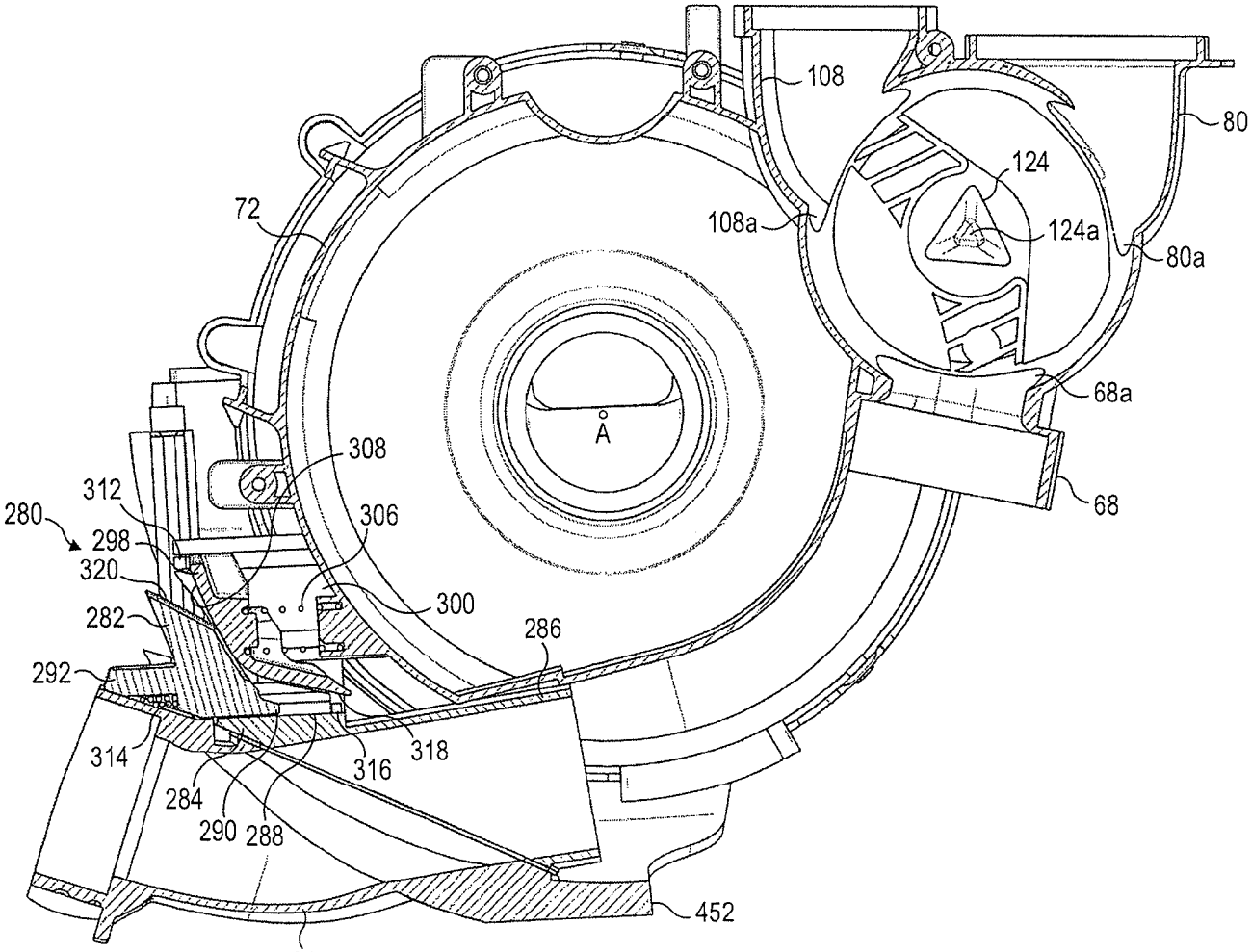
FIGS. 14*b* to 14*d* are left side cross-sectional views of the components of FIG. 14*a* when assembled and illustrating the movement of a locking member of the retaining mechanism from a deployed position to a stowed position.

With reference now to FIGS. 14*a* and 14*b*, the vacuum cleaner 10 further comprises a mechanism 280 for retaining the cleaner head 12 in a generally fixed angular position relative to the yoke 26 when the main body 14 is in its upright position. This allows the cleaner head 12 to support the main body 14, along with the stand 180, when the main body 14 is in its upright position. In the event that the cleaner head 12 was able to rotate relative to the yoke 26, and thus the main body 14, when the main body 14 is in its upright position there is a risk that the vacuum cleaner 10 may topple over, for example when the wand 84 is disconnected from the spine 86 of the main body 14.

Figure 8:
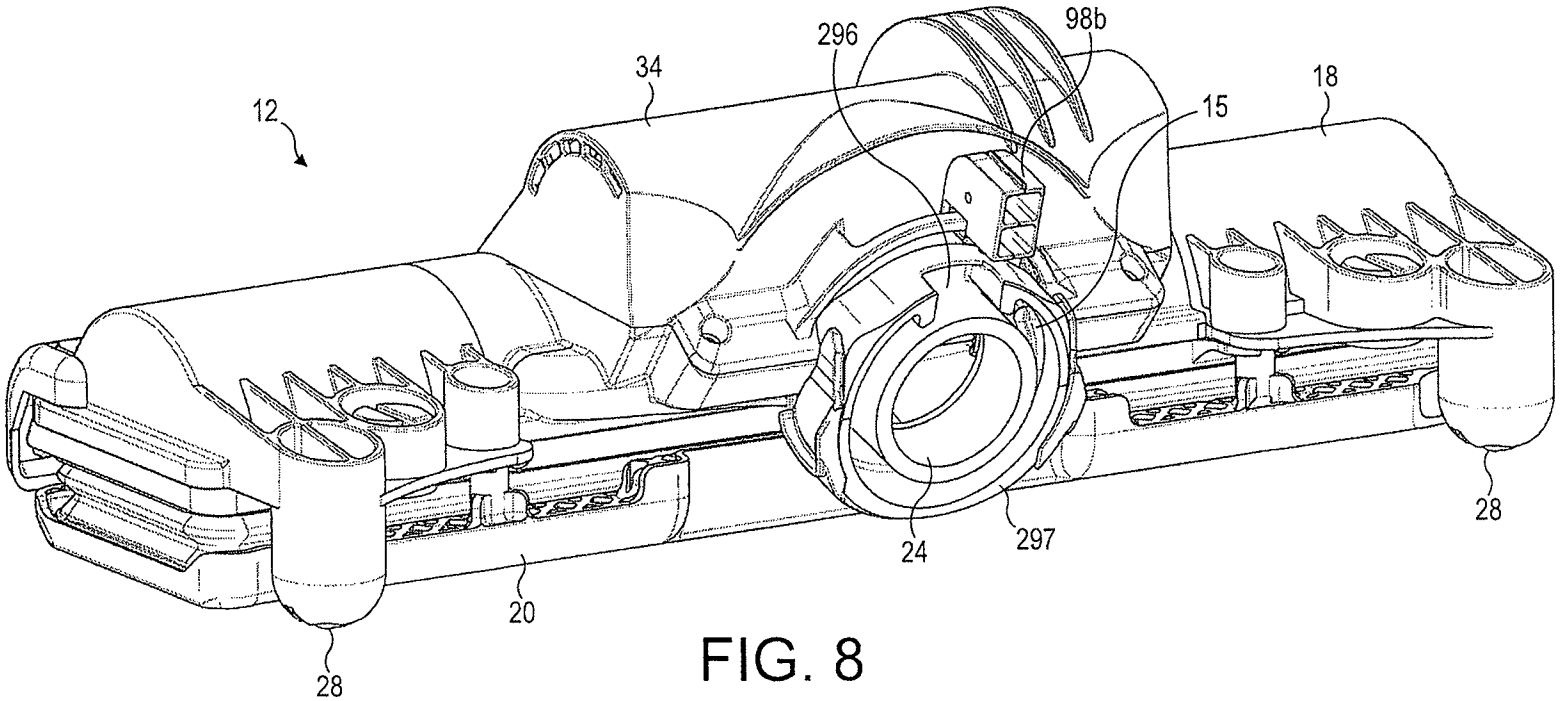
FIG. 8 is a rear perspective view, from the left, of the cleaner head of the vacuum cleaner.

This cleaner head retaining mechanism 280 retains the cleaner head 12 in its generally fixed angular position relative to the yoke 26 by inhibiting the rotation of the cleaner head 12 about the internal duct inlet section 64 of the yoke 26. The cleaner head retaining mechanism 280 comprises a cleaner head locking member 282 which is moveable relative to the cleaner head 12 between a deployed position, in which rotation of the cleaner head 12 relative to the yoke 26 is generally inhibited, and a stowed position. The movement of the locking member 282 between its deployed and stowed positions is described in more detail below. The locking member 282 is slotted into a locking member housing 284 which is connected to the inner surface of the lower yoke section 44. The locking member housing 284 comprises a conduit 286 which is disposed between the internal duct inlet section 64 and the hose 70 of the internal duct 66 so that a dirt-bearing airflow flows through the conduit 286 as it passes from the internal duct inlet section 64 to the hose 70. The locking member housing 284 further comprises a pair of grooves 288 for receiving ribs 290 formed on the sides of the locking member 282 to allow the locking member 282 to slide along the locking member housing 284. A pair of fingers 292 extends forwardly from the front surface of the locking member 282. When the locking member 282 is in its deployed position, the fingers 292 protrude through an aperture 294 located between the lower yoke section 44 and the upper yoke section 46, as illustrated in FIGS. 6*a* and 6*b*, and into a groove 296 located on the upper surface of a collar 297 extending about the fluid outlet 24 of the cleaner head 12, which is shown in FIG. 8. When the locking member 282 is in its stowed position, the locking member 282 is substantially fully retracted within the spherical volume V delimited by the wheels 40, 42 of the support assembly 16.

When the main body 14 is in its upright position, the locking member 282 is urged towards its deployed position by an actuator 298. The actuator 298 is located between a pair of arms 300 extending outwardly from the outer surface of the first motor casing section 72. Each side of the actuator 298 comprises a rib 302 which is slotted into, and moveable along, a track 304 formed on the inner side surface of a respective one of the arms 300. When the main body 14 is in its upright position, the actuator 298 is urged towards the locking member 282 by a helical compression spring 306 located between the actuator 298 and the outer surface of the first motor casing section 72. A curved front face 308 of the actuator 298 is urged against a conformingly curved rear face 310 of the locking member 282 to force the fingers 292 through the aperture 294 and into the groove 296 on the collar 297 of the cleaner head 12.

A catch 312 restricts the movement of the actuator 298 away from the motor casing 74 under the action of the spring 306. The catch 312 is preferably arranged so that the actuator 298 is spaced from the end of the catch 312 when the main body 14 is in its upright position so that the actuator 298 is free to move both towards and away from the motor casing 74. A second helical compression spring 314 is located between the lower yoke section 44 and the locking member 282 to urge the locking member 282 away from the groove 296 located on the upper surface of a collar 297, and so urge the rear face 310 of the locking member 282 against the front face 308 of the actuator 298 when the main body 14 is in its upright position. The biasing force of the spring 306 is greater than the biasing force of the spring 314 so that the spring 314 is urged into a compressed configuration under the action of the spring 306.

In use, when the main body 14 is in its upright position the valve member 112 of the changeover valve 110 is in its first position, as illustrated in FIG. 10*a*, so that when the user depresses the first switch 97*a* to activate the fan unit 76 a dirt-bearing airflow is drawn into the vacuum cleaner 10 through the distal end of the wand 84. The dirt-bearing airflow passes through the hose and wand assembly 82 and is conveyed by the valve member 112 of the changeover valve 110 into the separating apparatus inlet duct 106. The dirt-bearing airflow is conveyed by the separating apparatus inlet duct 106 into the separating apparatus 100. Larger debris and particles are removed and collected in the chamber of the first stage 102 of cyclonic separation. The airflow then passes through a shroud to a set of smaller frusto-conically shaped cyclonic chambers of the second stage 104 of cyclonic separation. Finer dust is separated from the airflow by these chambers of the second stage, and the separated dust is collected in a common collecting region of the separating apparatus 100. An airflow is exhausted from the air outlet formed in the base of the separating apparatus 100, and is conveyed to the motor casing 74 by the motor inlet duct 130. The airflow passes through the motor casing 74 and the fan unit 76, and is exhausted from the motor casing 74 through the motor casing air outlets 166. The airflow passes through the post-motor filter 170 before being exhausted from the vacuum cleaner 10 through the wheel air outlets 168.

Figure 2B:
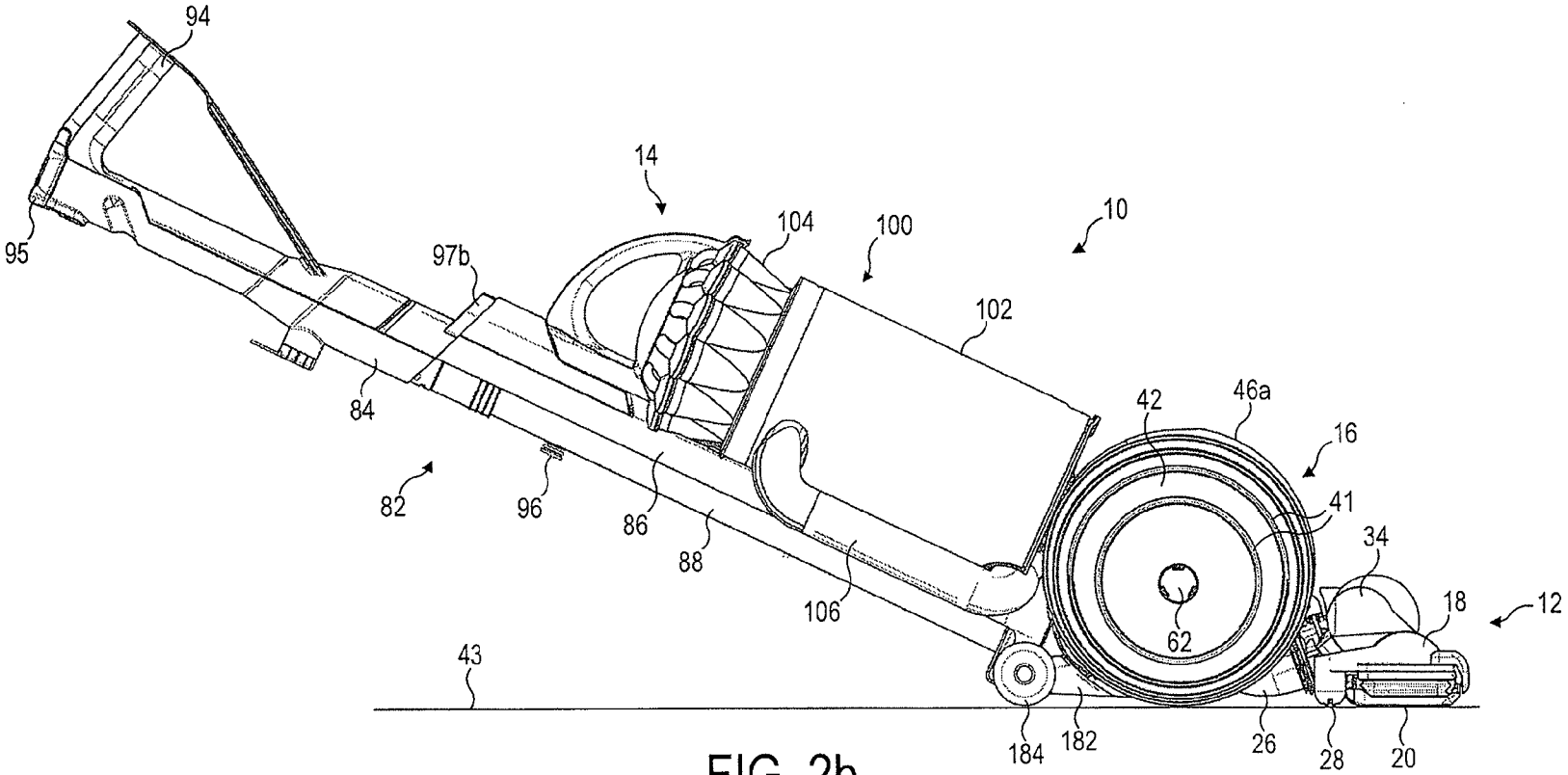
FIG. 2*b* is a right side view of the vacuum cleaner, with the main body in a fully reclined position.

The main body 14 of the vacuum cleaner 10 is moveable between an upright position, illustrated in FIG. 2*a*, and a fully reclined position, illustrated in FIG. 2*b*. In this example, when the vacuum cleaner 10 is located on a substantially horizontal floor surface 43 with both the wheels 28 of the cleaner head 12 and the stabilizer wheels 184 of the stand 180 in contact with the floor surface, the longitudinal axis M of the spine 86 of the main body 14 is substantially orthogonal to a horizontal floor surface 43 when the main body 14 is in its upright position. Of course, the main body 14 may be inclined backwards or forwards slightly towards the floor surface 43 when in its upright position.

The rotational attachment of the yoke 26 and the stand 180 to the motor casing 74 allows the main body 14, which includes the motor casing 74, the hose and wand assembly 82, the spine 86 and the motor inlet duct 130, to be rotated about the axis A relative to the cleaner head 12, and the yoke 26, wheels 40, 42 and stand 180 of the support assembly 16. The axis A may thus also be considered as a pivot axis about which the main body 14 may be reclined away from its upright position. Consequently, as the main body 14 is reclined from its upright position to its fully reclined position the bottom surface of the cleaner head 12 may be maintained in contact with the floor surface. In this example, the main body 14 pivots by an angle of around 65° about the pivot axis A as it is reclined from its upright position to its fully reclined position.

The main body 14 is reclined when the vacuum cleaner 10 is to be used to clean a floor surface. The rotation of the main body 14 of the vacuum cleaner 10 from its upright position is initiated by the user pulling the handle 94 of the main body 14 towards the floor surface while simultaneously pushing the handle 94 downwardly, along the longitudinal axis M of the spine 86 of the main body 14, both to increase the load bearing on the stand 180 and to maintain the bottom surface of the cleaner head 12 in contact with the floor surface. This action causes the stand 180 to move slightly relative to the motor casing 74, against the biasing force of the torsion spring 200, so that the wheels 40, 42 of the support assembly 16 engage the floor surface. This reduces the load acting on the stand 180, due to the load on the vacuum cleaner 10 now being borne also by the wheels 40, 42 of the support assembly 16, and so enables the stand 180 to be raised subsequently to its retracted position, as described in more detail below.

As the main body 14 is reclined relative to the floor surface, the motor casing 74 rotates about the axis A, relative to the support assembly 16. Initially, the stabilizer wheels 184 of the stand 180 remain in contact with the floor surface. Consequently the force acting between the protrusion 240 of the stand locking member 212 and the stand pin 250 increases. The increase in this force is due to both the increased load acting on the stabilizer wheels 184 and the application of a torque to the main body 14. As the user continues to recline the main body 14 towards the floor surface, the torque applied to the main body 14 increases. Eventually, the force acting between the protrusion 240 and the stand pin 250 becomes sufficiently high as to cause the stand locking member 212 to pivot about the tip 228 of its hooked first end 224, against the biasing force of the compression spring 232 acting on the second end 234 of the stand locking member 212. This in turn causes the first side face 242 of the protrusion 240 to slide along the stand pin 250 as the main body 14 is reclined further by the user.

Figure 7B:
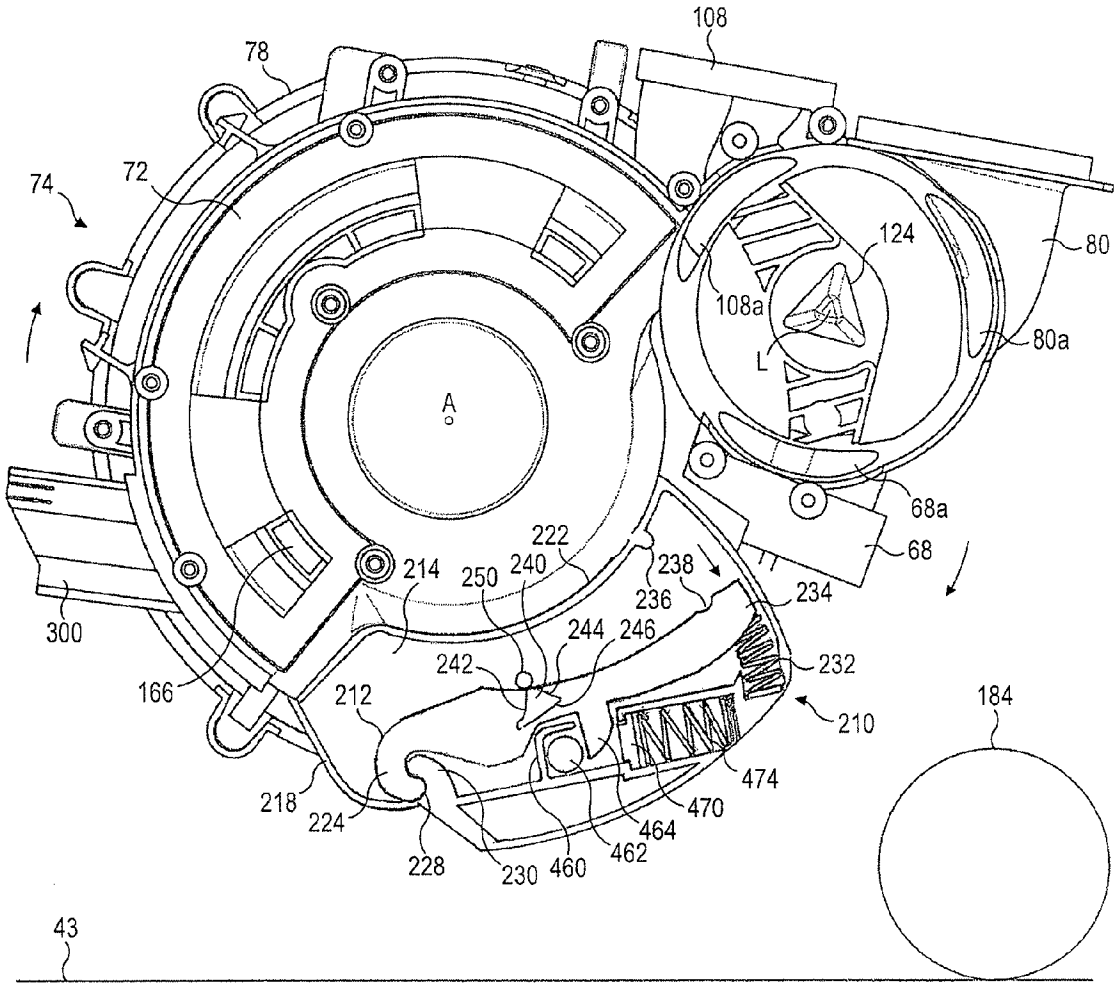
Figure 7C:
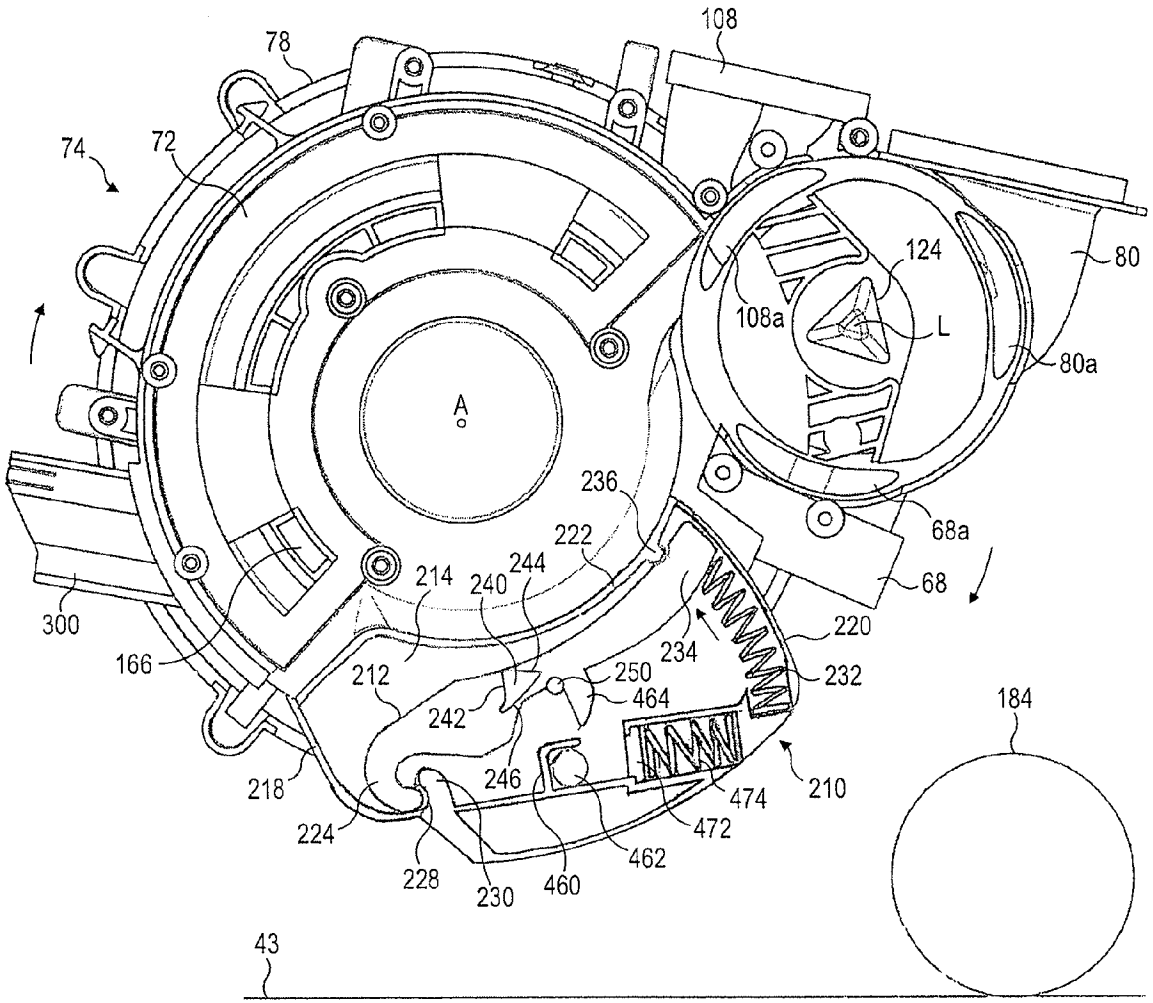

Once the stand locking member 212 has pivoted to a position at which the stand pin 250 is located at the upper edge of the first side face 242, as illustrated in FIG. 7*b*, the stand locking member 212 can now be rapidly moved beneath the stand pin 250 under the action of the torque applied to the main body 14 by the user. This is because the second side face 244 of the protrusion 240 is angled so as to not impede relative movement between the stand pin 250 and the stand locking member 212. This relative movement between the stand pin 250 and the stand locking member 212 is also assisted by the action of the compression spring 232 urging the second end 234 of the stand locking member 212 back towards its raised position as the second side face 244 of the protrusion 240 slides beneath the stand pin 250. When the stand pin 250 and the stand locking member 212 are in the relative positions illustrated in FIG. 7*c*, the stand pin 250 has become released from the stand retaining mechanism 210. In this example, the stand 180 becomes released from the stand retaining mechanism 210 when the main body 14 has been reclined from its upright position by an angle of around 5 to 10°.

However, due to the user both pulling and pushing the handle 94 downwardly to release the stand 180 from the stand retaining mechanism 210, the stand 180 becomes released when the motor casing 74 has been rotated relative to the stand 180 by a slightly greater angle.

Once the stand 180 has been released by the stand retaining mechanism 210, the main body 14 can be reclined fully towards the floor surface by the user while maintaining the bottom surface of the cleaner head 12 in contact with the floor surface. The main body 14 is preferably arranged so that its center of gravity is located behind the stabilizer wheels 184 of the stand 180 once the stand 180 has become disengaged from the stand retaining mechanism 210. Consequently, the weight of the main body 14 tends to assist the user in reclining the main body 14 towards its fully reclined position.

Figure 15B:
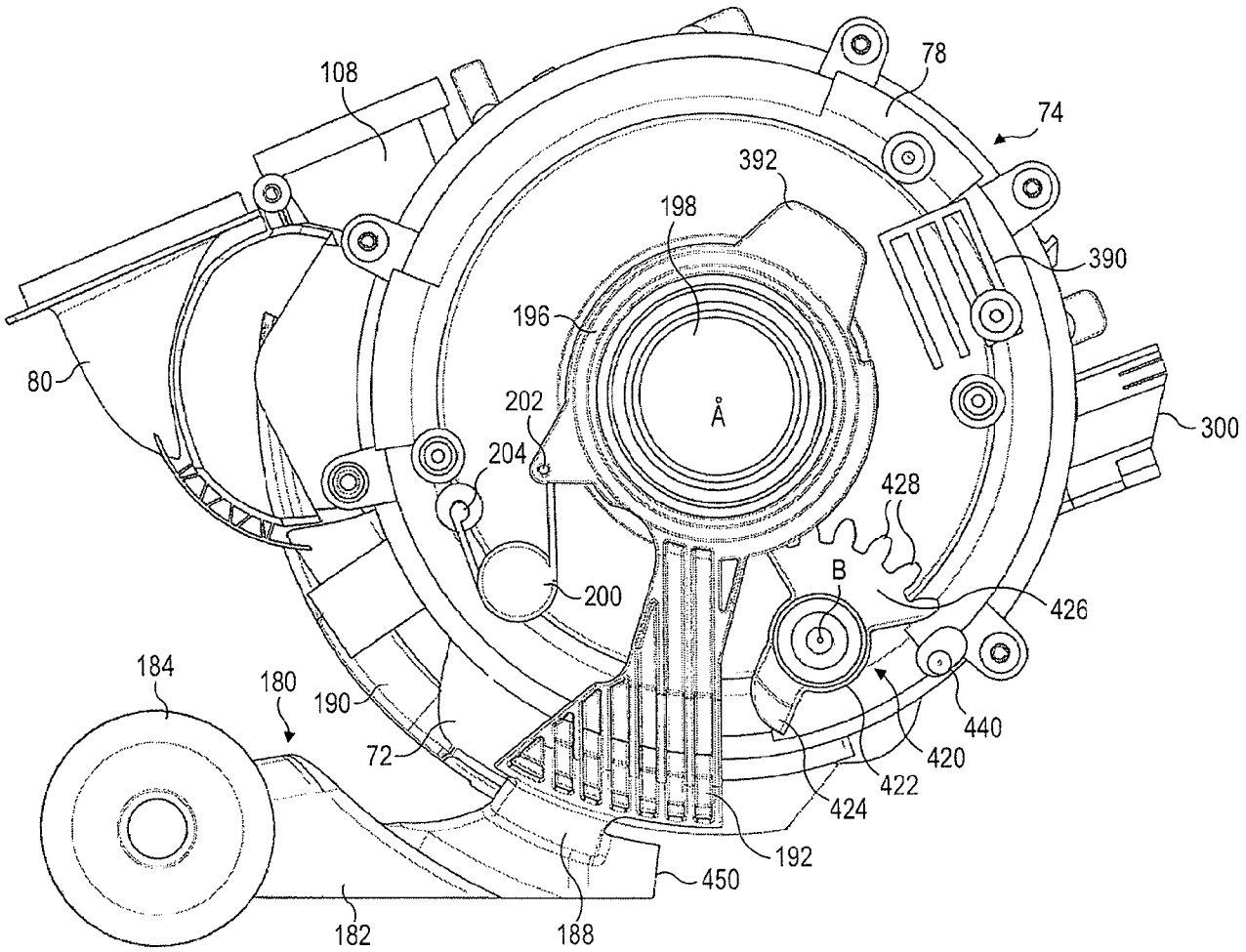

Following its release from the stand retaining mechanism 210, the stand 180 does not automatically move to its retracted position. Instead, as the main body 14 is reclined towards its fully reclined position following the release of the stand 180 from the stand retaining mechanism 210, initially the stabilizer wheels 184 of the stand 180 remain in contact with the floor surface, and so the main body 14 continues to pivot about axis A relative to the stand 180. As discussed above, the over-center spring mechanism comprises a torsion spring 200, and this torsion spring 200 is connected between the stand 180 and the motor casing 74 so that the spacing between the ends 202, 204 of the torsion spring 200 varies as the main body 14 is pivoted about axis A. In this example, this spacing reaches a minimum, and so the torsion spring 200 is at its over-center point, when the main body 14 has been reclined by an angle of around 30° from its upright position. FIGS. 15*a* and 15*b* illustrate the relative positions of the stand 180 and the motor casing 74 when the main body 14 is in its upright position, and when the main body 14 has been reclined so that the torsion spring 200 is at its over-center point, respectively.

Figure 15C:
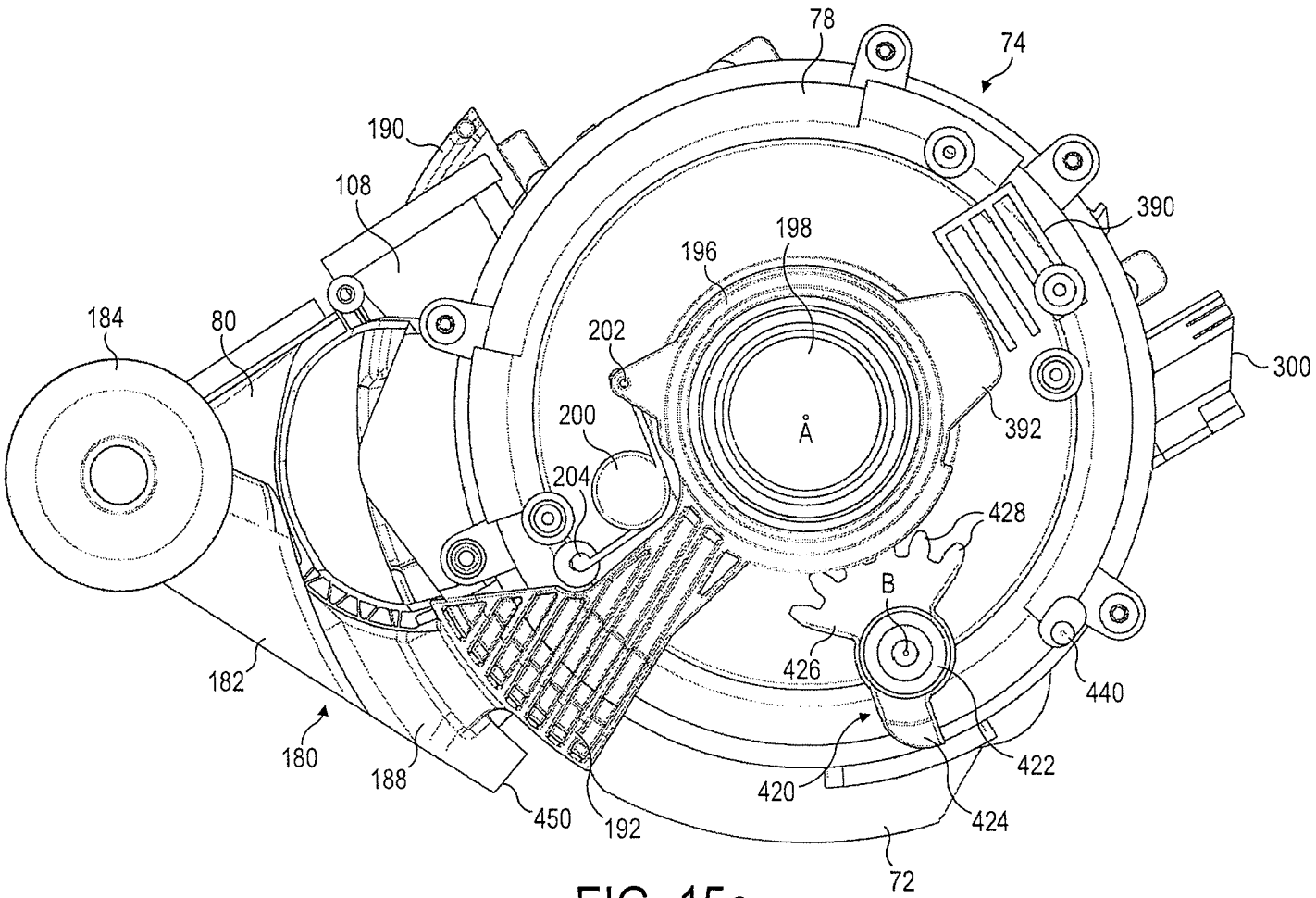

As the main body 14 is reclined beyond the position illustrated in FIG. 15*b*, the biasing force of the torsion spring 200 urges the first end 202 of the torsion spring 200 away from the second end 204 of the torsion spring 200. This results in the automatic rotation of the stand 180 about the axis A to its raised, retracted position, as illustrated in FIG. 15*c*, in which the stabilizer wheels 184 are raised above the floor surface. A first stand stop member 260 located on the motor casing 74 engages the supporting arm 192 of the stand 180 to inhibit movement of the stand 180 beyond its retracted position, and so, in combination with the torsion spring 200, serves to maintain the stand 180 in a fixed angular position relative to the motor casing 74.

Figure 15D:
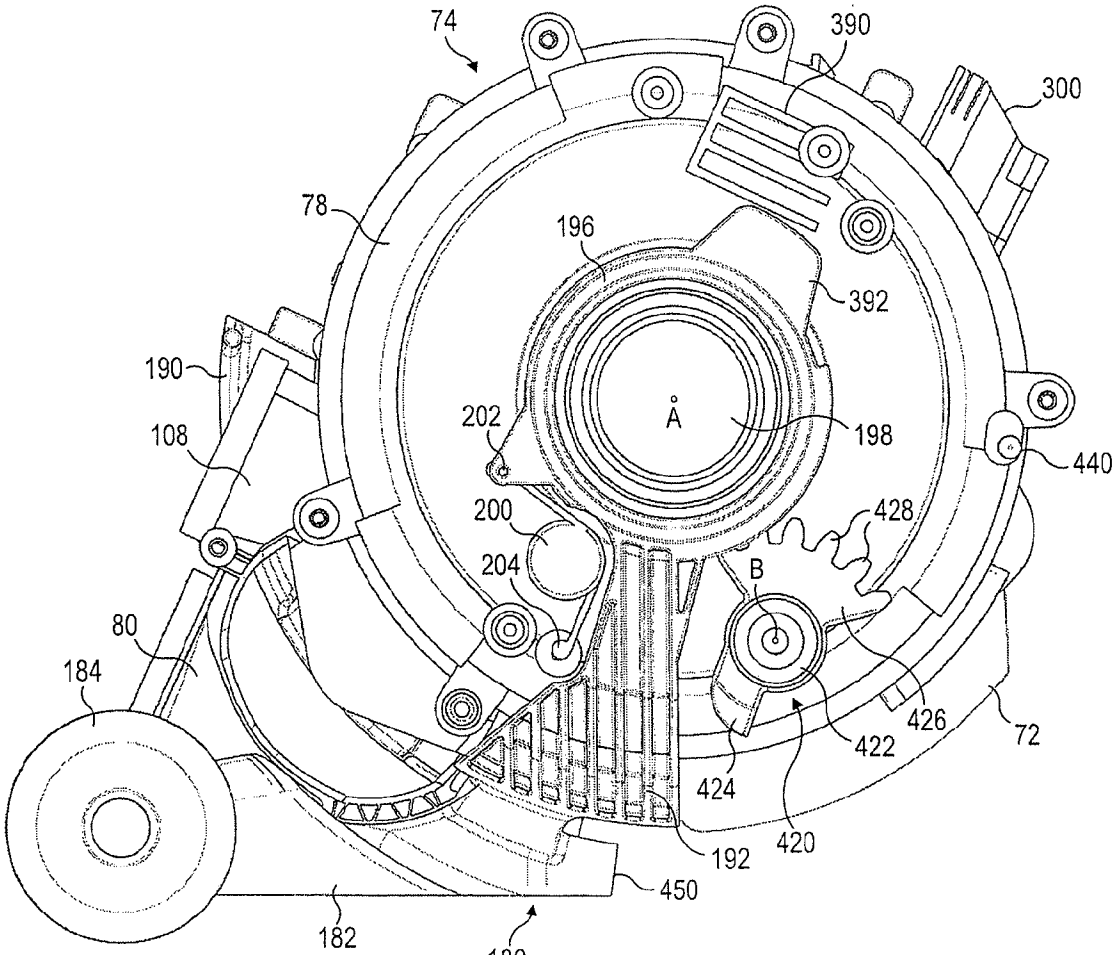
Figure 15E:
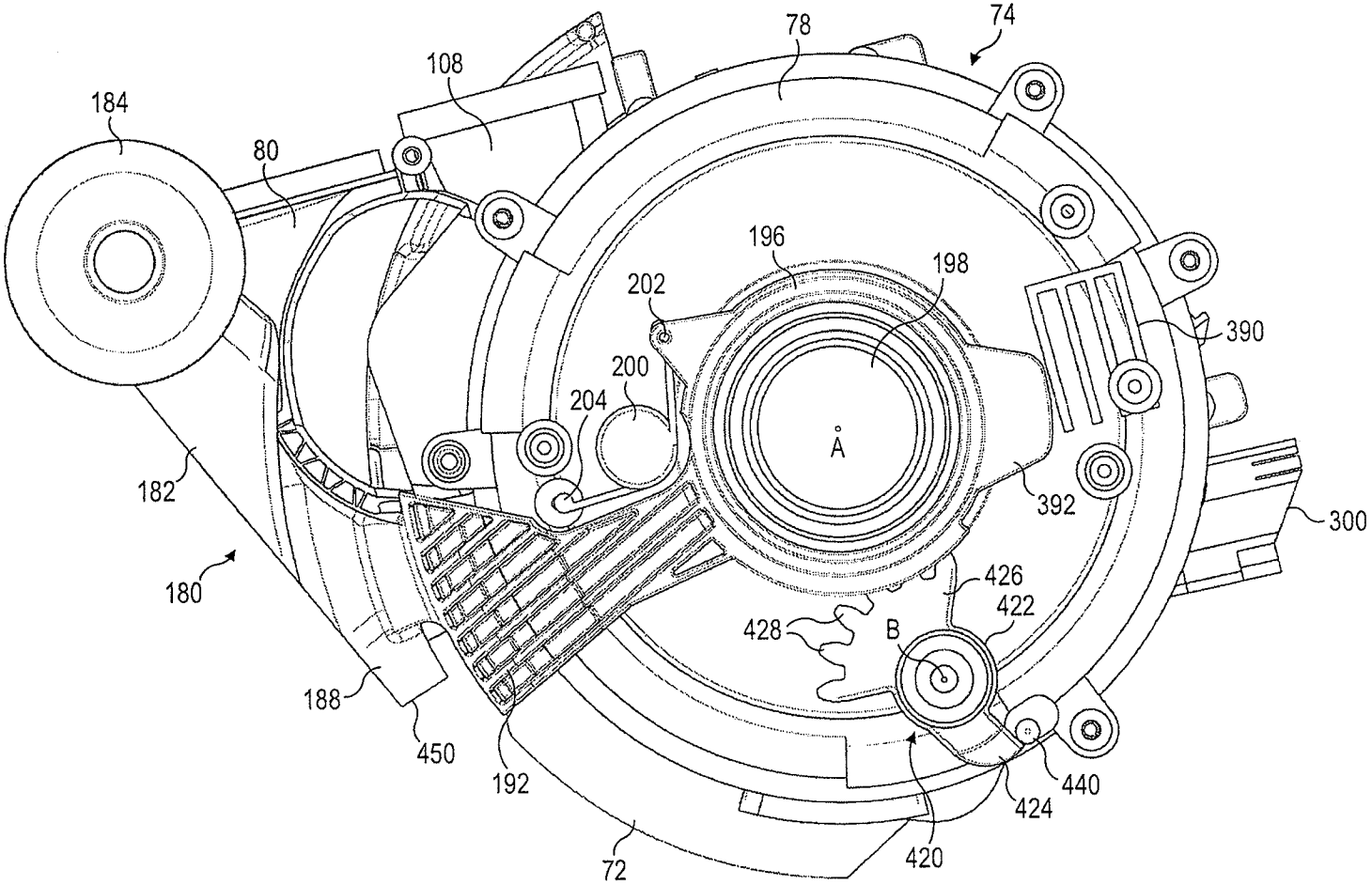
FIG. 15*e* is a similar side view during the return of the main body to its upright position.

The biasing force of the torsion spring 200 subsequently maintains the stand 180 in its retracted position relative to the motor casing 74 when the main body 14 is reclined from its upright position by an angle which, in this example, is in the range from 15 and 65°. We have found that, during floor cleaning, the main body 14 of the vacuum cleaner 10 tends to be inclined at an angle within this range as it is maneuvered over a floor surface, and so generally the torsion spring 200 will prevent the stand 180 from moving away from its retracted position during a floor cleaning operation. FIG. 15*d* shows the relative positions of the stand 180 and the motor casing 74 when the main body 14 is in its fully reclined position. In this position, the stabilizer wheels 184 are able to contact the floor surface, and thus may assist in maneuvering of the vacuum cleaner 10 over the floor surface when the main body 14 is in its fully reclined position, for example for cleaning beneath items of furniture.

As the main body 14 is reclined from its upright position, the cleaner head 12 is released by the cleaner head retaining mechanism 280 to allow the cleaner head 12 to rotate relative to the yoke 26 as the vacuum cleaner 10 is subsequently maneuvered over the floor surface during floor cleaning. As mentioned above, the actuator 298 of the cleaner head retaining mechanism 280 is retained between the arms 300 extending outwardly from the motor casing 74, whereas the engagement between the ribs 290 of the locking member 282 and the grooves 288 of the locking member housing 284 retains the locking member 282 on the yoke 26. Consequently, as the main body 14 is reclined the motor casing 74 rotates about axis A relative to the yoke 26, which results in the actuator 298 moving upwardly relative to the locking member 282.

As the main body 14 is reclined, the front face 308 of the actuator 298 slides over the rear face 310 of the locking member 282. A series of grooves may be formed on the rear face 310 of the locking member 282 to reduce frictional forces generated as the front face 308 of the actuator 298 slides over the rear face 310 of the locking member 282. Due to the conformingly curved shapes of the front face 308 of the actuator 198 and the rear face 310 of the locking member 282, the locking member 282 remains in its deployed position while the front face 308 of the actuator 298 maintains contact with the rear face 310 of the locking member 282.

Figure 14C:
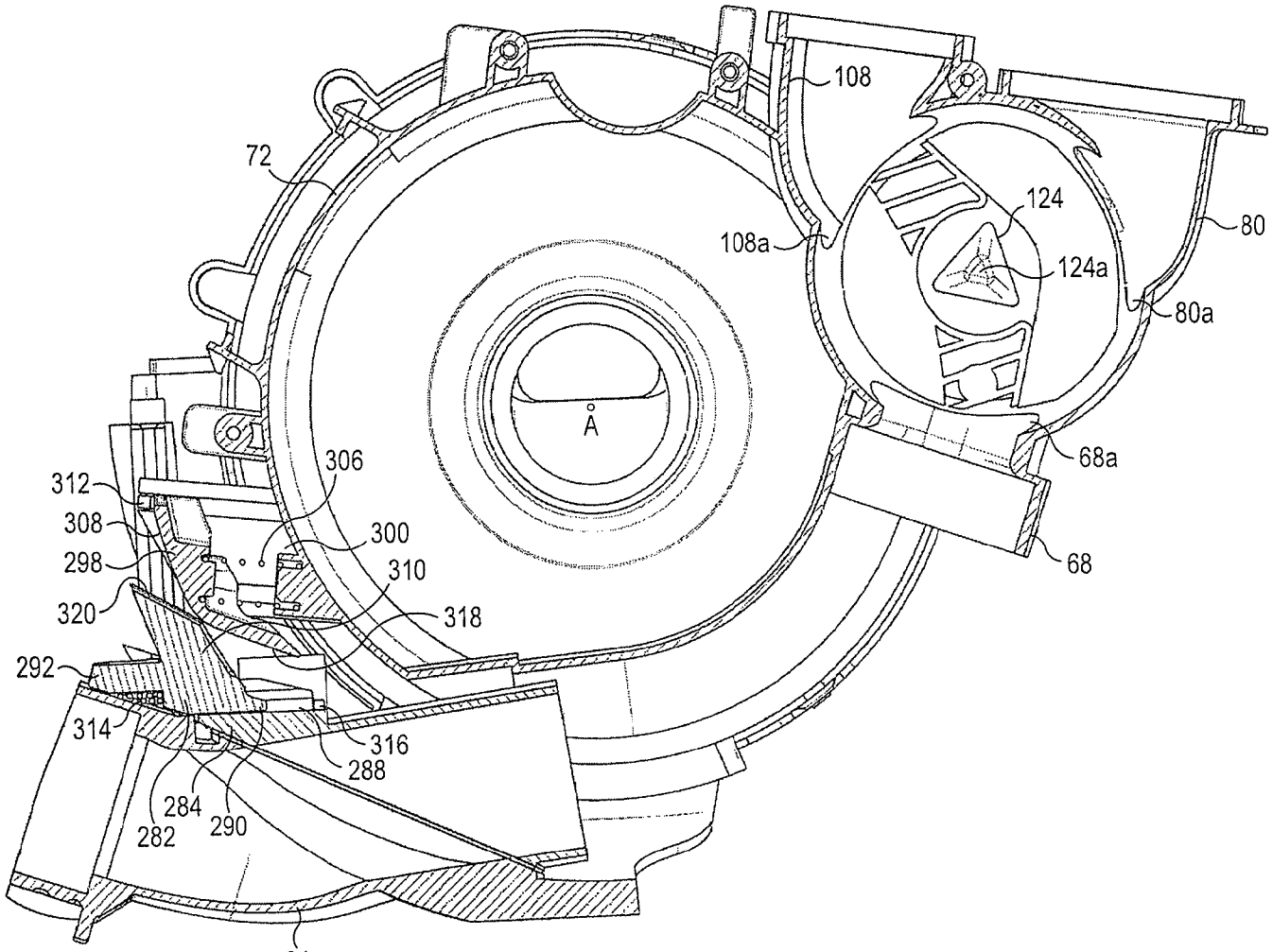
Figure 14D:
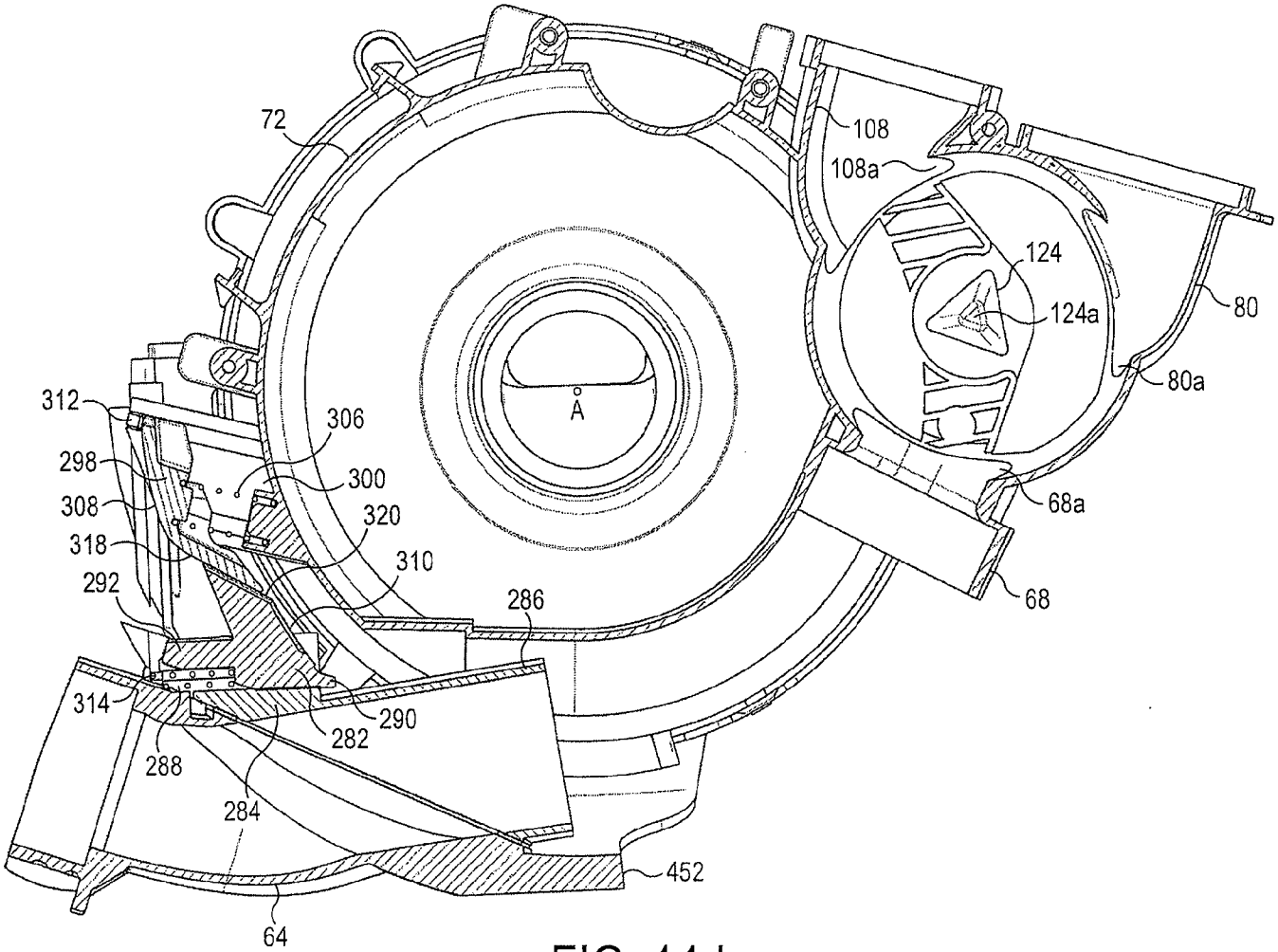

In this example the front face 308 of the actuator 298 maintains contact with the rear face 310 of the locking member 282 until the main body 14 has been reclined by an angle of around 7°. This means that the angular position of the cleaner head 12 relative to the yoke 26 remains fixed while the stand 180 is retained in its supporting position by the stand retaining mechanism 210. The relative positions of the locking member 282 and the actuator 298 when the main body 14 has been reclined by around 7° are shown in FIG. 14*c*. With continued reclining of the main body 14 from its upright position, the front face 308 of the actuator 298 becomes disengaged from the rear face 310 of the locking member 282. The biasing force of the spring 306 urges the actuator 298 away from the motor casing 74 and against the catch 312, as shown in FIG. 14*d*. Under the action of the spring 314, the locking member 282 begins to move along the locking member housing 284, away from its deployed position, as the main body 14 is reclined, resulting in the retraction of the fingers 292 from the groove 296 formed in the outer collar 297 of the fluid outlet 24 of the cleaner head 12.

As also shown in FIGS. 14*a* and 14*b*, the actuator 298 comprises a curved, lower drive face 318 which is inclined by an angle of around 30 to 40° to the front face 308 of the actuator 298. The locking member 282 comprises a conformingly curved upper driven face 320, which is inclined at an angle of around 30 to 40° to the rear face 310 of the locking member 282. The purpose of the drive face 318 and the driven face 320 is to allow the locking member 282 to be subsequently returned to its deployed position, as described in more detail below. Under the action of the spring 314, the driven face 320 of the locking member 282 slides over the drive face 318 of the actuator 298 as the main body 14 is reclined. Grooves may also be formed in the driven face 320 to reduce frictional forces generated as the driven face 320 slides over the drive face 318.

FIG. 14*d* illustrates the relative positions of the locking member 282 and the actuator 298 when the locking member 282 has moved to its stowed position, in which the fingers 292 of the locking member 282 are fully retracted from the groove 296 formed in the outer collar 297 of the fluid outlet 24 of the cleaner head 12 to allow the cleaner head 12 to rotate relative to the yoke 26. In this example the locking member 282 reaches its stowed position once the main body 14 has been reclined by an angle of around 15° from its upright position, that is, before the stand 180 is moved to its retracted position by the over-center spring mechanism. As the main body 14 is reclined further, the drive surface 318 becomes spaced from the driven surface 320, allowing the spring 314 to maintain the locking member 282 in its stowed position, in which it is urged against the stop member 316 located at the rear of the locking member housing 284.

The movement of the stand 180 from its supporting position to its retracted position actuates the movement of the valve member 112 of the changeover valve 110 from its first position to its second position. Returning to FIGS. 9*a* and 9*b*, the changeover valve 110 further comprises a valve drive 340 for rotating the valve member 112 between its first and second positions. The valve drive 340 comprises a body 342, a first pair of drive arms 344 and a second pair of drive arms 346. Each pair of drive arms 344, 346 extends outwardly from the body 342, with the first pair of drive arms 344 being located diametrically opposite the second pair of drive arms 346. Within each pair, the drive arms 344, 346 are spaced apart to define an elongate slot 348, 350. The ends 352, 354 of each pair of drive arms 344, 346 protrude inwardly so that each slot 348, 350 has a region of reduced width located remote from the body 342. A further slot 355 extends radially inwardly from the outer periphery of the body 342.

The valve member 112 comprises a pair of diametrically opposed driven arms 356 extending outwardly from the side thereof located opposite to the hub 122 (only one of the shafts 356 is visible in FIGS. 9*a* and 9*b*). Each driven arm 356 is arranged to be received between a respective pair of drive arms 344, 346 by a snap-fit connection so that each driven arm 356 is moveable within a respective slot 348, 350 but is retained therein by the ends 352, 354 of the drive arms 344, 346 defining that slot 348, 350. Each driven arm 356 has a head 358 which is locally enlarged to prevent the driven arms 356 from sliding out of the slots 348, 350. This arrangement enables the drive arms 344, 346 of the valve drive 340 to rotate the driven arms 356 of the valve member 112 about the longitudinal axis L of the boss 124 while permitting the valve member 112 to move towards and away from the valve drive 340.

A helical compression spring 360 is located between the valve member 112 and the valve drive 340. One end of the spring 360 is located over a boss 362 located within a recess 364 located centrally in the body 342 of the valve drive 340, while the other end of the spring 360 is located within a central recessed portion (not shown) of the outer surface of the valve member 112.

The valve drive 340 is rotatably connected to a cover plate 366 by a connector pin 368 which extends through an aperture 370 formed in the cover plate 366. In assembly, the valve member 112 is located on the boss 124 of the motor casing 74 so that the valve member 112 is in its first position. The valve drive 340 is then connected to the valve member 112, with the spring 360 disposed therebetween, with the slot 355 oriented so that the mouth 355*a* of the slot 355 is located below the center of the drive member 340. The cover plate 366 is then connected to the valve drive 340 using the connector pin 368 so that the valve drive 340 can rotate relative to the cover plate 366, and secured to the first motor casing section 72 by screws 372 which are inserted through apertures 374 in the cover plate 366 and screwed into the motor casing 74. When the valve member 112, valve drive 340 and the cover plate 366 are located on the motor casing 74, both the valve member 112 and the valve drive 340 may be rotated about the longitudinal axis L of the boss 124. Due to the connection of the valve drive 340 to the cover plate 366, the biasing force of the spring 360 urges the valve member 112 towards the boss 124 located on the motor casing 74.

Figure 16A:
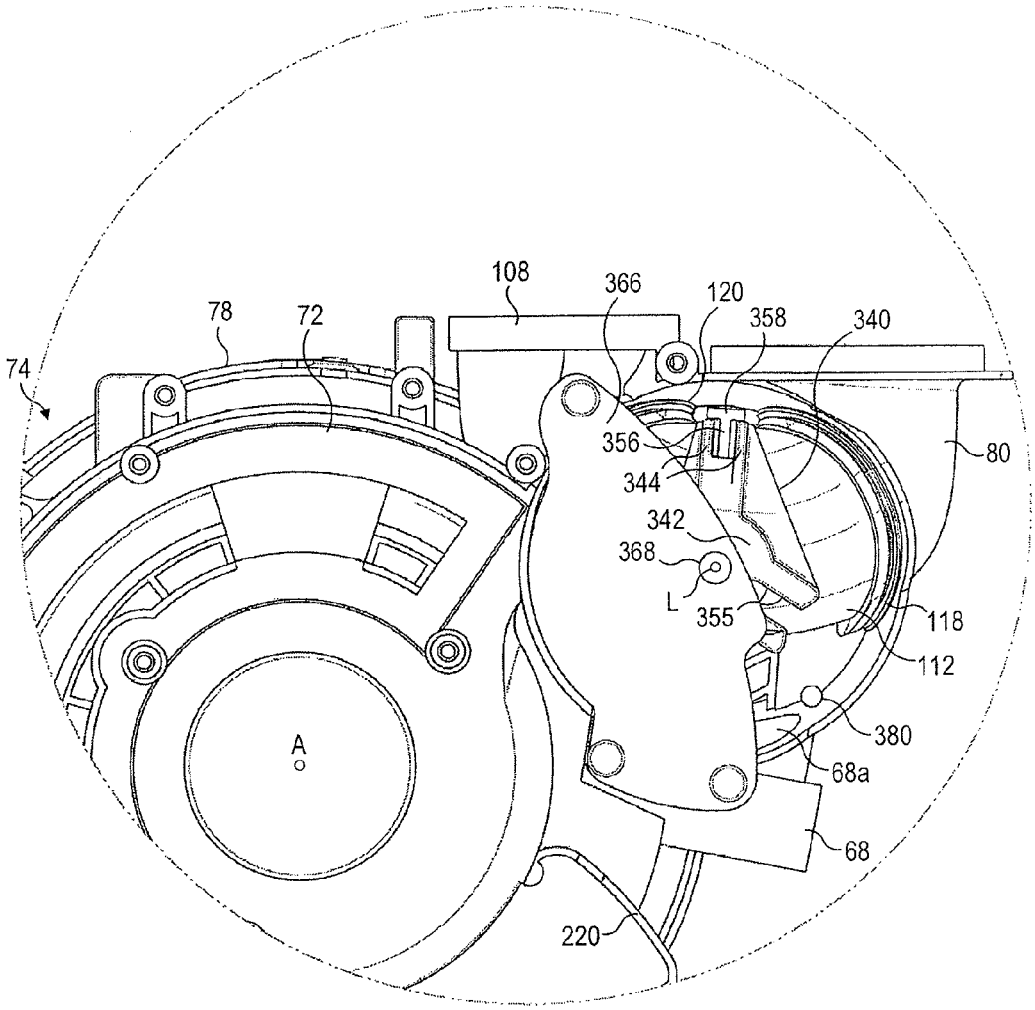
FIGS. 16*a* to 16*d* are a series of left side views of the motor casing of the vacuum cleaner, illustrating the movement of the change over arrangement from the first angular position to the second angular position.
Figure 16B:
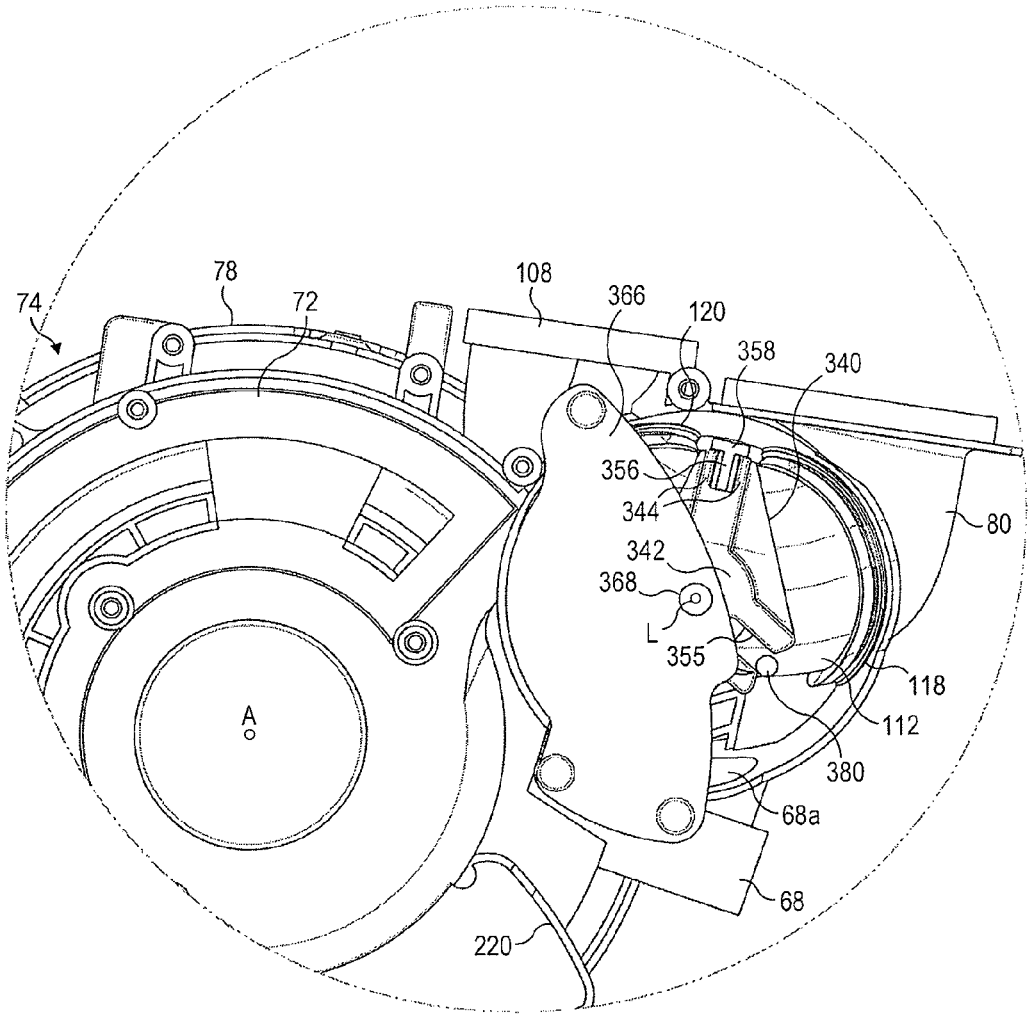
Figure 16C:
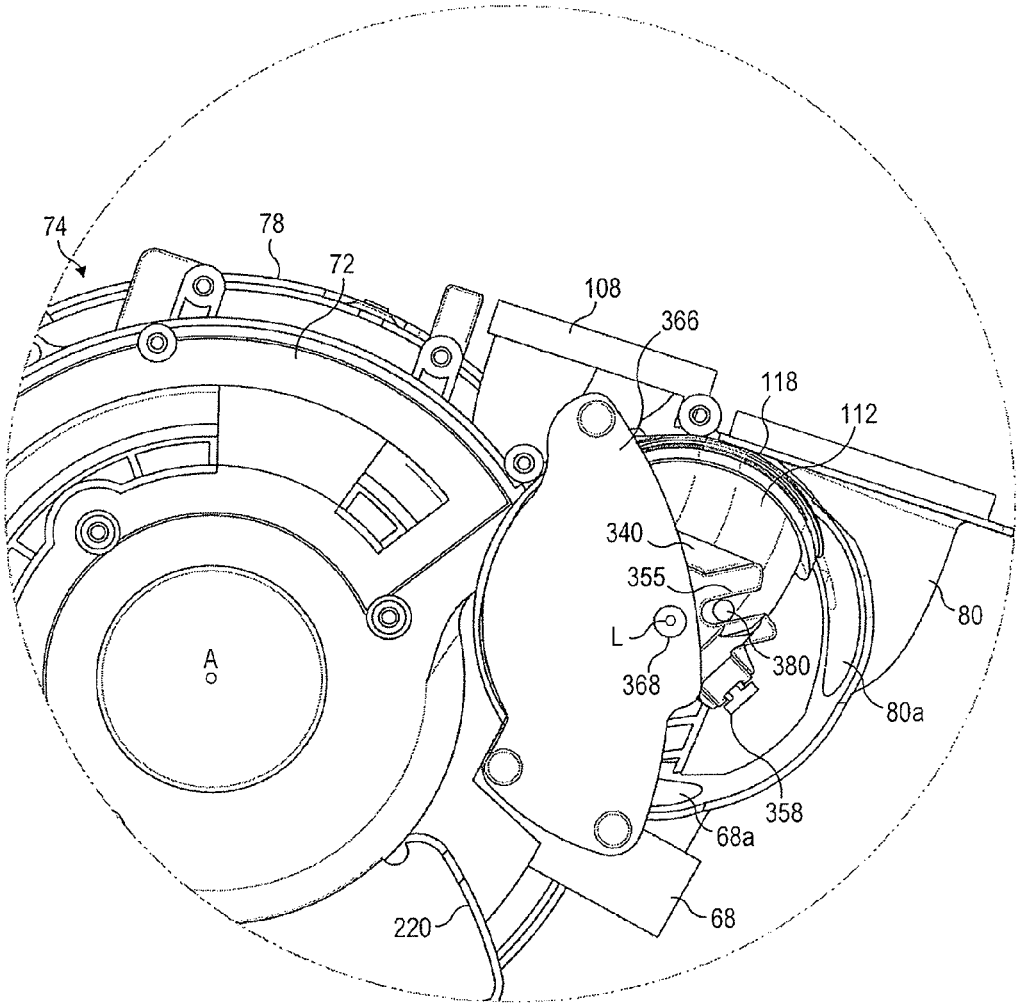

The movement of the valve member 112 between its first and second positions is actuated by the stand 180 as the main body 14 is reclined from its upright position. While the stand 180 is in its supporting position, the longitudinal axis L of the hub 124 orbits about the pivot axis A of the main body 14 towards the stand 180 as the main body 14 is reclined. As shown in FIG. 13, the supporting arm 190 of the stand 180 comprises a valve drive pin 380 extending inwardly from a raised section 382 of the supporting arm 190. With reference now to FIG. 16*a*, the valve drive pin 380 is spaced from the valve drive 340 when the main body 14 is in its upright position. The valve drive pin 380 is positioned on the supporting arm 190 so that as the main body 14 is reclined towards the floor surface, the valve drive pin 380 enters the slot 355 formed in the body 342 of the valve drive 340, through the mouth 355*a* thereof. In this example, the valve drive pin 380 enters the slot 355 once the main body 14 has been reclined by an angle of around 9° from its upright position. The relative positions of the valve drive pin 380 and the valve drive 340 when the main body 14 has been reclined by this amount are shown in FIG. 16*b*. As the main body 14 is reclined further from the upright position, the relative movement between the motor casing 74 and the stand 180 causes the valve drive 340 to be rotated about the longitudinal axis L of the boss 124 by the valve drive pin 380, which in turn causes the valve member 112 to be rotated from its first position towards its second position, as illustrated in FIG. 16*c*.

Figure 16D:
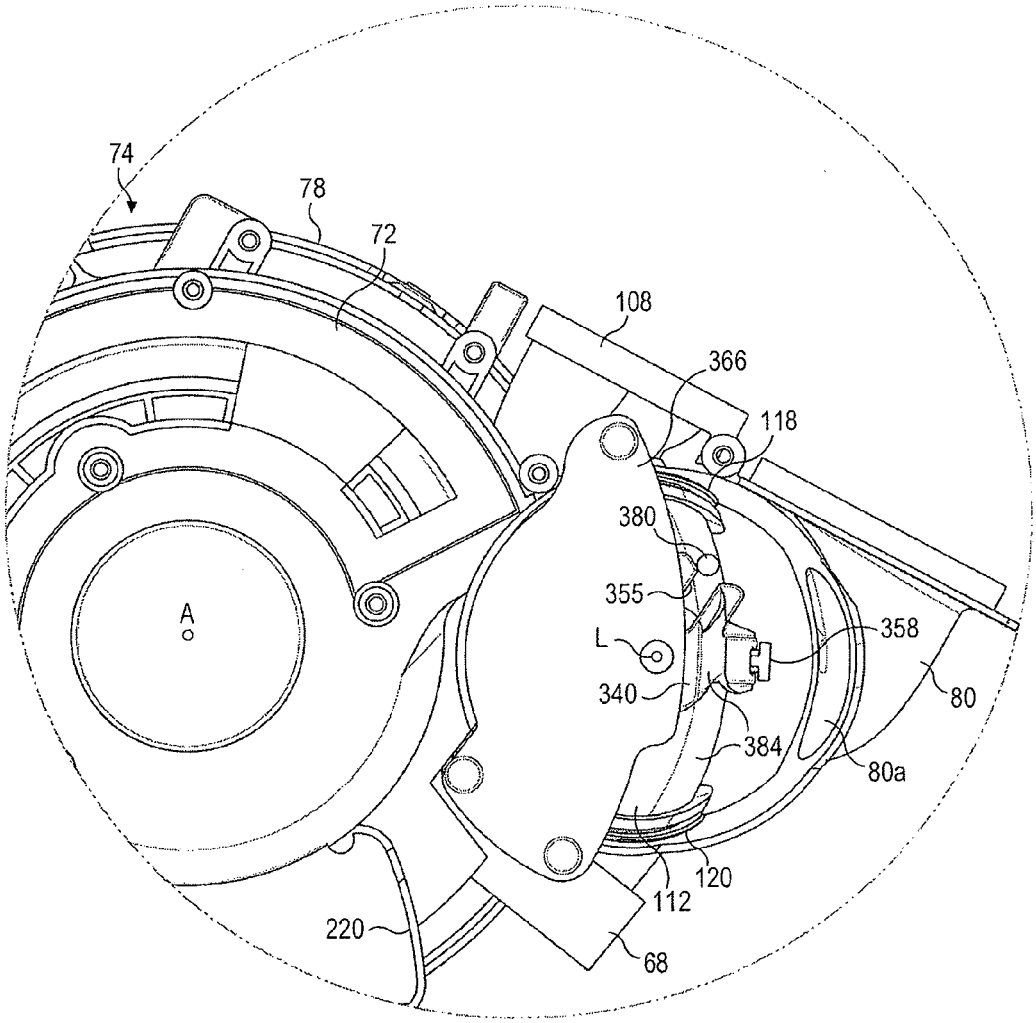

The valve drive 340 rotates about the longitudinal axis L of the hub 124 until the valve drive pin 380 eventually leaves the slot 355, as shown in FIG. 16*d*. In this example, the valve drive pin 380 leaves the mouth 355*a* of the slot 355 when the main body 14 has been reclined by an angle of around 25 to 30° from its upright position. Following this rotation of the valve drive 340 about the longitudinal axis L of the hub 124, the valve member 112 has been rotated about an angle of 120° from its first position to its second position, as also shown in FIG. 10*b*, although the angle of rotation of the valve member 112 may be any desired value depending on the arrangement of the motor casing 74. The entire movement of the valve member 112 from its first position to its second position thus occurs while the stand 180 is in its supporting position.

The tapered, triangular profiles of the outer surface of the boss 124 and the inner surface 123 of the hub 122 assist in breaking the seals that the valve member 112 makes with the hose and wand assembly outlet section 80 and the inlet duct inlet section 106 when the valve member 112 is in its first position. This reduces the amount of torque required to rotate the valve member 112 to its second position, particularly when an airflow is being drawn through the changeover valve 110. As the valve member 112 is urged away from its first position through the rotation of the valve drive 340 by the valve drive pin 380, due to the tapered triangular profiles of the outer surface of the boss 124 and the inner surface 123 of the hub 122 the movement of the valve member 112 has two different components: (i) a rotational movement about the longitudinal axis L of the boss 124 with the valve drive 340, and (ii) a translational movement along the longitudinal axis L of the boss 124 towards the valve drive 340, against the biasing force of the spring 360. It is this translational movement of the valve member 112 along the boss 124 that facilitates the breaking of the aforementioned seals.

This combination of translational and rotational movements of the valve member 112 relative to the boss 124 continues until the valve member 112 has been rotated about the longitudinal axis L of the boss 124 by around 60°. At this point, the valve member 112 has moved along the longitudinal axis L of the boss 124 by a distance which in this example in the range from 5 to 10 mm. The further movement of the valve member 112 as it is moved to its second position now has the following two different components (i) a rotational movement about the longitudinal axis L of the boss 124 with the valve drive 340, and (ii) a reverse translational movement along the longitudinal axis L of the boss 124, away from the valve drive 340, under the biasing force of the spring 360.

In the second angular position of the valve member 112 relative to the motor casing 74, the airflow path defined by the valve member 112 connects the internal duct 66 to the separating apparatus inlet duct 106 so that air is drawn into the vacuum cleaner 10 through the suction opening 22 of the cleaner head 12. As shown in FIG. 10*b*, in this second position of the valve member 112 the first port 114 is now seated over the air inlet 108*a* so that the seal 118 is in sealing contact with the inlet duct inlet section 108, and second port 116 is seated over the air outlet 68*a* so that the seal 120 is in sealing contact with the internal duct outlet section 68. In this second position of the valve member 112, the body of the valve member 112 serves to isolate the hose and wand assembly 82 from the fan unit 76 so that substantially no air is drawn into the vacuum cleaner 10 through the wand 84 of the hose and wand assembly 82. Again, the conforming profiles of the inner surface 123 of the hub 122 and the outer surface of the boss 124 means that the valve member 112 can be accurately aligned, both angularly and axially, relative to the motor casing 74 when in its second position. When compared to FIG. 10*a*, FIG. 10*b* illustrates the compression of the hose 70 of the internal duct 66 as the main body 14 moves from its upright position to a reclined position. This is due to the movement of the internal duct outlet section 68, which is connected to the motor casing 74, towards the internal duct inlet section 64, which is connected to the yoke 26.

Returning to FIG. 16*d*, the valve member 112 and the valve drive 340 are each shaped to define a groove or recess 384. The recess 384 is arranged so that the valve drive pin 380 can move along the outer surface of the valve member 112 and the valve drive 340 in the event that the valve member 112 has been moved manually to its second position while the main body 14 is in the upright position.

The movement of the stand 180 from its supporting position to its retracted position also enables the motor of the brush bar assembly 30 to be energized. As the stand 180 is moved to its retracted position, the supporting arm 192 actuates a brush bar activation switch mechanism (not shown) mounted in a switching housing 390 located on the second motor casing section 78. The actuation of this switch mechanism is preferably through contact between the switch mechanism and a switch actuating portion 392 of the annular connector 196 of the supporting arm 192 of the stand 180 as the stand 180 moves to its retracted position. For example, the switch mechanism may comprise a spring-loaded cam which is engaged by the switch actuating portion 392 of the stand 180 and urged against a switch of the switching mechanism as the stand 180 is rotated towards its retracted position. Alternatively, this switch may be actuated by a magnetic, optical or other non-contact actuation technique. The actuation of the switch preferably occurs as the stand 180 is moved towards its retracted position by the over-center spring mechanism. Upon actuation, the switch is placed in a first electrical state in which power is supplied to the motor 33 of the brush bar assembly 30 to enable the brush bar assembly 30 to be rotated within the brush bar chamber 32 of the cleaner head 12. The vacuum cleaner 10 is preferably arranged so that rotation of the brush bar assembly 30 is started upon actuation of the switch. Depending on the nature of the floor surface to be cleaned, the user may choose to de-activate the motor 33 by de-pressing the second switch 97*b*. During cleaning, the motor 33 of the brush bar assembly 30 may be selectively re-activated or de-activated as required by depressing the second switch 97*b*.

In use, with the main body 14 is in a reclined position and the valve member 112 of the changeover valve 110 is in its second position, a dirt-bearing airflow is drawn into the vacuum cleaner 10 through the suction opening 22 of the cleaner head 12 when the user depresses the first switch 97*a* to activate the fan unit 76. The dirt-bearing airflow passes through the cleaner head 12 and the internal duct 66 and is conveyed by the valve member 112 of the changeover valve 110 into the separating apparatus inlet duct 106. The subsequent passage of the airflow through the vacuum cleaner 10 is as discussed above when the main body 14 is in its upright position.

Returning to FIG. 5*a*, the main body 14 comprises a bleed valve 400 for allowing an airflow to be conveyed to the fan unit 76 in the event of a blockage occurring in, for example, the wand and hose assembly 82 when the main body 14 is in its upright position or the cleaner head 12 when the main body 14 is in a reclined position. This prevents the fan unit 76 from overheating or otherwise becoming damaged. The bleed valve 400 is located in the lower portion of the motor inlet duct inlet section 134, and so is located within the spherical volume V delimited by the wheels 40, 42 of the support assembly 16. The bleed valve 400 comprises a piston chamber 402 housing a piston 404. An aperture 406 is formed at one end of the piston chamber 402 for exposing the piston chamber 402 to the external environment, and a conduit 408 is formed at the other end of the piston chamber 402 for placing the piston chamber 402 in fluid communication with the motor inlet duct inlet section 134.

A helical compression spring 410 located in the piston chamber 402 urges the piston 404 towards an annular seat 412 inserted into the piston chamber 402 through the aperture 406. During use of the vacuum cleaner 10, the force $F_1$ acting on the piston 402 against the biasing force $F_2$ of the spring 410, due to the difference in the air pressure acting on each respective side of the piston 404, is lower than the biasing force $F_2$ of the spring 410, and so the aperture 406 remains closed. In the event of a blockage in the airflow path upstream of the conduit 404, the difference in the air pressure acting on the opposite sides of the piston 402 dramatically increases. The biasing force $F_2$ of the spring 410 is chosen so that, in this event, the force $F_1$ becomes greater than the force $F_2$, which causes the piston 404 to move away from the seat 412 to open the aperture 406. This allows air to pass through the piston chamber 402 from the external environment and enter the motor inlet duct 130.

Turning now to FIGS. 11*a* to 11*e*, a shield 414 is connected to the motor casing 74 for inhibiting the ingress of dirt into the spherical volume V delimited by the wheels 40, 42 of the support assembly 16 when the main body 14 is in a reclined position. The shield 414 is connected to the motor casing 74 using one or more of the bolts or other fixing means which are used to connect the motor inlet duct 130 to the motor casing 74. The shield 414 has an upper surface 414*a* which has a substantially spherical curvature. The radius of curvature of the upper surface 414*a* of the shield 414 is only slightly smaller than that of the upper surface 46*a* of the upper yoke section 46. The shield 414 has a curved upper end 416 which partially surrounds the motor inlet duct inlet section 134, and a lower end 418 which terminates above the arms 300 of the first motor casing section 72. The shield 414 also provides a housing for one or more of the electronic components of the vacuum cleaner 10, such as a circuitry for driving the motor 33 of the brush bar assembly 30 and/or the fan unit 76.

Figure 11B:
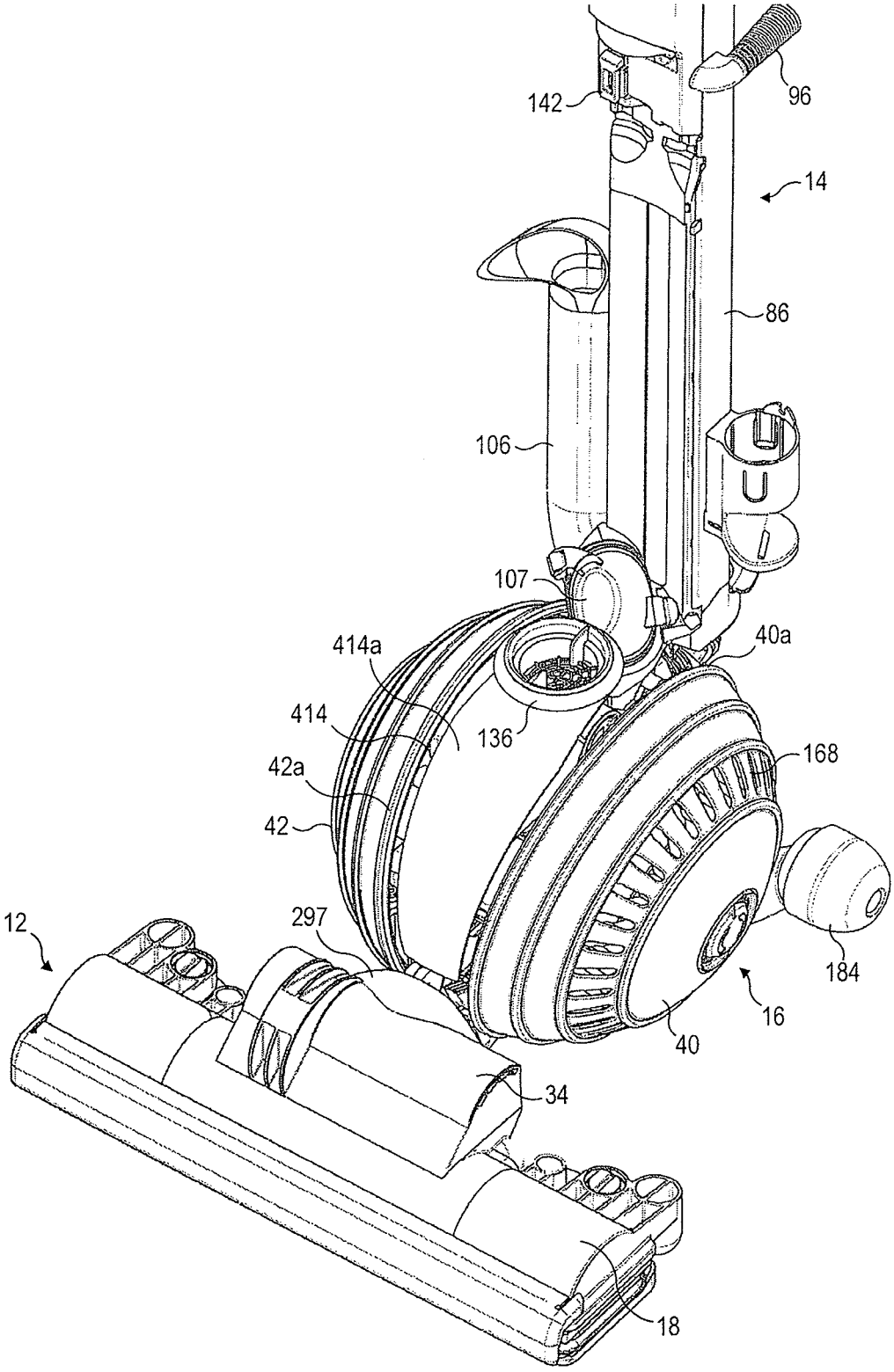
FIG. 11*b* is a similar view as FIG. 11*a* but with the upper yoke section omitted.
Figure 11C:
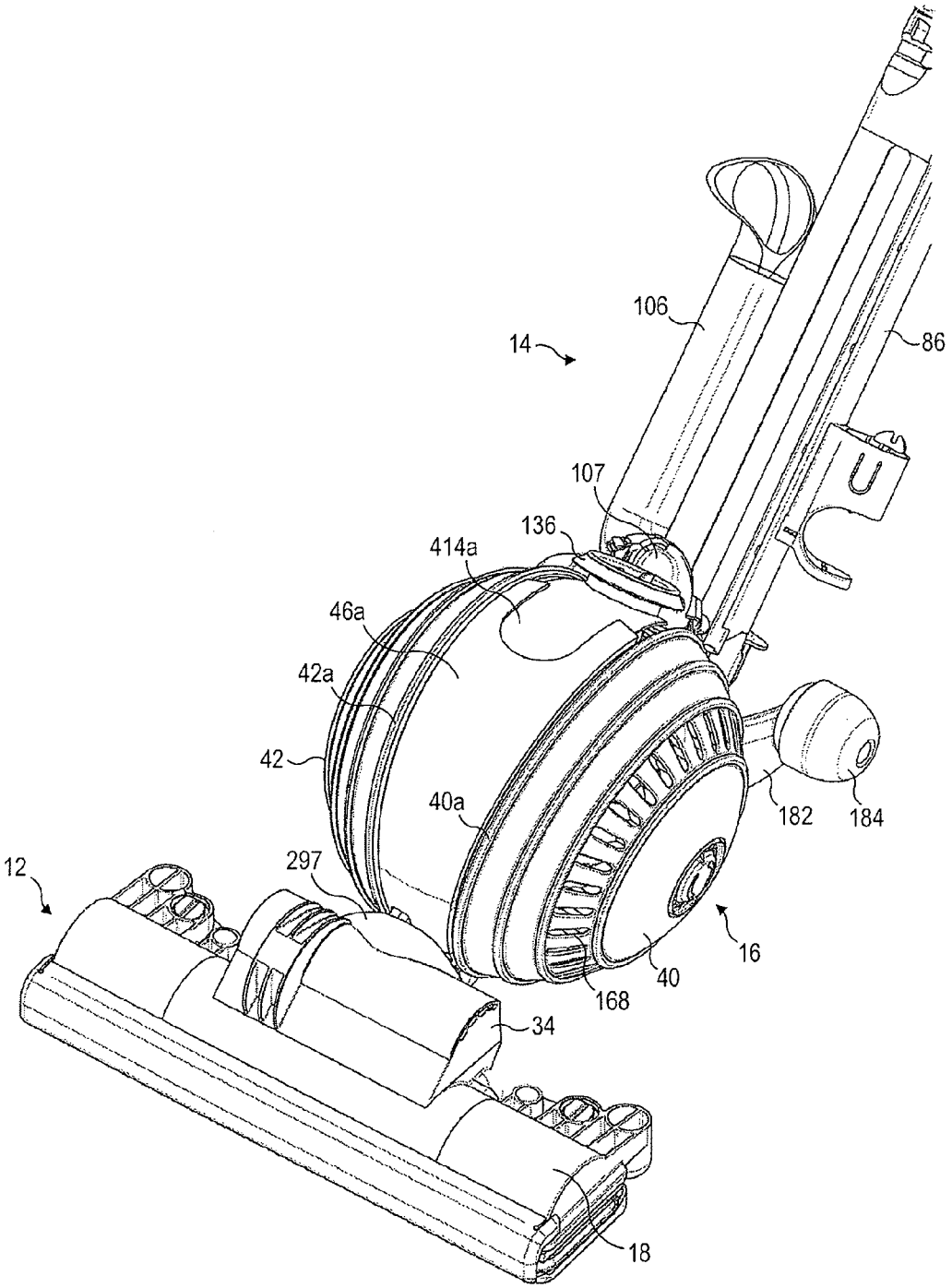
FIG. 11*c* is a similar view as FIG. 11*a* but with the main body in a reclined position.
Figure 11D:
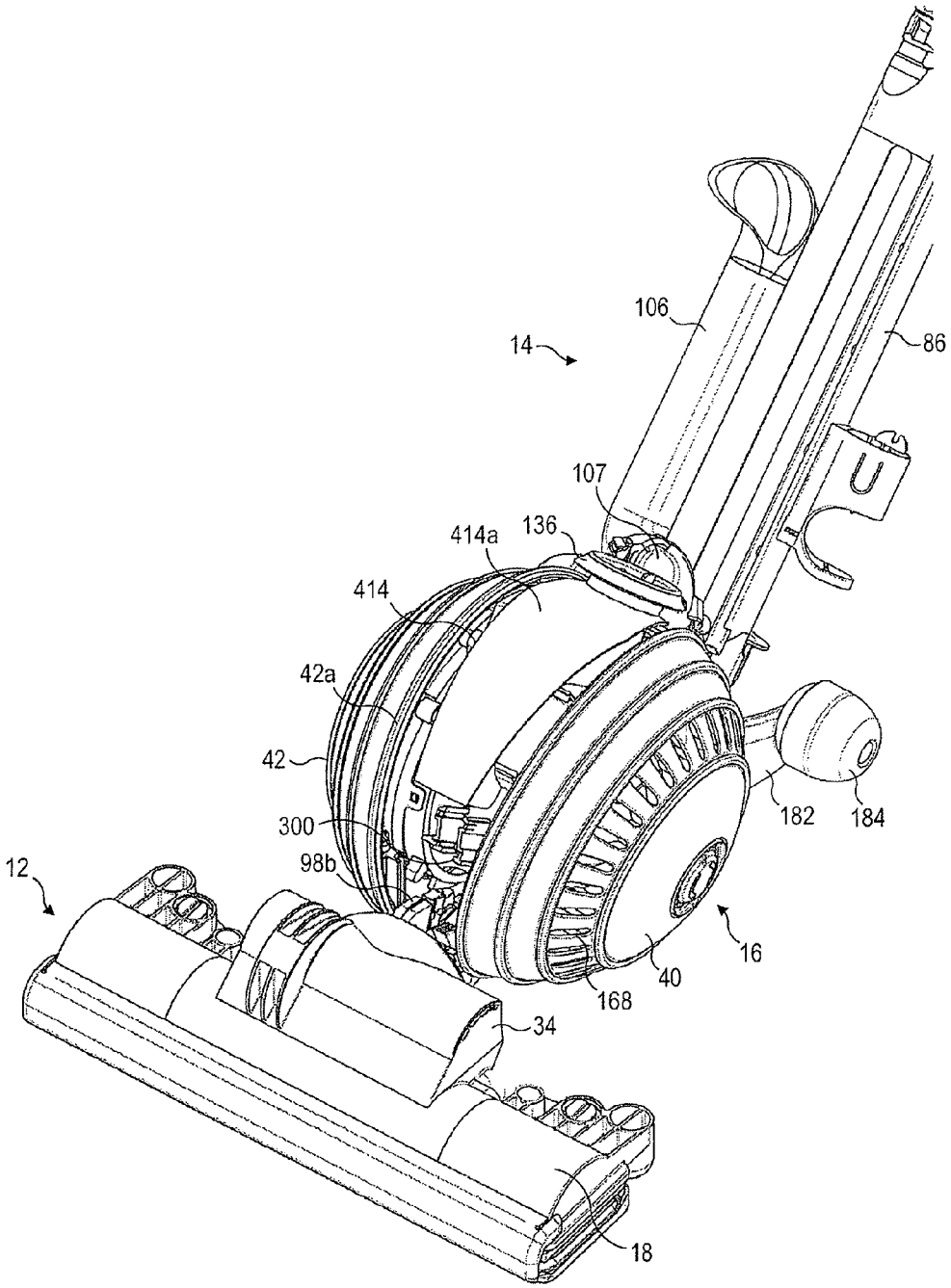
FIG. 11*d* is similar view as FIG. 11*c* but with the upper yoke section omitted.
Figure 11E:
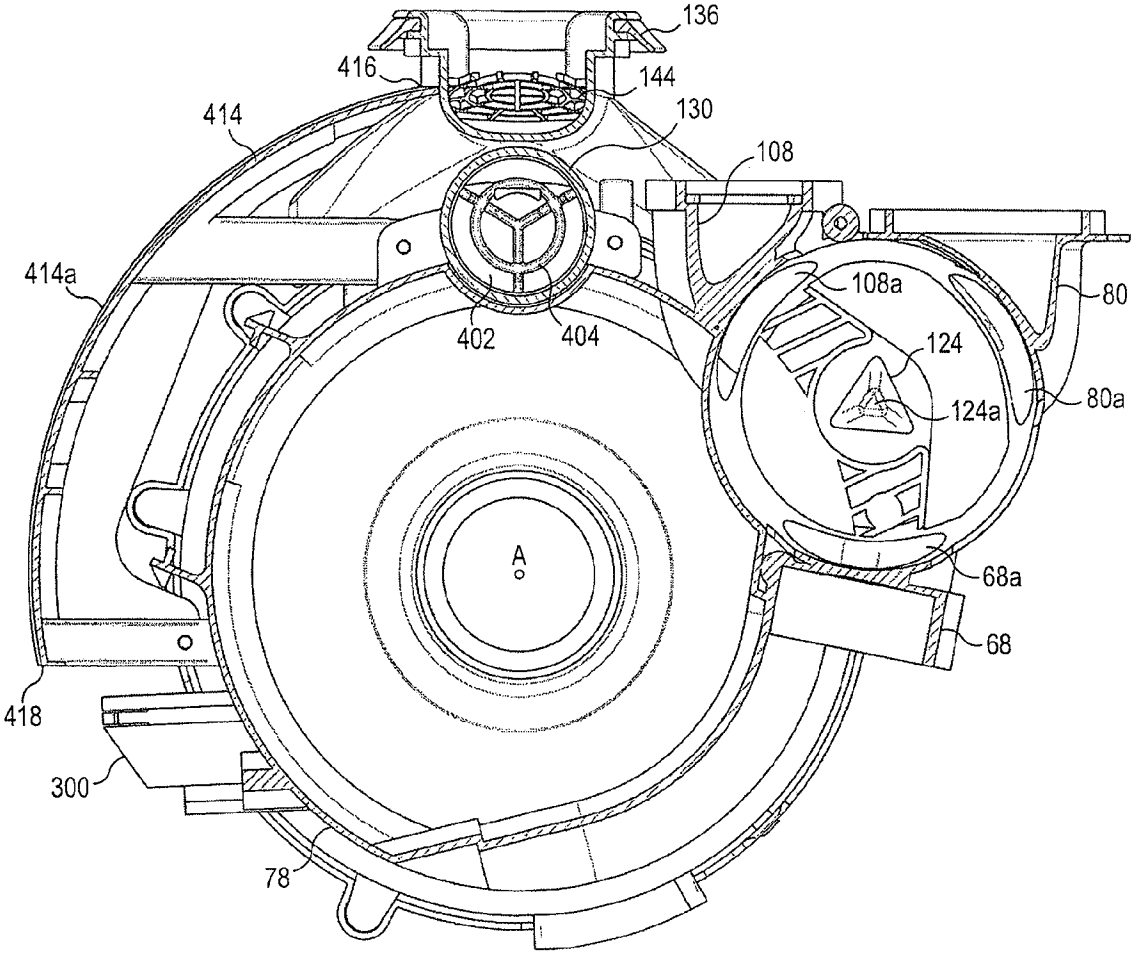
FIG. 11*e* is a vertical cross-sectional view illustrating the position of the shield relative to the motor casing.

With reference to FIGS. 11*a* and 11*b*, when the main body 14 is in its upright position the upper yoke section 46 is located over the shield 414, and so the shield 414 is hidden from view. As the main body 14 is reclined from its upright position to, for example, the reclined position illustrated in FIGS. 11*c* and 11*d* in which the stand 180 is in its retracted position, the motor casing 74 rotates about axis A relative to the yoke 26. Consequently, the shield 414 rotates relative to the upper yoke section 46. This results in the exposure of part of the shield 414. Due to the spherical curvature of the outer surface 414*a* of the shield 414, there is minimal disruption to the spherical appearance of the front of the support assembly 16 as the main body 14 is reclined from its upright position.

With the main body 14 in a reclined position and the stand 180 in its retracted position, the vacuum cleaner 10 can be moved in a straight line over a floor surface by simply pushing or pulling the handle 94 of the main body 14. With the pivot axis A of the main body 14 substantially parallel to the floor surface, both of the wheels 40, 42 engage the floor surface, and so rotate as the vacuum cleaner 10 is maneuvered over the floor surface. The pivotal mounting of the yoke 26 to the main body 14 allows the bottom surface 20 of the cleaner head 12 to be maintained in contact with the floor surface as the main body 14 is maneuvered over the floor surface. Returning to FIG. 5*a*, the bottom surface of the lower yoke section 44 comprises a pair of raised ribs 419. Each rib 419 comprises a curved lower surface. The radius of curvature of the lower surface of each rib 419 is slightly smaller than that of the inner surfaces of the wheels 40, 42. Each rib 419 is sized so that the lower surface thereof is spaced from the inner surface of its respective wheel 40, 42 when the main body 14 is in its upright position so that the wheels 40, 42 are raised above the floor surface. When the main body 14 is reclined, depending on the load applied to the vacuum cleaner 10 the rims 40*a*, 42*a* of the wheels 40, 42 may deform radially inwardly so that the inner surfaces of the wheels 40, 42 engage the lower surfaces of the ribs 419. This prevents excessive deformation of the wheels 40, 42. When a heavy load is applied to the main body 14, the curved lower surfaces of the ribs 419 can present a curved surface over which the inner surfaces of the wheels 40, 42 slide as the vacuum cleaner 10 is maneuvered over the floor surface.

To change the direction in which the vacuum cleaner 10 moves over the floor surface, the user twists the handle 94 to rotate the main body 14, in the manner of a corkscrew, about its longitudinal axis M, shown in FIGS. 2*a* and 3. With the cleaner head 12 free to rotate relative to the yoke 26, the bottom surface 20 of the cleaner head 12 can be maintained in contact with the floor surface as the main body 14, together with the yoke 26 and the wheels 40, 42, is rotated about its longitudinal axis M. As the main body 14 rotates about its longitudinal axis M, the cleaner head 12 rotates relative to the yoke 26 so as to turn in the direction in which the handle 94 has been twisted by the user. For example, twisting the handle 94 in a clockwise direction causes the cleaner head 12 to turn to the right. The pivot axis A of the main body 14 becomes inclined towards the floor surface which results, in this example, in the wheel 40 becoming spaced from the floor surface. The curved outer surface of the wheel 42 rolls over the floor surface, and so still provides support for the main body 14, while the wheel 42 continues to rotate about its rotational axis $R_2$ to turn the vacuum cleaner 10 to its new direction. The extent to which the handle 94 is twisted by the user determines the extent to which the cleaner head 12 turns over the floor surface.

When the user wishes to return the main body 14 of the vacuum cleaner 10 to its upright position, for example upon completing floor cleaning, the user raises the handle 94 so that the main body 14 pivots about the pivot axis A towards its upright position. As mentioned above, when the main body 14 is in its upright position the longitudinal axis M of the main body 14 is substantially vertical when the vacuum cleaner 10 is located on a horizontal floor surface. As the main body 14 is raised to its upright position, the motor casing 74 rotates about the axis A, and thus moves relative to the yoke 26. When the main body 14 reaches its upright position, the lower surfaces 300*a* of the arms 300 of the cleaner head retaining mechanism 280, which are connected to the motor casing 74, engage the upper surfaces 287*a* of a pair of columns 287 upstanding from the locking member housing 284, which is connected to the yoke 26, and which prevent the main body 14 from moving relative to the yoke 26 beyond its upright position.

As the main body 14 is returned to its upright position, the stand 180 is automatically moved towards its supporting position. Returning to FIGS. 13 and 15*a*, the main body 14 comprises a gear lever 420 which has a body 422 which is rotatably connected at the center thereof to the inner surface of the yoke arm 50 for rotation about axis B which is spaced from, and preferably substantially parallel to, the pivot axis A. The gear lever 420 further comprises a lever arm 424 and a gear portion 426. The lever arm 424 and the gear portion 426 each extend radially outwardly from the body 422 of the gear lever 420, the lever arm 424 being located diametrically opposite to the gear portion 426. The gear portion 426 comprises a plurality of teeth 428 which mesh with teeth 430 located on the outer periphery of the annular connector 196 located at the upper end of the supporting arm 192 of the stand 180.

As the main body 14 is raised from its fully reclined position, initially the biasing force of the torsion spring 200 maintains the stand 180 in its retracted position relative to the motor casing 74 and so the motor casing 74 and the stand 180 initially rotate together about the pivot axis A of the main body 14. The intermeshing of the teeth 428 of the gear lever 420 with the teeth 430 of the stand 180 causes the gear lever 420 to rotate in a first rotational direction relative to the yoke 26. When the main body 14 has been raised so that the main body 14 is inclined at an angle of around 15° from the upright position, a drive pin 440 located on the second motor casing section 78 engages the lever arm 424 of the gear lever 420, as illustrated in FIG. 15*d*. With further raising of the main body 14 towards its upright position, and thus rotation of the main casing 74 relative to the yoke 26, the drive pin 440 drives the gear lever 420 to rotate in a second rotational direction which is reverse to the first rotational direction. Due again to the intermeshing of the teeth 428 of the gear lever 420 with the teeth 430 of the stand 180, the rotation of the gear lever 420 in this reverse direction causes the stand 180 to start to rotate relative to the main casing 14, away from its supporting position and against the biasing force of the torsion spring 200. The gear ratio between the gear lever 420 and the stand 180 is at least 1:3, and preferably around 1:4 so that with each subsequent 1° pivotal movement of the main body 14 about its pivot axis A towards its upright position the stand 180 rotates around 4° relative to the motor casing 74 towards its supporting position.

The relative rotation between the main casing 14 and the stand 180 reduces the spacing between the ends 202, 204 of the torsion spring 200. This spacing now reaches a minimum, and so the torsion spring is at its over-center point, when the main body 14 has been raised so that, in this example, it is at an angle in the range from 1 to 5° from its upright position. As the main body 14 is raised further from this position, the biasing force of the torsion spring 200 urges the first end 202 of the torsion spring 200 away from the second end 204 of the torsion spring 200. This results in the automatic rotation of the stand 180 towards its supporting position so that the stabilizer wheels 184 of the stand 180 engage the floor surface.

As mentioned above, when the main body 14 is initially in its upright position and the stand 180 is in its supporting position the wheels 40, 42 of the support assembly 16 are raised above the floor surface so that the vacuum cleaner 10 is supported by a combination of the stabilizer wheels 184 of the stand 180 and the rollers 28 of the cleaner head 12. To return the vacuum cleaner 10 to this configuration the user is required to push the handle 94 of the main body 14 so that the main body 14 leans forward, beyond its upright position, by an angle which is preferably no greater than 10°. This prevents the center of gravity of the vacuum cleaner 10 from moving beyond the front edge of the bottom surface of the cleaner head 12, which in turn prevents the vacuum cleaner 10 from toppling forward, under its own weight, during this forward movement. This forward movement of the vacuum cleaner 10 causes both the cleaner head 12 and the main body 14 of the vacuum cleaner 10 to pivot about the front edge of the bottom surface 20 of the cleaner head 12, both raising the wheels 40, 42 from the floor surface and providing sufficient clearance between the vacuum cleaner 10 and the floor surface for the stand 180 to be urged by the torsion spring 200 beyond its supporting position until the front surface 450 of the body 188 of the stand 180 engages the rear surface 452 of the lower yoke section 44. The rear surface 452 of the lower yoke section 44 may be considered to provide a second stand stop member of the vacuum cleaner 10. The angular spacing about the pivot axis A between this second stand stop member and the first stand stop member 260 is preferably around 90°.

Figure 7D:
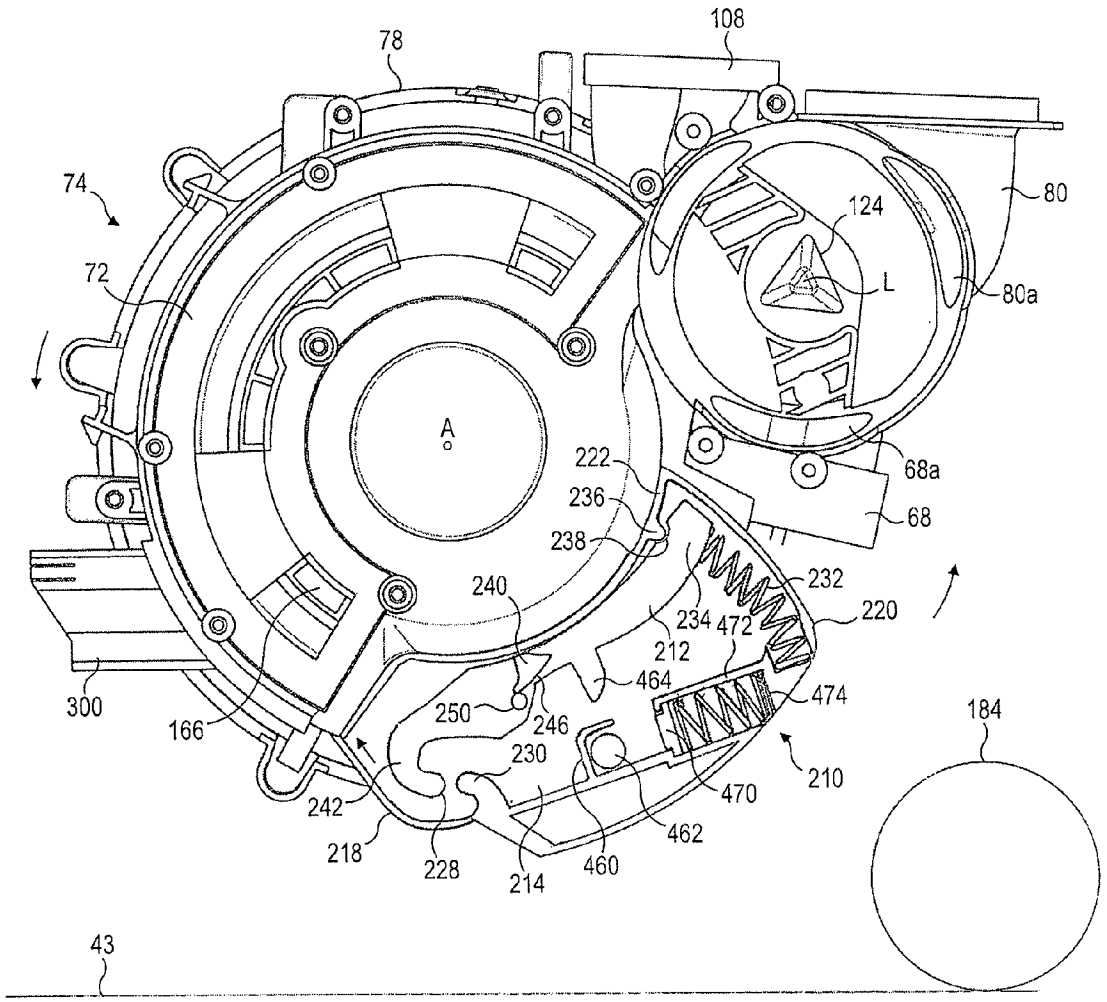
FIG. 7*d* is a similar side view illustrating the movement of the stand retaining mechanism as the main body is returned to its upright position.

As the stand 180 is urged towards the rear surface 452 of the lower yoke section 44 by the torsion spring 200, the stand pin 250 engages the third side face 246 of the protrusion 240 of the stand locking member 212. The torque that has to be applied to the main body 14 by the user in order to move the stand pin 250 relative to the protrusion 240 as the stand 180 is urged towards the second stand stop member is significantly less than that which is required to release the stand 180 from the stand retaining mechanism 210. The inclination of the third side face 246 of the protrusion 240 is such that the subsequent relative movement between the motor casing 74 and the stand 180 causes the stand locking member 212 to pivot upwardly about the ridge 238 of the housing 214 to allow the stand pin 250 to slide beneath the third side face 246 of the protrusion 240. As illustrated in FIG. 7*d*, the spring 232 of the stand retaining mechanism 210 tends to be pushed away from the side wall 220 of the housing 214 as the stand locking member 212 pivots about its second end 234, with the result that the spring 232 affords only a relative small resistance to the movement of the stand locking member 212 in comparison to when the user requires the stand 180 to be released from the stand retaining mechanism 210. This allows the stand pin 250 to slide along the third side face 246 of the protrusion 240 under the biasing force of the torsion spring 200 alone. Once the stand pin 250 has moved beyond the left end (as illustrated) of the third side face 246, the spring 232 returns the stand locking member 212 to the position illustrated in FIG. 7*a* so that the stand 180 is again retained in its supporting position by the first side face 242 of the protrusion 240. The main body 14 may now be returned to its upright position by the user so that the stabilizer wheels 184 contact the floor surface. Due this final movement of the stand 180 relative to the motor casing 74, the wheels 40, 42 of the support assembly 16 are spaced from the floor surface when the stabilizer wheels 184 engage that floor surface.

The rotation of the stand 180 back to its supporting position causes the switch actuating portion 392 of the annular connector 196 of the supporting arm 192 to push the spring-loaded cam of the brush bar activation switch mechanism against the switch of the switching mechanism. The actuation of the switch preferably occurs as the stand 180 is moved towards its supporting position by the over-center spring mechanism. Upon re-actuation, the switch is placed in a second electrical state in which power is no longer supplied to the motor 33 for driving the brush bar assembly 30.

The rotation of the stand 180 back to its supporting position also causes the valve member 112 of the changeover valve 110 to be driven back to its first position through engagement between the valve drive pin 380 of the stand 180 and the valve drive 340. The movement of the valve member 112 from its second position to its first position is the reverse of its movement from the first position to the second position. The symmetry of the profiles of the outer surface of the boss 124 and the inner surface 123 of the hub 122 means that the torque required to subsequently return the valve member 112 to its first position is substantially the same as the torque required to move the valve member 112 to the second position.

Simultaneously with the movement of the stand 180 to its supporting position, the locking member 282 of the cleaner head retaining mechanism 280 is returned to its deployed position. Returning to FIGS. 14*b*, 14*c* and 14*d*, when the main body 14 is raised so that it is inclined at an angle of around 15° to its upright position the drive face 318 of the actuator 298 re-engages the driven face 320 of the locking member 282. As the main body 14 continues to move towards its raised position, under the action of the spring 306 the actuator 298 pushes the locking member 282 back towards its deployed position, against the biasing force of the spring 314. With the cleaner head 12 angularly positioned relative to the yoke 26 so that the groove 296 on the cleaner head 12 is aligned with the aperture 294 of the yoke 26, the fingers 292 of the locking member 282 re-enter the groove 296 to lock the angular position of the cleaner head 12 relative to the yoke 26. Once the main body 14 has been raised so that it is inclined at an angle of around 7° to its upright position, the locking member 282 has been urged back to its deployed position by the drive face 318 of the actuator 298, as shown in FIG. 14*b*, The locking member 282 is maintained in its deployed position through the engagement between the front face 308 of the actuating member 298 and the rear face 310 of the locking member 282.

In the event that the groove 296 on the cleaner head 12 is not correctly aligned with the aperture 294 of the yoke 26, there is a risk that the end of at least one of the fingers 292 of the locking member 282 will engage the end of the collar 297. This will prevent the fingers 292 from re-entering the groove 296 with further raising of the main body 14 towards its upright position. In the event that the user continues to raise the main body 14 to its upright position, the biasing force of the spring 306 is chosen so that it will compress to allow the actuating member 298 simultaneously to move towards the motor casing 74 along the tracks 304 of the arms 300 and to slide over the now stationary locking member 282. This prevents permanent damage to one or more of components of the cleaner head retaining mechanism 280, the motor casing 74 and the cleaner head 12. Once the main body 14 has moved relative to the cleaner head 12 so that the aperture 294 and the groove 296 are aligned, the biasing force of the spring 306 will urge both the actuator 298 and the locking member 282 away from the motor casing 74 so that the locking member 282 moves to its deployed position.

When the main body 14 is in its upright position, the vacuum cleaner 10 may be maneuvered over a floor surface by pulling the handle 94 downward so that the vacuum cleaner 10 tilts backwards on the stabilizer wheels 184 of the stand 180, raising the bottom surface of the cleaner head 12 from the floor surface. The vacuum cleaner 10 can then be pulled over the floor surface, for example between rooms of a building, with the stabilizer wheels 184 rolling over the floor surface. This maneuvering of the vacuum cleaner 10 when in this orientation relative to the floor surface is hereafter referred to as "wheeling" of the vacuum cleaner 10 over the floor surface so as to differentiate this movement of the vacuum cleaner 10 from that taking place during floor cleaning. We have observed that a user tends to tilt the vacuum cleaner by an angle of at least 30°, more usually by an angle in the range from 40 to 60°, to place the handle 94 of the main body 14 at a comfortable height for pulling the vacuum cleaner 10 over a floor surface. The shape of the stabilizer wheels 184 aids a user in guiding the vacuum cleaner 10 between rooms. In this example the face of each stabilizer wheel 184 which is furthest from the supporting leg 182 is rounded to provide smooth running on a variety of floor surfaces.

The stand retaining mechanism 210 is preferably arranged to increase the force required to release the stand 180 from the stand locking member 212 when the vacuum cleaner 10 is reclined for wheeling over a floor surface. This can reduce the risk of accidental movement of the stand 180 to its retracted position relative to the motor casing 74 as the vacuum cleaner 10 is wheeled over the floor surface, which could result in the sudden, and inconvenient, "bumping" of the vacuum cleaner 10 down on to the floor surface.

Returning to FIGS. 7*a* to 7*c*, the base 216 of the housing 214 is inclined relative to the horizontal, in this example by an angle of at least 20°, when the main body 14 is in its upright position so that the base 216 slopes downwardly towards the side wall 218 of the housing 214. The base 216 comprises a relatively short wall 460 upstanding therefrom between the side walls 218, 220 of the housing 214. A ball bearing 462 is located on the base 216, between the side wall 220 and the wall 460 of the housing 214 so that the ball bearing 462 rolls, under gravity, against the wall 460 of the housing 214. The stand locking member 212 further comprises a fin 464 depending downwardly between the first end 224 and the second end 232 thereof. The fin 464 comprises a relatively straight first side surface 466 and a curved second side surface 468. The wall 460 of the housing 214 and the fin 464 of the stand locking member 212 are arranged so that, as the stand locking member 212 pivots about the tip 228 of its first end 224 between the positions illustrated in FIGS. 7*a* and 7*b* when the main body 14 is reclined from its upright position, the first side surface 466 of the fin 464 does not contact the ball bearing 462.

Figure 17A:
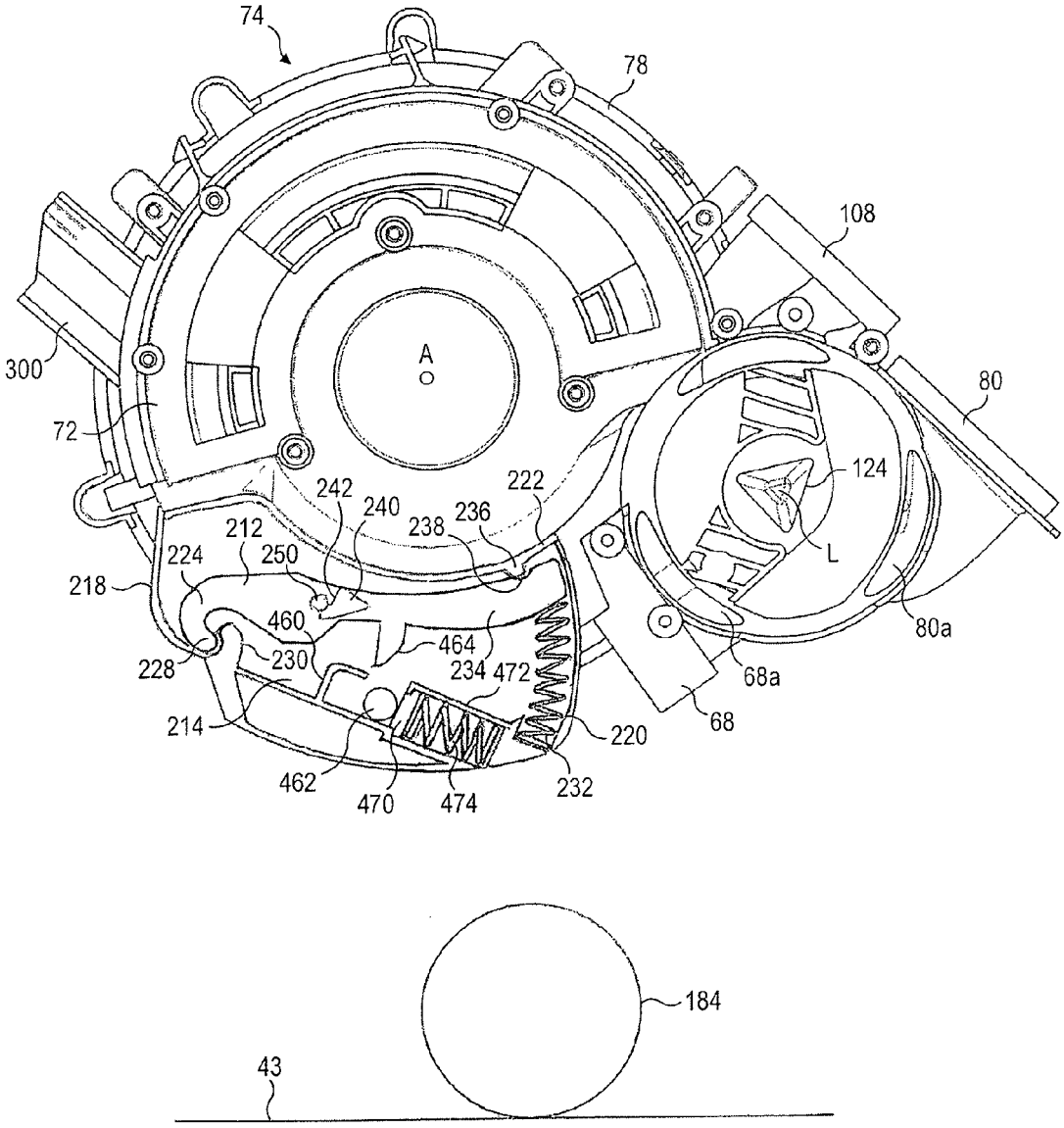
FIGS. 17*a* and 17*b* are similar views as FIGS. 7*a* and 7*b* when the vacuum cleaner is reclined by around 45° about the stabilizer wheels of the support.
Figure 17B:
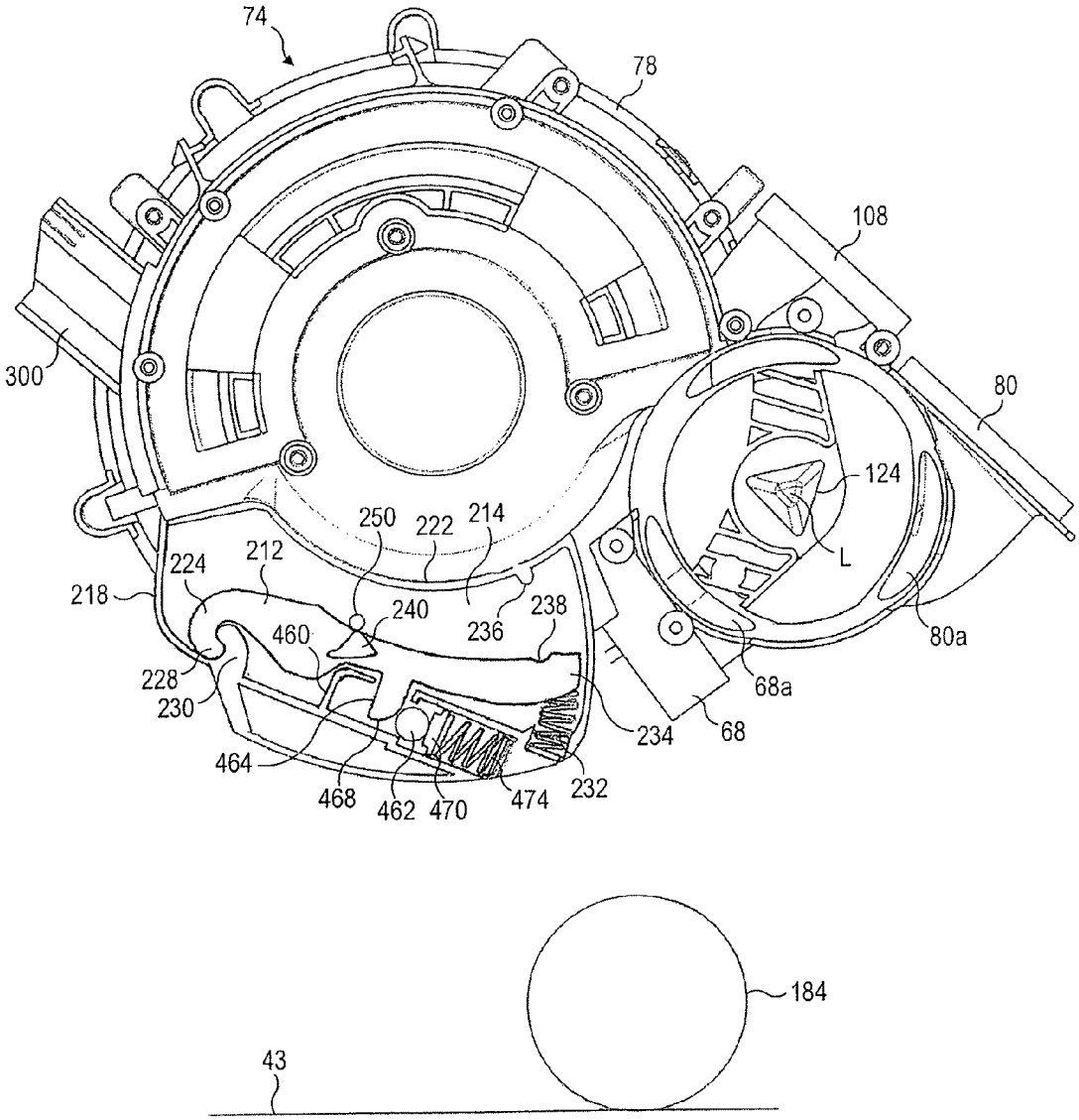

FIGS. 17*a* and 17*b* illustrate the orientation of the motor casing 74 when the vacuum cleaner 10 has been tilted backwards on to the stabilizer wheels 184 of the stand 180 for wheeling over the floor surface. The rotation of the motor casing 74 results in the base 216 of the housing 214 now sloping downwardly towards the side wall 220 of the housing 214, which causes the ball bearing 462 to roll under gravity away from the wall 460. The motion of the ball bearing 462 is checked by a side surface of a piston 470 located within a piston housing 472 forming part of the housing 214 of the stand retaining mechanism 210. A compression spring 474 located within the piston housing 472 urges the piston 470 towards the wall 460 and against an annular seat of the piston housing 472. The seat of the piston housing 472 is shaped so as to allow the ball bearing 462 to enter the piston housing 472, against the biasing force of the spring 474.

In the event of a force being applied to the stand 180 as the vacuum cleaner 10 is wheeled over the floor surface which would tend to cause the stand 180 to rotate towards its retracted position, the increased force acting between the stand pin 250 and the protrusion 240 of the stand locking member 212 can cause the stand locking member 212 to rotate about the tip 228 of its first end 224, against the biasing force of the spring 232. The fin 464 of the stand locking member 212 and the piston housing 472 are arranged such that before the stand pin 250 is released by the stand locking member 212, the curved second side surface 468 of the fin 464 contacts the ball bearing 462 so as to urge the ball bearing 462 against the piston 470. The biasing force of the spring 474 acting on the piston 470 resists the movement of the ball bearing 462 into the piston housing 472, which in turn increases the resistance to the rotation of the stand locking member 212 about the tip 228 of its first end 224. Thus, in order to release the stand 180 from the stand retaining mechanism 210 the force applied to the stand pin 250 must now be able be sufficiently large as to move the stand locking member 212 to the position illustrated in FIG. 17*b* against the biasing forces of both springs 232, 474 of the stand retaining mechanism 210.

With the locking member 282 of the cleaner head retaining mechanism 280 in its deployed position, the cleaner head 12 is prevented from rotating relative to the yoke 26 as the vacuum cleaner 10 is wheeled over the floor surface. When the vacuum cleaner 10 is tilted on to the stabilizer wheels 184 of the stand 180 the weight of the cleaner head 12 urges the rear surface 452 of the lower yoke section 44 against the front surface 450 of the body 188 of the stand 180. However, as the movement of the stand 180 relative to the motor casing 74, and so the main body 14, is restrained by the stand retaining mechanism 210, the stand retaining mechanism 210 thus serves also to restrain the rotation of the yoke 26 relative to the main body 14 as the vacuum cleaner 10 is wheeled over the floor surface. The stand retaining mechanism 210 and the cleaner head retaining mechanism 280 thus serve to inhibit rotation of the cleaner head 12 relative to the main body 14 about two substantially orthogonal axes, respectively the pivot axis A and the axis of rotation of the cleaner head 12 relative to the yoke 26, as the vacuum cleaner 10 is wheeled over the floor surface, which rotation could otherwise obstruct the movement of the vacuum cleaner 10.

In the event that the cleaner head 12 is subjected to an impact, or its movement with the main body 14 of the vacuum cleaner 10 is restricted by engagement with an item of furniture or the like, as the vacuum cleaner 10 is wheeled over the floor surface, then the cleaner head 12 can be released for movement relative to the main body by the stand retaining mechanism 210 or the cleaner head retaining mechanism 280 as appropriate to prevent any part of the vacuum cleaner 10 from breaking.

As a first example, if the cleaner head 12 is subjected to an impact in a direction opposite to that in which the vacuum cleaner 10 is being pulled over the floor surface, then the force of the impact will be transferred to the stand 180 through the engagement between the rear surface 452 of the lower yoke section 44 and the front surface 450 of the body 188 of the stand 180. Depending on the magnitude of this force, the force acting between the protrusion 240 on the stand locking member 212 and the stand pin 250 may increase sufficiently so as to cause the stand pin 250 to be released from the stand restraining mechanism 210. This can now enable both the stand 180 and the yoke 26 to pivot about the pivot axis A of the main body 14, thereby allowing the cleaner head 12 to move relative to the main body 14. In the event that the magnitude of the force of the impact is insufficient to release the stand 180 from the stand retaining mechanism 210, then the force of the impact can be absorbed through compression of the springs 232, 474 of the stand locking mechanism 210.

Figure 18:
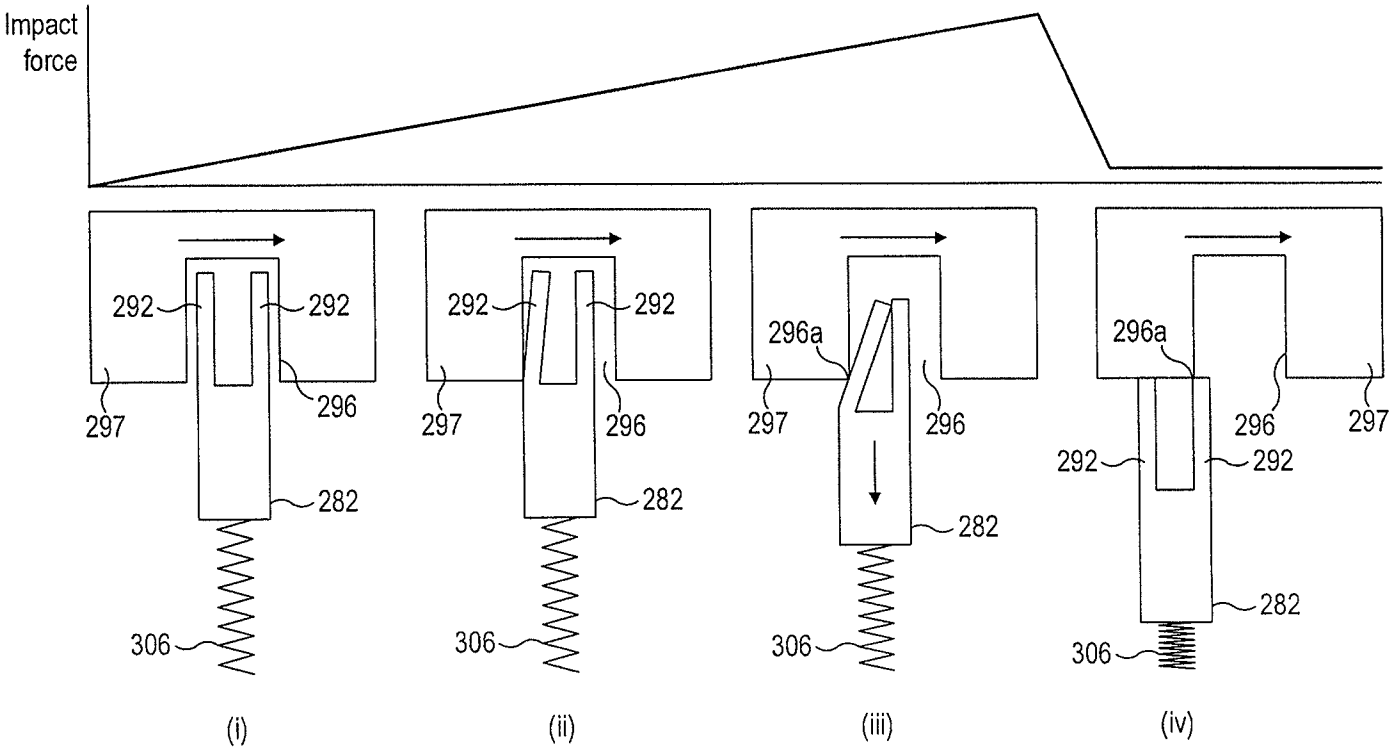
FIG. 18 illustrates schematically the release of the cleaner head by the cleaner head retaining mechanism when the cleaner head is subjected to a rotational force relative to the yoke.

As a second example, if the cleaner head 12 is subjected to an impact which causes the cleaner head 12 to rotate about its axis of rotation relative to the yoke 26, then the side of the groove 296 formed in the collar 297 of the cleaner head 12 would be urged against the side surface of one of the fingers 292 of the locking member 282. With reference to the sequence of images (i) to (iv) of FIG. 18, the locking member 282 is preferably formed from resilient material to allow that finger 292 of the locking member 282 to bend towards the other finger 292 under the bending force applied thereto by the collar 297 of the cleaner head 12. Depending on the force of the impact the edge 296*a* of the groove 296 can move along the side surface of the bent finger 292, thereby pushing the locking member 282 away from the groove 296 against the biasing force of the spring 306. If the magnitude of the force of the impact is sufficiently high as to push the fingers 292 of the locking member 282 fully from the groove 296, then the cleaner head 12 is free to rotate relative to the yoke 26 under the force of the impact. The connection between the electrical connectors 98*a*, 98*b* is preferably a push-fit connection to allow this connection to be broken upon relative rotation between the cleaner head 12 and the yoke 26.

The invention claimed is:

1. A surface treating appliance comprising:

a surface treating head;

a hose; and a main body comprising a fan unit for generating a flow of fluid, and a rotary changeover valve comprising a valve member which is selectively rotatable between a first position allowing fluid flow between the hose and the fan unit, and a second position allowing fluid flow between the surface treating head and the fan unit, the valve member comprising a hub having an internal surface shaped to receive a boss about which the valve member is selectively rotatable, wherein the external surface of the boss and the internal surface of the hub are shaped to impart a translational movement of the valve member along the boss as the valve member is rotated about the boss.

2. The appliance of claim 1, wherein each of the external surface of the boss and the internal surface of the hub has a profile generally in the shape of a prism.

3. The appliance of claim 1, wherein each of the external surface of the boss and the internal surface of the hub has a profile generally in the shape of a triangular prism.

4. The appliance of claim 1, wherein the external surface of the boss tapers towards the valve member.

5. The appliance of claim 1, wherein the internal surface of the hub tapers away from the boss.

6. The appliance of claim 1, wherein the changeover valve comprises a valve drive for driving the valve member between its first and second positions.

7. The appliance of claim 6, wherein the valve drive is rotatable about the longitudinal axis of the boss.

8. The appliance of claim 6, wherein the valve member is located between the boss and the valve drive.

9. The appliance of claim 6, comprising at least one biasing member for biasing the valve member away from the valve drive along the longitudinal axis of the boss.

10. The appliance of claim 6, wherein the valve drive comprises a pair of drive arms, and wherein the valve drive comprises a lever which is received between the drive arms of the valve drive.

11. The appliance of claim 6, comprising a stand moveable between a supporting position, in which it supports the main body, and a retracted position, the stand being arranged to induce movement of the valve drive as it moves between its supporting and retracted positions.

12. The appliance of claim 11, wherein the stand comprises a drive pin arranged to engage a slot on the valve drive as the stand moves between the supporting and retracted positions.

13. The appliance of claim 1, in which the valve member comprises an elbow-shaped conduit having a fluid port located at each end thereof.

14. The appliance of claim 1, wherein the changeover valve comprises a valve body comprising a first section for receiving fluid flow from the surface treating head, a second section for receiving fluid flow from the hose, and third section for conveying fluid flow towards the fan unit.

15. The appliance of claim 14, wherein the sections of the valve body are angularly spaced about a circular path defined by the valve body.

16. The appliance of claim 15, wherein the sections of the valve body are equally angularly spaced about the circular path.

17. The appliance of claim 1, wherein the boss is connected to the main body.

18. The appliance of claim 17, wherein the boss is connected to a casing housing the fan unit.

19. A surface treating appliance comprising:

a surface treating head;

a hose; and a main body comprising a fan unit for generating a flow of fluid, and a rotary changeover valve, the rotary changeover valve comprising a valve body and a valve member which is selectively rotatable between a first position allowing fluid flow between the hose and the fan unit, and a second position allowing fluid flow between the surface treating head and the fan unit, a seal being provided between the valve body and the valve member in the first position, the valve member comprising a hub having an internal surface shaped to receive a boss about which the valve member is selectively rotatable, wherein the external surface of the boss and the internal surface of the hub are shaped to impart a translational movement of the valve member along the boss as the valve member is rotated about the boss, thereby to facilitate breaking of the seal between the valve body and the valve member.

* * * * *